US006470679B1

(12) United States Patent
Ertle

(10) Patent No.: US 6,470,679 B1
(45) Date of Patent: Oct. 29, 2002

(54) APPARATUS AND METHOD FOR TRANSFERRING ENTROPY WITH THE AID OF A THERMODYNAMIC CYCLE

(76) Inventor: Thomas Ertle, Pfarrsteig 19, Langenau, B9129 (DE)

( * ) Notice: Subject to any disclaimer, the term of this patent is extended or adjusted under 35 U.S.C. 154(b) by 0 days.

(21) Appl. No.: 09/509,388

(22) PCT Filed: Sep. 23, 1998

(86) PCT No.: PCT/DE98/02827

§ 371 (c)(1),
(2), (4) Date: Jun. 21, 2000

(87) PCT Pub. No.: WO99/17011

PCT Pub. Date: Apr. 8, 1999

(30) Foreign Application Priority Data

Sep. 26, 1997 (DE) ..... 197 42 520
Sep. 26, 1997 (DE) ..... 197 42 660

(51) Int. Cl.[7] ..... F01B 29/00

(52) U.S. Cl. ..... 60/512; 60/515; 60/526; 60/530

(58) Field of Search ..... 60/508, 512, 515, 60/517, 526, 530

(56) References Cited

U.S. PATENT DOCUMENTS 3,845,624 A * 11/1974 Roos ..... 60/517
3,879,945 A * 4/1975 Summers
3,986,359 A * 10/1976 Manning et al. ..... 60/508
4,270,351 A * 6/1981 Kuhns ..... 60/508 X
4,414,812 A * 11/1983 Parry
4,442,670 A * 4/1984 Goldman
5,337,562 A * 8/1994 Kleinwaechter
5,353,596 A * 10/1994 Siegel

FOREIGN PATENT DOCUMENTS

| | | | |
|---|---|---|---|
| DE | 2835592 | * | 2/1980 |
| DE | 2928316 | * | 1/1981 |
| DE | 3607432 | * | 9/1987 |
| DE | 3826117 | * | 2/1990 |
| WO | 6281 | * | 4/1992 |

* cited by examiner

*Primary Examiner*—Hoang Nguyen
(74) *Attorney, Agent, or Firm*—Dority & Manning, P.A.

(57) ABSTRACT

The invention relates to regenerative working and thermal processes, the drive energy of which is supplied by external combustion of the fuel. The heat supply for this, almost always assumed to be isothermic, is achieved only in exceptional cases, since the flue gases usually have a low specific thermal capacity. The invention explains new types of processes in order to obtain the optimum thermodynamic efficiency even for these less efficient heating cases. The heating heat exchangers and thermal regenerators used in regenerative processes are replaced by regenerative heat exchangers, which comprise a plurality of short regenerators, which are connected by tubular heat exchangers for the heating medium. It is thereby possible to supply the heat to the process not at a fixed but at a sliding temperature. In the same way, regenerative coolers are used for the dissipation of heat from Stirling engines and regenerative heat pumps or refrigeration machines, if, for example, only air is available as heat transfer medium.

26 Claims, 31 Drawing Sheets

APPARATUS AND METHOD FOR TRANSFERRING ENTROPY WITH THE AID OF A THERMODYNAMIC CYCLE

PROBLEM

In the case of the transfer of entropy as, for example, in the use of solar energy or heat sources, such as the combustion of biomass, waste heat or geothermal heat, for example, for a required local supply for pumping power, mechanical drive, electrical energy, for provision of heat, the production of cold, cleaning or separating or the chemical or physical alteration of at least one substance by coupling to a periodically proceeding thermodynamic cycle, the aim is to render as low as possible the necessary outlay on energy carriers or mechanical energy, as well as the design, technological, financial or ecological outlay for

- the construction of the entire apparatus, or the operating sequence of the entire method,
- the thermal or mechanical energy transport(s) required in this case,
- the methods or apparatuses which can be used in this case for the mechanical energy conversion, or
- an integrated energy storage mechanism.

The thermodynamic cycles used so far (Stirling engine, steam turbine) are coupled in each case to two heatbaths at a constant temperature. As a result, energy transport can be performed only optically (in conjunction with parabolic mirrors or optical conductors) are via a material flow with a phase transition (heatpipe). Because the aim is an isothermal exchange of heat energy, the thermal energy can be stored only in chemical stores or in PCM devices. As a result, the outlay on concentrating the energy by the collector, on the transport and on a storage which is desirable for many applications becomes all too often excessive. If the aim is direct supply with cold or compressed air, for example, with as little an outlay as possible on apparatus, it is necessary in the case of many known systems to select the path passing via the interface of electrical power.

Object

In the case of a method and/or an apparatus for transferring entropy as in the use of solar energy or heat sources, such as the combustion of biomass, waste heat or geothermal heat, for example, for a required local supply for pumping power, mechanical drive, electrical energy, for provision of heat, the production of cold, cleaning or separating or the chemical or physical alteration of at least, one substance by coupling to a periodically proceeding thermodynamic cycle, whose efficiency is as high as possible, the central object of the invention is to render as low as possible the necessary outlay on energy carriers or mechanical energy, as well as the design, technological, financial or ecological outlay for

- the construction of the entire apparatus, or the operating sequence of the entire method,
- the thermal or mechanical energy transport(s) required in this case,
- the methods or apparatuses which can be used in this case for the mechanical energy conversion, or
- an integrated energy storage mechanism.

The above is achieved by means of an apparatus and a method for transferring entropy. At least one working volume filled with a working fluid is largely delimited from other spaces or the surroundings, by at least one valve and at least one pressure housing, optionally without or with a mechanical compression device such as, for example, one or more pistons, liquid pistons or diaphragms, and optionally at least one liquid boundary surface or none, in which:

- in each case at least two mutually delimitable structures or structural elements through which working fluid is to flow in a period with a maximum quantity and which have heat transfer surfaces necessarily active for the thermodynamic process, in which in the operating state in each case isothermal surfaces of different temperature which are to be flowed through by the working fluid are formed,
- optionally at least one or no element or structural element such as for example, a (foldable) diaphragm, folded, telescopic or resilient sheets, a regenerator structure of changeable shape or a liquid boundary surface, which is arranged between said structures or structural elements in a connecting and largely sealing fashion or is equipped with the action of a regenerator,
- or at least one or no displacer piston which can be moved in this working volume,
- and the limitation of the working fluid delimit at least one partial volume with a minimum size in a fashion largely free from overlap with a comparable volume and are partly caused by control system elements acting thereon by which, predominantly in those time periods of the periodically proceeding thermodynamic cycle, the ratio of this partial volume to this working volume is either enlarged or reduced during which the size of this working volume is changed in size only to a lesser degree. Depending on the pressure of the working fluid in this working volume, in each case at least one specific valve whose opening and closing times decisively influence the thermodynamic cycle, and which valve can delimit this working volume from at least one external space which is filled up with at least one working means in conjunction with partially differing pressures which are subjected to fluctuations which are only smaller relative to the periodic pressure change in this working volume during these time periods, is predominantly (in the time periods characterized above) held open by the control system or the flow pressure and flowed through. The valve is held closed during other time periods which proceed between these time period and in which the pressure of the working fluid in this working volume either rises or falls through the displacement of the above-named or further components or structural elements by the control system and the variation thereby caused in the mean temperature of the working fluid in this working volume and/or by a variation in the size of this working volume by the mechanical compression device, and the ratio of each partial volume as defined above to this working volume is varied only to a decisively lesser extent, wherein during a time interval which is much longer relative to the period there is either an absorption or output of thermal energy at least of one substance of a continuous or periodically swelling and subsiding mass flow in conjunction with a sliding temperature or with a plurality of temperature levels, and in this working volume at least one working means acts at least partially as a working fluid which traverses the periodic thermodynamic cycle.

The method according to the invention proceeds in an apparatus for transferring entropy, in which at least one working volume filled with a working fluid is largely delimited from other spaces or the surroundings, by at least one valve and at least one pressure housing, optionally without or with a mechanical compression device such as, for example, one or more pistons, liquid pistons or diaphragms, and optionally at least one liquid boundary surface or none, in which:

in each case at least two mutually delimitable structures or structural elements through which working fluid is to flow in a period with a maximum quantity and which have heat transfer surfaces necessarily active for the thermodynamic process, in which in the operating state in each case isothermal surfaces of different temperature which are to be flowed through by the working fluid are formed, optionally at least one or no element or structural element such as for example, a (foldable) diaphragm, folded, telescopic or resilient sheets, a regenerator structure of changeable shape or a liquid boundary surface, which is arranged between said structures or structural elements in a connecting and largely sealing fashion or is equipped with the action of a regenerator, or at least one or no displacer piston which can be moved in this working volume, and the limitation of the working fluid delimit at least one partial volume with a minimum size in a fashion largely free from overlap with a comparable volume and are partly caused by control system elements acting thereon by which, predominantly in those time periods of the periodically proceeding thermodynamic cycle, the ratio of this partial volume to this working volume is either enlarged or reduced during which the size of this working volume is changed in size only to a lesser degree. Depending on the pressure of the working fluid in this working volume, in each case at least one specific valve whose opening and closing times decisively influence the thermodynamic cycle, and which valve can delimit this working volume from at least one external space which is filled up with at least one working means in conjunction with partially differing pressures which are subjected to fluctuations which are only smaller relative to the periodic pressure change in this working volume during these time periods, is predominantly (in the time periods characterized above) held open by the control system or the flow pressure and flowed through. The valve is held closed during other time periods which proceed between these time periods and in which the pressure of the working fluid in this working volume either rises or falls through the displacement of the above-named or further components or structural elements by the control system and the variation thereby caused in the mean temperature of the working fluid in this working volume and/or by a variation in the size of this working volume by the mechanical compression device, and the ratio of each partial volume as defined above to this working volume is varied only to a decisively lesser extent, wherein during a time interval which is much longer relative to the period there is either an absorption or output of thermal energy at least of one substance of a continuous or periodically swelling and subsiding mass flow in conjunction with a sliding temperature or with a plurality of temperature levels, and in this working volume at least one working means acts at least partially as a working fluid which traverses the periodic thermodynamic cycle.

The overall cycle in a working volume can be assigned a plurality of cycles, running in parallel, between in each case two heat reservoirs at constant temperatures, when viewed in the light of acceptable idealization. Each heat reservoir of these cycles can be assigned a partial volume of the working volume, which partial volume is filled with working fluid and defined as above. At least one substance of a continuous or periodically swelling and subsiding mass flow is thus heated or cooled either by absorbing or outputting thermal energy in conjunction with a temperature difference which is small relative to the total temperature change upon contact with the hotter or colder heat reservoir of these cycles, it being possible for the phase or chemical composition to be transformed. In order to use the solar energy, at least one substance of a continuously or periodically swelling and subsiding mass flow is fed thermal energy in conjunction with a sliding temperature or a plurality of temperature levels.

When constructing the integrated collector, the following principles can be very effectively combined on the basis of the temperature change over a large temperature interval:

optical concentration translucent insulation and flow through the translucent insulation. The thermal energy can be exchanged very efficiently and cost effectively with the aid of a sensitive accumulator which has a large surface, such as a gravel bulk fill, for example, in conjunction with a through flow of working means. The thermal energy transport can be performed by a movement of a capacitive working means such as air, for example. The pressure change of at least one working means also leaves open the possibility of using a highly problem-free infrastructure to transport the mechanical energy or as an interface for simple further transfer or transformation in order to solve more concrete problems.

These problems have already been taken up in part in Patent DE 3607432 A1. This patent contains a representation of the theoretical principles of a cycle. Citation: column 3, line 45: "Vorliegende Erfindung liefert die Erkenntnisse und praktischen Verfahren, um auch mit einer Wärmezufuhr bei gleitender Temperatur den Carnot-Wirkungsgrad erreichen zu können" ["The present invention provides the knowledge and practical experience to be able to achieve the Carnot efficiency even when feeding heat in conjunction with sliding temperature."]. The concept for a corresponding heat engine was presented by the applicant of the cited patent in the conference volume of the 6th International Stirling Engine Conference 1993, 26–27–28 May in Eindhoven (Netherlands).

The cited patent does not set forth a physical (phase) and/or chemical change by a transformation of thermal energy over a wide temperature interval, although these problems can be traced back to the same core problem: Because of the variable ratio of the partial pressures, liquefying a portion of the gas mixture generally requires extraction of thermal energy over a temperature interval. Consequently, when evaporating a gas mixture it is necessary to feed thermal energy over a temperature interval or in conjunction with a plurality of temperatures.

Similar statements also hold for a chemical process in which thermal energy is absorbed or output in conjunction with a plurality of temperatures or in a temperature interval.

The preamble and the main claim of the patent cited in excerpts include a limitation to regenerative driven machines or heat engines in the case of which the working volume available to the working fluid is divided into only two periodically variable partial volumes by a rigidly connected structure, which is to be flowed through, of regenerator, cooler and heater as in the known Stirling engines.

Stirling engines with appropriate volumes, temperature differences and speeds such as the machine described in the cited patent are successively described by an isothermal model. Cf.: "Studie über den Stand der Stirling-Maschinen Technik" ["Study on the status of Stirling engine technology"]; 1995 in the commission of BMBF; development code: 0326974; page 55 ff Chapter 3.2 ff. The contact made by the working gas with the cylinder walls or the heat exchangers adjoining the partial volumes exhibits no difference, which relates to the application of this model. If this model is applied to the machine described in the cited patent, it must be established that the working gas in the heated partial volume of the working volume expands predominantly isothermally at the temperature of $T_1$ whenever the partial volume cooled at the temperature Tk is smaller, and is predonmiantly isothermally compressed whenever the ratio of the partial volumes is inverse. The working gas in this case traverses a cycle between two heat reservoirs from which or to which thermal energy is extracted or fed at constant temperatures in each case. Except for the cycle of the working gas, with this machine there is no cycle to which it is possible to assign a relevant area in the temperature-entropy diagram or in the pressure-volume diagram. Without violating the second law of thermodynamics, thermal energy, which is fed to the machine at a temperature below $T_1$ can be transported to the cooler only by irreversible phenomena. Similarly, thermal energy which is extracted from a machine above Tk can be transported only be irreversible phenomena and must originate from the heater, since no relevant cycle proceeds in the machine which pumps thermal energy from the temperature level of the coldest partial volume of the working volume filled with gas to the higher temperature level. It is scarcely to be imagined on the basis of this model that the machine described in the cited patent achieves the object set.

In the case of the apparatuses and/or methods not cited, the mechanical work which is fed (consumed) or output (obtained) during a period of the overall cycle for the purpose of compensating the energy balance is for the most part directly converted during the transfer of at least one specified quantity of at least one flowable substance from one storage space into another storage space at a different pressure. Other systems or methods can thereby be integrated simply: Direct use of the pressure change, for example by replacing a mechanically driven compressor, or decoupling the movements in the working volume from the driving shaft of a turbine or a compressor or the like, which turbine/compressor is driven by the pressure difference in the substance flowing (in the closed circuit), or generates this. It is thereby possible, for example, to drive a generator at the usual angular velocity, and to achieve a flow rate of the working fluid of the order of magnitude of 1 m/s against the heat transfer surfaces, and a correspondingly low temperature difference in the case of the heat transfer, and this has a positive effect on the efficiency and reduces the accelerations, occurring at the control system, and the flow losses. This permits a design of large volume in which the pressure in the working volume is in the region of the atmospheric pressure and air is used as working fluid, as a result of which many problems relating to tightness are defused and interesting applications become possible (cf. Examples of Application).

Compared with the abstract formulation of the object as selected above, the cited patent is limited to cooling or heating a heating or cooling medium by thermal contact with heat exchangers of a regenerative driven machine or heat engine. This rules out a reduction in the outlay on design or technology for heat exchangers or regenerators, which is achieved according to the invention when heat is fed into the working volume by virtue of the fact that the heating medium is admitted as a hot gas, for example, into the working volume through valves and output again at a lower temperature through a valve (or valves), as a result of which, moreover, the dead volumes of the working volume can be reduced and, in accordance with experience, this is just as favourable for achieving a high efficiency as is a functional replacement of the relatively small heat transfer surface of the heat exchanger by the very much larger one of the regenerator. Fresh air can flow at atmospheric pressure into the working volume through one of the valves, as a result of which decisive synergy effects can be achieved in some applications. Thus, for example, hot air can be admitted into a working volume and be blown out as cooler air into a space at higher pressure, a portion of the thermal energy released during the cooling of the air having been absorbed by the cooler. Large synergy effects are used in the process when the hot fresh air at atmospheric pressure is heated by exhaust gases of an internal combustion engine, and the cooler air at higher pressure is used for the purpose of supercharging the internal combustion engine (cf. Examples of Application). Cost effective parabolicic fluted mirrors can be employed when solar energy is being used, since the working means can heat air with the aid of the solar irradiation, and therefore no environmental and disposal problems can occur from escaping heating oil, nor is there a need to construct greatly ramified absorber pipeline systems for generating high pressure and steam, and this renders the transport of thermal energy substantially less problematical. Moreover, the heating of the working means over a large temperature interval (for example 200° C. to 500° C.) is used to achieve a higher final temperature of the working means in conjunction with heating in the absorber of the collector with a relatively low outlay. The principles of optical concentration, translucent insulation and through flow of the translucent insulation can be very effectively combined for this purpose. The co-operation of a nonproblematical accumulator made from cost effective materials even permits the seasonal storage of the insolation over several months, given appropriate dimensioning. A cost effective individual solution, for example the supplying of a remote village or a hospital, is thereby rendered possible.

The following discussion, related to specific applications, makes it easier to understand the formation of the temperature field in the working volume, for example in the case of the use of only one heat exchanger, and the sequence of an overall cycle, together with the problems on which the object is based.

BRIEF DESCRIPTION OF THE DRAWINGS

The above and other aspects and advantages of the present invention are apparent from the detailed description, which follows in combination with the drawings in which.

DETAILED DESCRIPTION OF THE INVENTION

Figure 1:
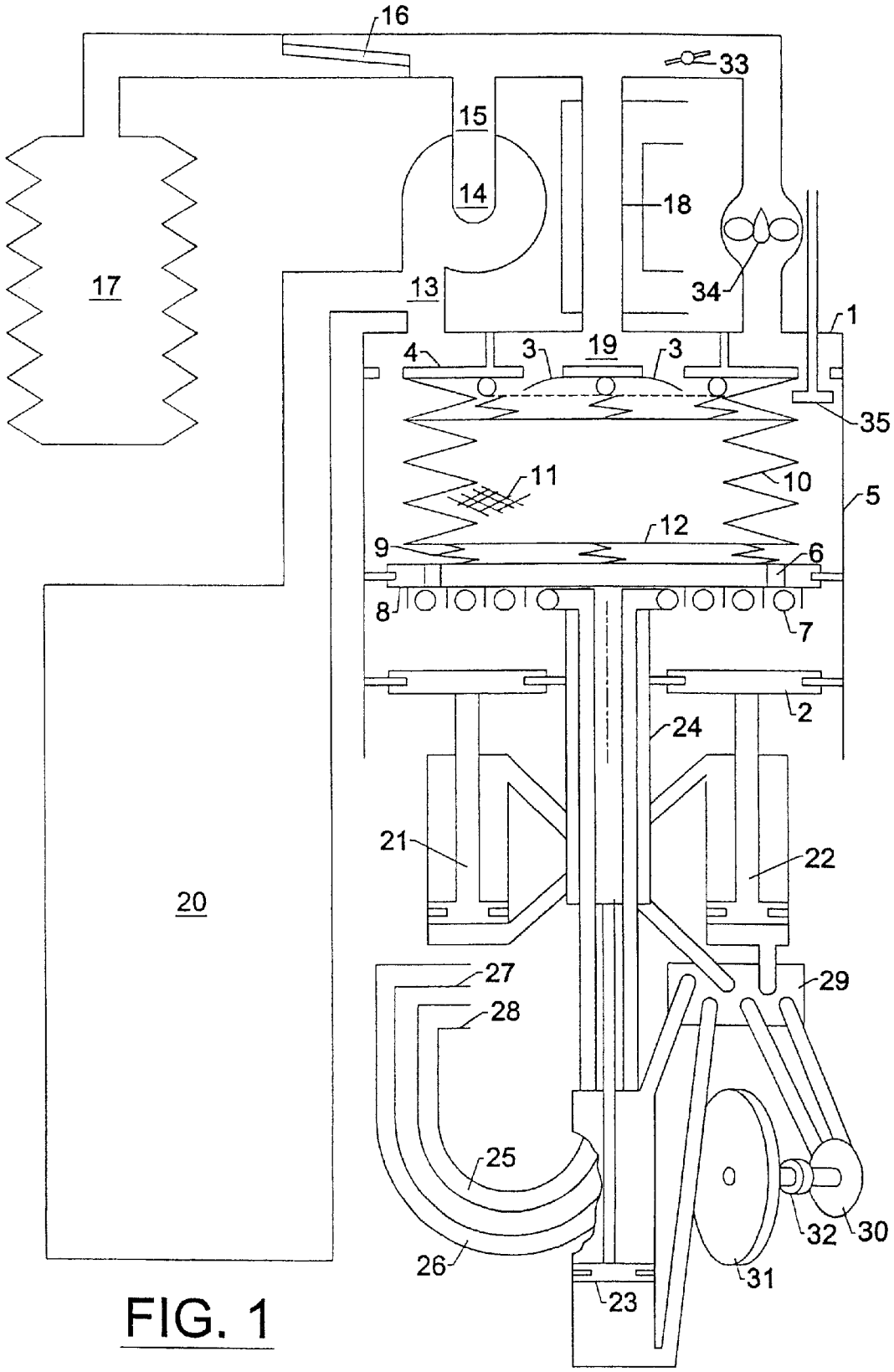
FIG. 1 is a plan view of an apparatus according to an embodiment of the present invention.

Detailed reference will now be made to the drawings in which examples embodying the present invention are shown. The drawings and detailed description provide a full and detailed written description of the invention, and of the manner and process of making and using it, so as to enable one skilled in the art to make and use it, as well as the best mode of carrying out the invention. However, the examples set forth in the drawings and detailed description are provided by way of explanation of the invention and are not meant as limitations of the invention. The present invention thus includes any modifications or variations of the following examples as come with the scope of the appended claims and their equivalents.

Application of the Principle of the Invention

The apparatus represented in FIG. 1 can operate, inter alia, as a thermal gas compressor (with the integrated action as a prime mover), and because of the simple design and the relatively simple possible theoretical description of the cycle, forms a good starting point for understanding the more complex machines, apparatuses or methods likewise based on the principle of the invention.

Design

A working volume filled with gas as working fluid is largely enclosed by a working cylinder as pressure vessel 1, a slidingly sealed piston 2, and inlet and outlet valves 3 and 4, respectively. Moving in this working volume against the cylinder wall 5 in a slidingly sealed fashion is a frame 6 on which a heat exchanger 7 and a regenerator 8, of invariable structure or size, are fitted such that they must be flowed through by the gas. Sprung spacers 9 form between this regenerator 8 and a reversibly contracting and expanding structure 11, acting as a regenerator, which is also surrounded by a bellows 10 and consists of a fine (40–80 ppi) foam plastic or approaches the latter in terms of homogeneity or interspaces (for example a plurality of layers, juxtaposed perpendicular to the flow direction, made from embossed or curved metal fabric) over the entire cylinder surface a flow channel 12 through which the gas can pass to the ventilator 14 past the structure 11 through the opened outlet valve 4 of the working volume and a part 13 of the pipeline system. This gas can flow from the ventilator through a part 15 of the pipeline system and a regenerator 16, which is to be flowed through, into a standby space 17 which is surrounded by a bellows. After heating in a (countercurrent) heat exchanger 18, the gas can pass through the inlet valves 3 into the working volume from the ventilator 14 or from this standby space 17 through a part of the pipeline system 19. A pressure tank 20 is connected to the pipeline system at 13 upstream of the ventilator (turbine) 14 in order to buffer the pressure fluctuation. The piston 2 and the frame 6 are moved periodically by hydraulic pistons 21, 22, 23 as characterized in FIG. 4, FIG. 5, FIG. 6 or the associated description of the cycle. The orientation of the piston 2 with reference to the stroke direction is stabilized by the hydraulic cylinders 21 and 22.

The driving tube 24 of the frame 6 is guided out of the working volume through seals in the stroke direction by the piston 2. Running in this driving tube are two tubes for the cooling water which are sealed against the inner wall of the driving tube such that no gas exchange with a disturbing influence on the cycle can take place between the working volume and surroundings. Movable hoses 25, 26 connect these tubes to fixed connections 27, 28 of a cooled water reservoir, with the result that the cooling water can circulate in a closed circuit. The liquid in the heat exchanger 7 should always be at a lower pressure by comparison with the working volume, so that no liquid can be forced into the working volume, something which could lead to dangerous, sudden development of steam—instead, the liquid in the heat exchanger is displaced by inflowing working fluid. If the hot gas which is to be cooled is introduced directly at 19 into the pipeline system of the apparatus for transferring entropy (compare FIG. 1), and extracted again at 15, the losses and the structural outlay of the heat exchanger 18 can be eliminated. The hydraulic pistons 21, 22 and 23 exchange mechanical power via a controlled valve system 29 of the control system via a hydraulic pump 30 with a flywheel 31 and a component 32 acting as electric motor and/or generator. Working fluid can be exchanged from the part of the pipeline system 19 to the flow channel 12 through a valve 33, optionally driven by a ventilator 34 or not through a further valve 35.

The valve 33 initially remains closed. The acceptable, simplifying assumption is made below that, as an ideal gas, the working fluid always has the temperature $T_k$ in the coolest partial volume, that is to say only isothermal processes proceed there. Determining the maximum possible output of work by a method according to the invention, and an apparatus according to the invention in the case of which a gas quantity of mass $m_A$ can be cooled over a temperature integral from $T_1$ to $T_2$ by coupling to a cycle.

The thermal energy $dQ=m_A{}^* c_p{}^*dT$ [a1] is output during cooling of the gas from T+dT to T. If this thermal energy is absorbed isothermally at the temperature T by a cycle cooled at $T_k$, the work of at most $dW=\eta^*DQ$[a2]; $\eta=1-T_k/T$: Carnot efficiency [a3]can therefore be performed.

Consequently, the work of $$W = \int_{W(T_2)}^{W(T_1)} dW\left[\underline{\underline{a2}}\right] = \int_{Q(T_2)}^{Q(T_1)} \eta_c\, dQ[a3] \underline{\underline{[a1]}} \int_{T_2}^{T_1} \left(1-\frac{T}{T}\right) * m_A * c_{Pg}\, dT$$

-continued $$= m_A * c_{Pg} * \left(T_1 - T_2 - T_k * 1n\left(\frac{T_1}{T_2}\right)\right)$$

can be performed during cooling of the gas from $T_1$ to $T_2$. W can be denoted [according to Stephan, Karl: Thermodynamik: Grundlagen und technische Anwendungen; Band 1 Einstoffsysteme [Thermodynamics: Principles and technical applications; Volume 1 Unary systems]; 14th Ed.; 1992 Springer-Verlag, page 177 ff] as the exergy of the thermal energy which has been extracted from the gas during cooling from $T_1$ to $T_2$ when the cooler temperature $T_k$ is equated to the ambient temperature $T_u$. Page 185: Exergy:

$$-L_{ex} = \int_1^2 \left(1 - \frac{T_u}{T}\right) dQ$$

Figure 2:
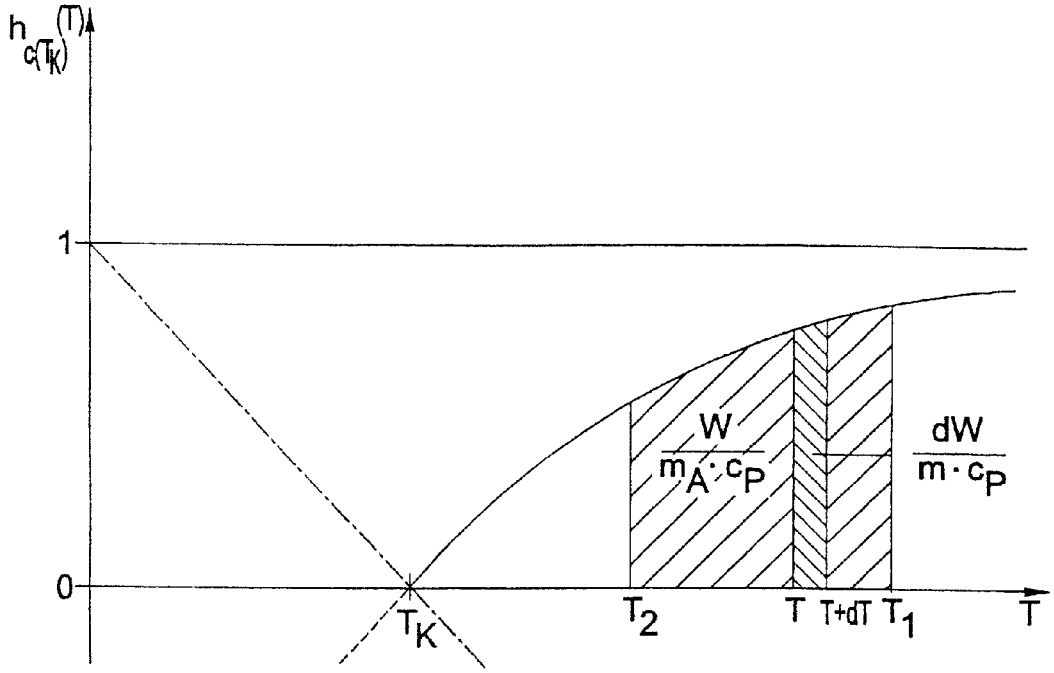
FIG. 2 is a T-η diagram showing evectiveness η[-] vs. temperature T [K] and the determination of the change of exergy W [J] in cooling the fluid.

The hatched area under the curve of $\eta_{c[Tk]}$ (T) in FIG. 2 is proportional to this work W. In this case, the cycle is fed the thermal energy $Q=m_A{}^*c_p{}^*(T_1-T_2)$.

This results in:

$$\eta_{tot} = \frac{W}{Q} = 1 - T_k * \frac{1n\left(\frac{T_1}{T_2}\right)}{T_1 - T_2}$$

for the overall efficiency of this cycle.

Figure 3:
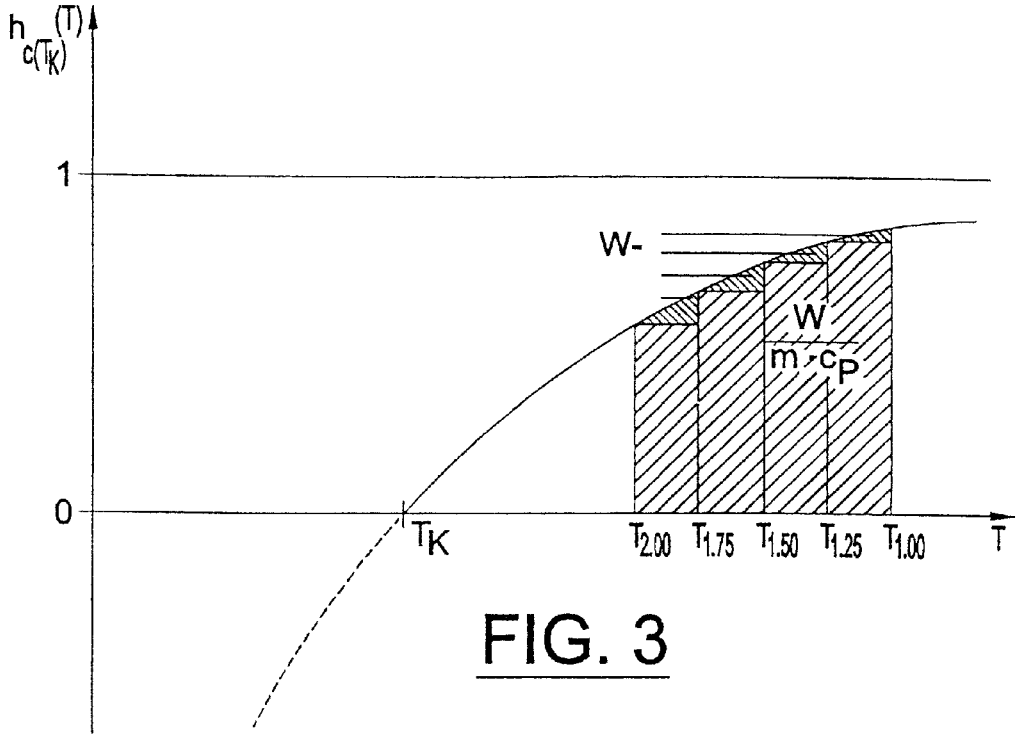
FIG. 3 is also a T-η diagram showing the exergy loss in cooling the fluid by four planes.

If the thermal energy is extracted isothermally from the gas by thermal contact with four ideal heat exchangers at temperatures $T_{1.25}$, $T_{1.5}$, $T_{1.75}$, $T_2$ (cf. FIG. 3), the exergy shown above is reduced by W_to the maximum useful energy W. This is represented in FIG. 3. The formal description and the interpretation follow from the comparison with those relating to FIG. 2.

Cycle Traversed by the Gas in the Apparatus Relating to FIG. 1

Figure 4:
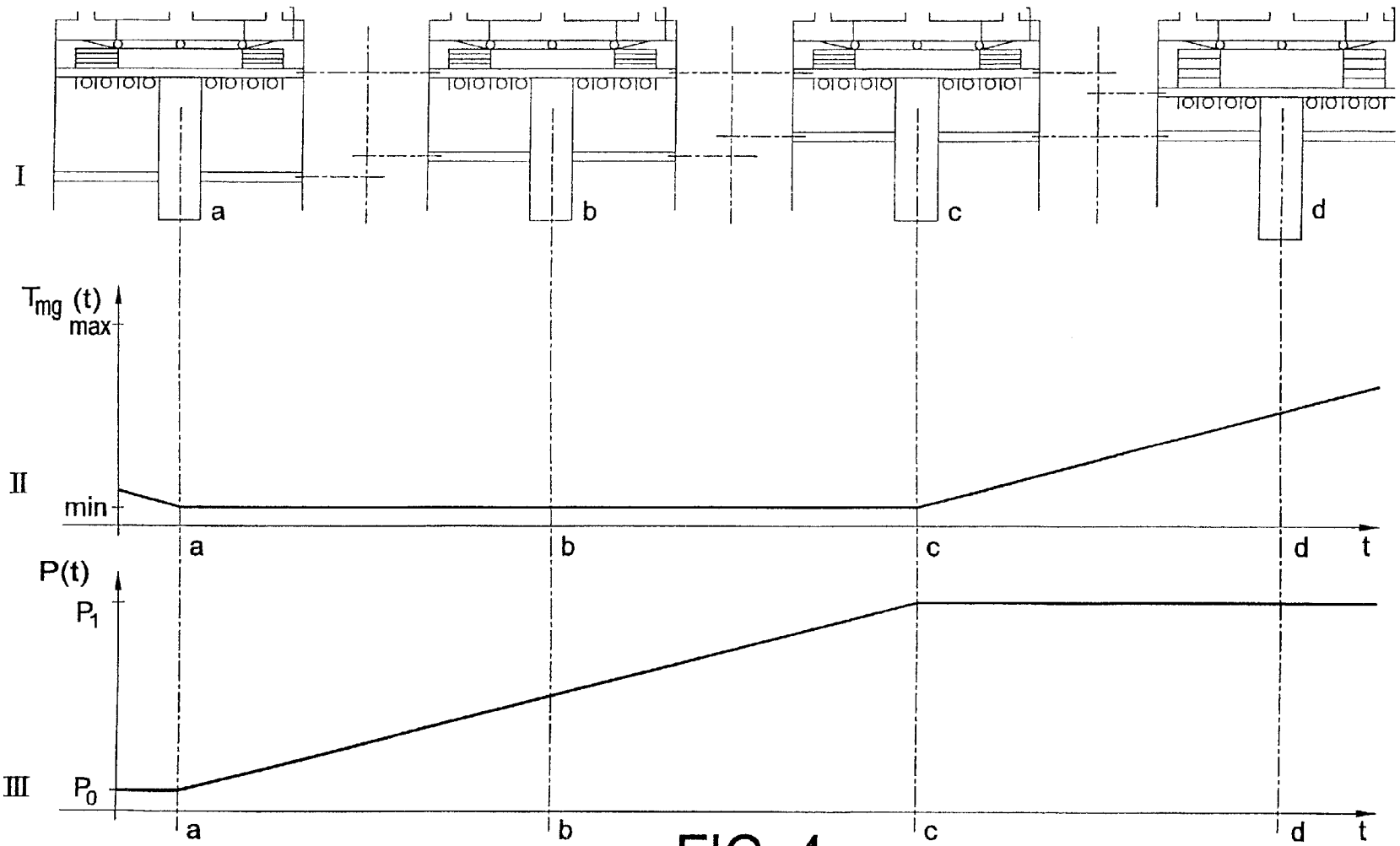
FIG. 4 shows: at the top (I) the workspace of the apparatus shown in FIG. 1, at different points a, b, c, d in time; in the middle (II) a T-t diagram showing temperature T(t) of the fluid within the workspace vs. time [s]; and bottom (III) the associated pressure P(t)[Pa] of the fluid.
Figure 5:
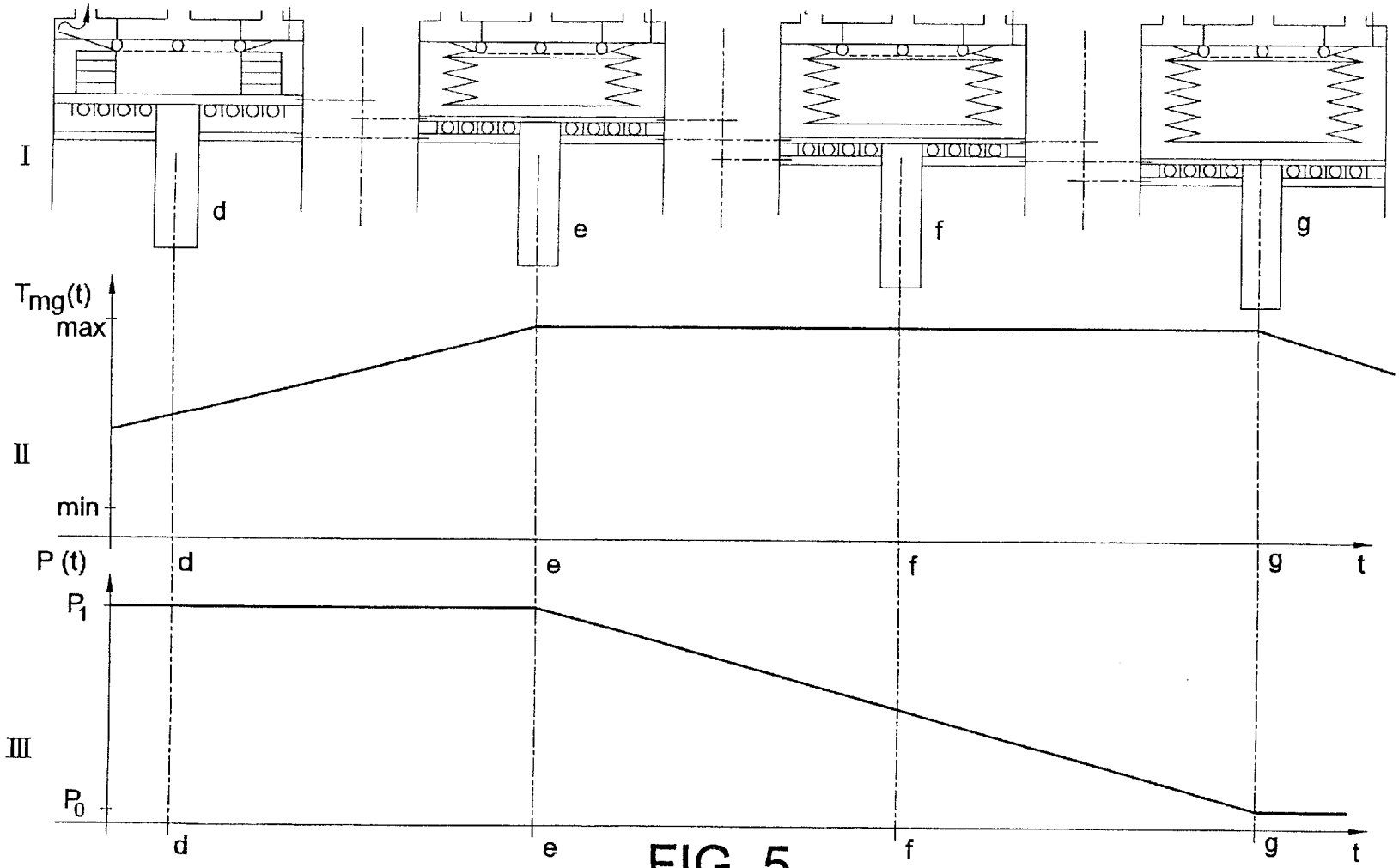
FIG. 5 shows: at the top (I) the workspace of the apparatus shown in FIG. 1, at different points d, e, f, g in time; in the middle (II) a T-t diagram showing temperature T(t) of the fluid within the workspace vs. time [s]; and bottom (III) the associated pressure P(t)[Pa] of the fluid.

The cycle of movements is determined by the control system and represented roughly in FIG. 4, FIG. 5, FIG. 6I in a satisfactory fashion for the following analysis. On the assumption—confirmed later in more detail—that in the equilibrium operating state the regenerator system 11 has a temperature profile whose mean temperature $T_{mg}$ is substantially above the cooler temperature $T_k$, the profile of the mean temperature in the working volume $T_m$(t) is yielded immediately therefrom, being represented qualitatively in FIG. 4, FIG. 5, FIG. 6II. Because of the standby space 17, the pressure $P_0$ in the part of the pipeline system 19 upstream on the inlet valves corresponds to atmospheric pressure.

Figure 7:
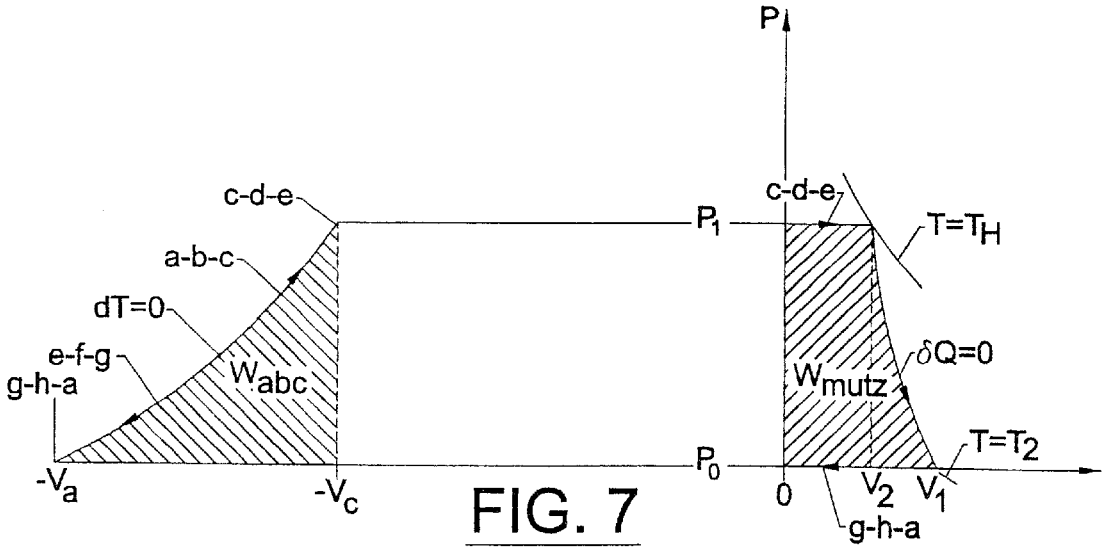
FIG. 7 is a P-V diagram showing at the right (V>0) pressure vs. volume of the workspace and at the left (V<0) pressure vs. volume of the fluid portion interchanged per cycle.

The ventilator 14 is to operate such that the pressure $P_1$ is changed only slightly relative to the differential pressure $P_1-P_2$ in the space 13 of the pipeline system adjoining the outlet valve 4. The valves 3 and 4 are opened or closed by the (flow) pressure of the gas. The pressure is increased during the corresponding reduction in the working volume from $V_a$ to $V_b$ by the movement of the piston 2 in the time period a-b-c, since the inlet and outlet valves 3 and 4, respectively, are closed because of the pressure P(t) in the working volume, which is higher relative to $P_0$ but lower relative to $P_1$. In the case of the assumed isothermal compression in the time period a-b-c, the cool gas in the working volume at the temperature $T_k$ outputs the thermal energy $$Q_{abc} = \int_{V_a}^{V_b} P_{Tk}(V)\,dV$$

to the cooler. In this time period, the control system must perform at the piston the work of $W_{abc}=-Q_{abc}$. This work $W_{abc}$ corresponds to an area illustrated in a hatched fashion in FIG. 7.

In the time period c-d-e, the coolest partial volume becomes smaller in conjunction with a constant working volume through a displacement of the frame 6 with the cooler 7 and regenerator 8, and this leads to a rise in the mean temperature of the gas in the working volume. As soon as the pressure P(t) in the working volume rises at the start of this time period somewhat above the pressure $P_1$ on the other side of the outlet valve 4, this valve is opened and the expansion of the gas, which is associated with the rise in the mean temperature, has the effect that a gas quantity of mass $m_A$ flows out from the working volume through the outlet valve, is expanded adiabatically in the ventilator 14 and in the process performs the work $W_{use}$, which corresponds to an area in FIG. 7.

It holds that:

$$\begin{aligned} W_{use} &= (P_1 - P_0) * V_2 + \int_{V_2}^{V_1} (P_{ad}(V) - P_0)\,dV; \\ P_{ad}(V) &= V_1^{\kappa} * P_0 * V^{-\kappa};\ \kappa = c_P / c_V \\ &= P_1 * V_2 - P_0 * V_2 - V_1 * P_0 + V_2 * P_0 + \int_{V_1}^{V_1} P_{ad}(V)\,dV \\ &= P_1 * V_2 - V_1 * P_0 + C_V * m_A * (T_H T_2) \end{aligned}$$

Note: $T_2$ is yielded independently of $m_A$ for a given pressure ratio $P_1/P_0$, where $W_{use}=C_p*m_A*(T_1-T_2)*\eta_{tot}$.

Each volume V can be divided into subvolumes $V_i$, where $$V = \sum_i V_i$$

by an appropriate, possibly very small division, such that the following may be set down for $V_i$ without effectively falsifying the thermodynamic description:

$$P * V_i = N_i * k_B * T_i;\quad N_i = P * \frac{1}{k_B} * \frac{1}{T_i} * V_i;$$

$$N = \sum_i N_i = \frac{P}{k_B} * \sum_i \frac{1}{T_i} * V_i$$

$k_B$: Boltzmann's constant; $T_i$: temperature in $V_i$; $N_i$: number of gas molecules in $V_i$.

Mathematical foundation:

Because of the thermal conduction, a continuously differentiable temperature field can be assumed, cf. Riemann integrals. It then holds in general that:

$$N = \frac{P}{k_B} * \int_V \frac{1}{T(\vec{r})}\,d^3r$$

Number of the gas molecules exchanged per period with the working volume:

$$\Delta N = N_c - N_e = \frac{P_1}{k_B} * \int_{V_c} \frac{1}{T_c(\vec{r})} - \frac{1}{T_e(\vec{r})}\,d^3r$$

Figure 6:
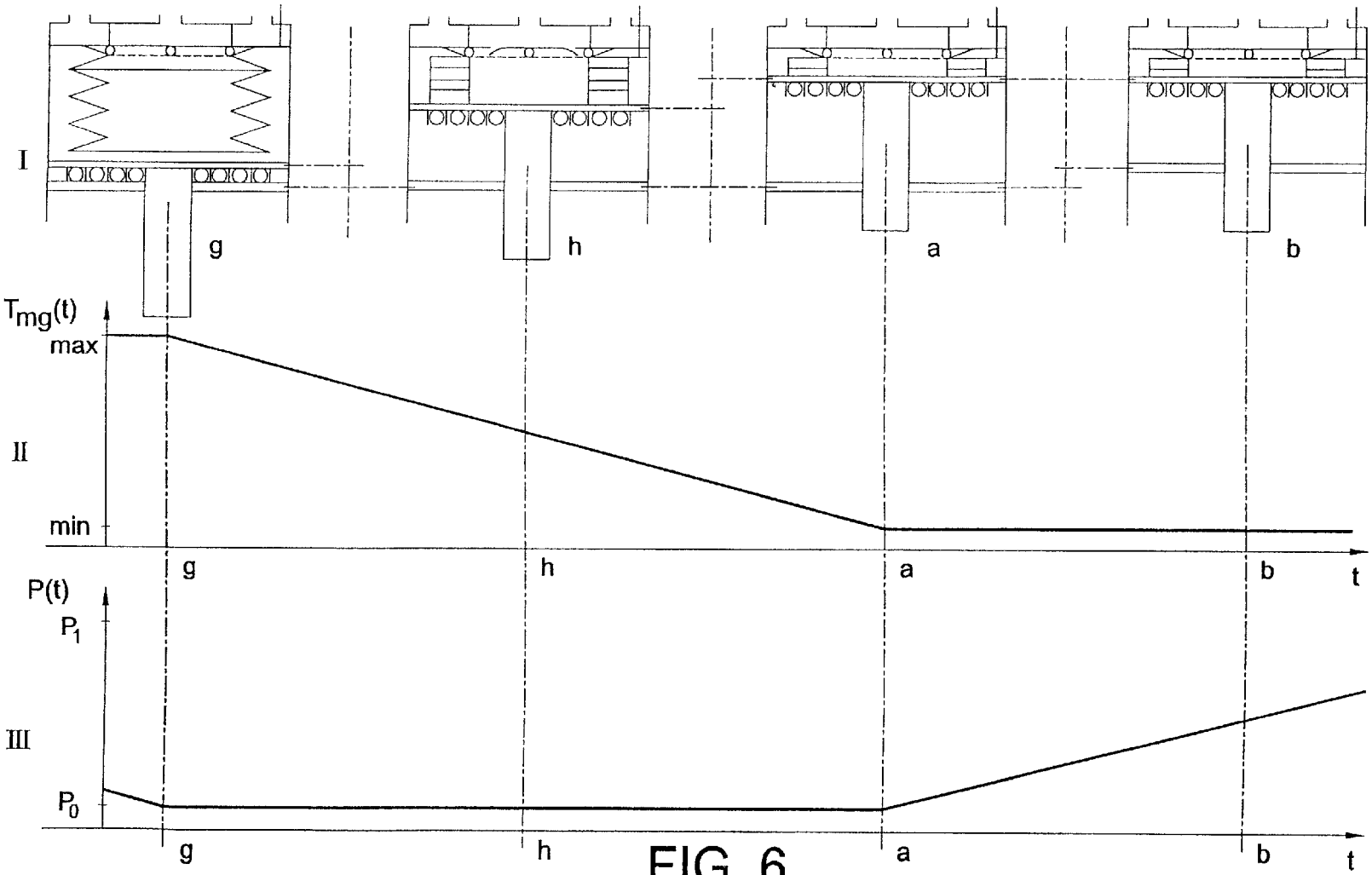
FIG. 6 shows: at the top (I) the workspace of the apparatus shown in FIG. 1, at different points g, h, a, b in time; in the middle (II) a T-t diagram showing temperature T(t) of the fluid within the workspace vs. time [s]; and bottom (III) the associated pressure P(t)[Pa] of the fluid.

Note: the letters in the index, for example c in $N_c$ denote an instant of the cycle as defined in FIG. 4, FIG. 5, FIG. 6. Determination of the mass of the exchanged gas quantity $$m_A = m_C * \frac{\Delta N}{N_C};\quad N_c = \frac{P_1}{k_B} * \int_{V_c} \frac{1}{T_C(\vec{r})}\,d^3r$$

$m_c$: mass of the gas in the working volume at the instant c it holds for the time period c-d-e that:

$$m_{Acde} = m_C * \left[ 1 \frac{\int_{V_c} \frac{1}{T_e(\vec{r})}\,d^3r}{\int_{V_c} \frac{1}{T_C(\vec{r})}\,d^3r} \right]$$

The working volume is enlarged by the piston movement in the time period e-f-g. In this case, the gas is not to flow relative to the heat transfer surfaces which are necessarily active for the thermodynamic cycle.

Since in this time period the gas in the entire working volume is in direct contact with heat transfer surfaces of high thermal capacities which are necessarily active for the thermodynamic cycle, and the gas is not moved relative thereto because of their specific movement, this time period of the cycle can be described by an isothermal expansion, the same formulae holding for the exchanged thermal energy or work as for the time period a-b-c. It is therefore possible for this energy to be stored in an oscillating system and to be output again for compression (for example by an oscillating water column in a U-shaped tube, possibly with a cavity acting as an air spring, as boundary). It holds for the gas quantity admitted in the time period g-h-a (cf. c-d-e) that:

$$m_{Agah} = m_a * \left[ 1 - \frac{\int_{V_a} \frac{1}{T_g(\vec{r})}\,d^3r}{\int_{V_a} \frac{1}{T_a(\vec{r})}\,d^3r} \right]$$

$M_{Agah}=M_{Acde}$ $m_a$: mass of the gas in the working volume at the instant a.

The temperature profile, the temperature field T(r) in the apparatus relating to FIG. 1 [lacuna] In the time period e-f-g, the largely homogeneous regenerator structure 11 with a thermal capacity which is very high relative to the gas in the working volume and assumed to be infinite below, largely fills up the entire working volume, and the working volume is expanded by the displacement of the piston. Only isothermal processes take place in the working volume because of the specific movement.

Formulation

Let the working volume be divided into E equally large partial volumes by E-1 planes arranged perpendicular to the stroke. In the ideal case, the temperature in these planes is constant because of the symmetry. The thermal energy $Q_i=1/E*Q_{efg}$ is extracted from the regenerator structure 11 in each of the subvolumes by the isothermal expansion of the gas. $i \in [1;E]$. During the time period g-h-a, the cooling of the hot gas quantity of mass $m_A$ flowing in through the inlet valves 3 during each period effectively feeds energy to the regenerator structure 11, since thereby a larger gas quantity flows overall from the hot into the colder part of the regenerator structure 11 than in the case of the inverse flow direction.

Let the jth one of these subvolumes be bounded (cf. above) by the isothermal planes at temperatures of $T_j$ and $T_{j+1}$. The gas flow during a period feeds this partial volume the thermal energy of $Q_j=m_A*C_p*(T_j-T_{j+1})$. It must hold for the formation of an operating state in equilibrium that:

$$Q_j=m_A*c_p*(T_j-T_{j+1})=1/E*Q_{efg}$$

A linear temperature profile in the stroke direction for T(r) results from $(T_j-T_{j+1})=(m_A*c_p*E)^{-1}*Q_{efg}$.

Achieving a Larger Temperature Difference $T_1-T_2$ when the Apparatus Characterized in FIG. 1 is Used as a Thermal Gas Compressor If the aim in a system is to achieve larger temperature differences in the gas admitted to and output from the working volume, a gas quantity of mass $m_H$ must flow from the part of the pipeline system 15 into the flow channel 12 through a further inlet valve in the time period g-h-a. That is to say, the valve 33 is open, and the ventilator 34 can remain stationary. With $T_1$, $T_2$, $P_0$ unchanged, $P_1$ can be selected such that the gas quantity drawn in overall remains constant, that is to say this measure reduces by $m_H$ the mass $m_A$ of the gas which is drawn in in a hot state and forced out at a lower temperature and higher pressure. Less thermal energy is therefore exchanged during a period with the regenerator system 11. The pressure ratio $P_1/P_0$ must therefore be lower in this case.

With $T_1$, $P_1$, $P_0$ unchanged, the same quantity of thermal energy is fed during a period to the regenerator system 11 only whenever the exchanged gas quantity is more intensely cooled. A larger temperature difference $T_1-T_2$ can thus be achieved given the same pressure ratio $P_1/P_0$. Given a constant pressure ratio $P_1/P_0$, the temperature $T_2$ can be stabilized relatively simply by a simple thermostat control for the inlet valve 35. The inlet valve 35 is opened in this case only whenever the gas (just) exceeds the stipulated temperature at 15. If appropriate, it is also sufficient to reduce the flow resistance in the region of the inlet valve 35 in conjunction with rising temperature of the gas at 15, for example by a baffle, controlled by a bimetal, which changes the cross section for the flow.

Achieving a Smaller Temperature Difference $T_1-T_2$ when the Apparatus Characterized in FIG. 1 is Used as a Thermal Gas Compressor If the aim in the system is to achieve a higher pressure ratio $P_1/P_0$ during the cooling of the exchanged gas by a specific temperature difference, the gas quantity of mass $m_B$ must be sucked from the flow channel 12 through a further (driven) outlet valve 35 in the time period g-h-a with the aid of a ventilator 34 which, in the ideal case, uses adjustable elements to apply the pressure difference, which is small relative to $P_1-P_0$, required for this purpose only in this time period. This gas quantity is fed to the space 15 of the pipeline system. That is to say open valve 33. If four such working volumes operate with a phase shift of 90°, a commercially available ventilator can run uniformly, that is to say only the outlet valves 35 need be controlled with some expenditure of force and energy. Consequently, with $T_1$, $T_2$, $P_0$ unchanged, the exchanged and cooled gas quantity $m_A$ is enlarged by $m_B$, and a larger quantity of thermal energy is fed to the regenerator system 11 during a period. This more substantial thermal energy is partially extracted again from the regenerator system 11 in the time period e-f-g during the effectively isothermal expansion of the gas from $P_1$ to $P_0$, it being possible to achieve a higher pressure ratio $P_1/P_0$, resulting in more energy being converted overall per period, in which case the thermal energy exchanged overall at the regenerator 8 or at the regenerator system 11, and also the thermal losses associated therewith are increased in a far lower ratio. A better efficiency is thereby achieved overall. If the mass flow through the adjustable ventilator can be set in 3 stages (out, average, large), and the stage of large can always be switched on by a thermostat whenever a specific temperature is undershot, the temperature $T_2$ can thereby be stabilized sufficiently at a value with a relative low outlay.

Use of the Apparatus Characterized in FIG. 1 as a Refrigerating Machine

The apparatus represented in FIG. 1 can also be operated as a refrigerating machine which cools a gas quantity over a large temperature interval. For this purpose, the ventilator (turbine) 14 then driven must force the gas from the part of the pipeline system 19 at the pressure $P_0$ into the part 13 at $P_1$. The flow direction of the gas is reversed (in the working volume overall), and the design of the apparatus and the sequence of movements are maintained as represented in FIG. 1 and FIG. 4, FIG. 5, FIG. 6, respectively. The outlet valve 4 becomes an inlet valve by virtue of the fact that it is held open against the flow pressure in the time period c-d-e, for example by an engaging spring connected to the control system, in conjunction with an unchanged stop direction. The gas then flowing in at the pressure $P_1$ outputs thermal energy to the regenerator system 11 upon cooling. During the effectively isothermal expansion of the gas (as above in the case of the gas compressor; prime movers) from $P_1$ to $P_0$, thermal energy is extracted from the regenerator system during the time period e-f-g. As shown above in the case of the description of the prime mover, with the refrigerating machine, as well, the cooperation of the partial processes in the time periods c-d-e and e-f-g forms in the regenerator structure 11 a temperature field T(r) which is linear in the stroke direction and whose mean temperature $T_m$ is below the cooler temperature $T_k$ in the case of the refrigerating machine. (Temporal development of $T_m(t)$ in FIG. 4, FIG. 5, FIG. 6: substitute max. $T_m(t)$ with min. T(t)). As a result, the mean temperature in the working volume is increased in the time period g-h-a upon telescoping of the regenerator system 11. The inlet valves of the prime mover 3 can act as outlet valves in the case of the refrigerating machine when they are held open against the flow pressure in this time period g-h-a, for example by an engaging spring connected to the control system, in conjunction with an unchanged stop direction, and because of the increase in the mean temperature in the constant working volume, gas flows out at a constant pressure $P_0$ into the part of the pipeline system 19. Before this gas is compressed anew by the ventilator (turbine), it absorbs in the heat exchanger 18 the thermal energy originating from the cooling of the other gas flow. When the gas to be cooled is introduced directly into the pipeline system of the refrigerating machine at 15 (cf. FIG. 1) and extracted again at 19, the losses and the design outlay of the heat exchanger 18 can be eliminated. In the time period c-d-e, the mean temperature of the gas in the working volume is lowered in conjunction with a constant working volume by the expansion of the regenerator system 11, which, because of the fact that the valve 4 is held open, leads in conjunction with a constant pressure $P_1$ to an inflow of warmer gas, additional feeding of thermal energy to the regenerator structure 11, and the closure of the cycle.

Achieving a Larger Temperature Difference $T_1-T_2$ when the Apparatus Characterized in FIG. 1 is Used as a Thermal Refrigerating Machine The apparatus represented in FIG. 1 and already described as a prime mover can, as already largely represented above, also be operated as a refrigerating machine. As in the case of the prime mover, given an open valve 33 and stationary ventilator 34, a larger temperature difference of the gas quantity, absorbed and output by the working volume, of mass $m_A$ can be achieved when a gas quantity of mass $m_H$ flows out in the time period g-h-a into the space 15 through the valve 35, which acts in this case in conjunction with the same stop as an outlet valve which is held open by the control system against the flow pressure in this time period g-h-a. Air is also forced through the turbine 14 and the valve 4 into the working volume in the same time period g-h-a. With $T_1$, $P_1$, $P_0$ unchanged, the regenerator system 11 is fed an equally large quantity of thermal energy during a period only whenever the gas is more intensely cooled. It is thereby possible to achieve a large temperature difference $T_1-T_2$ in conjunction with the same pressure ratio $P_1/P_0$. Given a constant pressure ratio $P_1/P_0$, the temperature $T_2$ can be stabilized relatively easily by a simple thermostat control for the outlet valve 35. The outlet valve 35 is opened in this case only whenever the gas (just) exceeds the stipulated temperature at 19.

Achieving a Smaller Temperature Difference $T_1-T_2$ when the Apparatus Characterized in FIG. 1 is Used as a Thermal Refrigerating Machine The prime mover represented in FIG. 1 can, as already represented above, also be operated as a refrigerating machine. If, as in the case of the prime mover, the aim is also to operate with a larger pressure difference $P_1-P_0$ in the case of the refrigerating machine for a specific cooling, this can be achieved when the gas quantity of mass $m_B$ is blown with the aid of a ventilator 34 from the space 15 into the flow channel 12 through a further (driven) inlet valve 35 in the time period g-h-a. As a result, in the operating state the regenerator system 11 is fed a correspondingly larger quantity of thermal energy by comparison with operation without the valve 35, and correspondingly more thermal energy is extracted again in the case of the isothermal expansion in the time period e-f-g by an expansion with a higher pressure ratio $P_1/P_0$.

The advantages of these measures, or the control of the temperature $T_2$ are largely similar to the case of the correspondingly operated prime mover relating to FIG. 1.

Action as a Heat Pump

When, by virtue of the reversal of all the directions of movement, the control system runs in the case of the refrigerating machines described above such that the moving parts change their position in accordance with FIG. 4, FIG. 5, FIG. 6 in the reversed sequence h-g-f-e-d-c-b-a, and the ventilator operating directions remain unchanged relative to FIG. 1, these apparatuses act as heat pumps which instead of cooling the gas blown in heat it over comparable temperature intervals in conjunction with comparable pressure ratios.

The Cycle for the Case of the Use of an Apparatus According to FIG. 1 as a Heat Pump Thermal energy is fed to the regenerator system 11 in the time period g-f-e in the case of the isothermal compression (with valves closed) of the gas from $P_0$ to $P_1$. Upon telescoping of the regenerator system 11 in the time period e-d-c, gas at the temperature $T_H$ is admitted by the turbine from the working volume at the pressure $P_1$ through the valve 4, which is being held open, since the mean temperature is lowered. In the time period c-b-a, the gas is expanded to the pressure $P_0$ with the valves closed, and so thermal energy is extracted from the heat exchanger at the temperature $T_k$. In the time period a-h-g, the mean temperature in the working volume is increased with the expansion of the regenerator system 11, and gas at the temperature $T_1$ is output through the valves 3 at $P_0$. If, simultaneously with this, gas with the temperature of approximately $T_H$ is pushed by the ventilator 34 out of the space 15 into the flow channel 12 through the valve 35, the difference in the temperatures $T_H-T_1$ is reduced in conjunction with the same pressure ratio $P_1/P_0$. As in the case of the prime mover, this measure of making a change leads to a larger conversion of mechanical energy in conjunction with thermal losses of approximately the same magnitude. If gas passes from the working volume into the space 15 of the pipeline system through the valve 35 controlled via the gas temperature at 15 in the time period a-h-g, it is thereby possible to achieve a larger temperature difference (cf. refrigerating machine or prime mover corresponding to FIG. 1).

Fresh air can be filtered and heated with this heat pump.

The regenerators in the working volume act as filters. The thermal energy fed to the fresh air originates partly from a colder heat reservoir such as the ambient air or the groundwater. The thermal pump sketched can be designed such that the air virtually does not come into contact with lubricants, and that the filters can be changed easily upon contamination.

Hot Gas+Cool Gas Yields Warm Gas at a Higher Pressure

In order to be able to admit two gas quantities of masses $m_1$, $m_2$ at the temperatures $T_1$ and $T_2$, respectively, into a working volume, and to output them again at a higher pressure at a temperature $T_3$ situated between $T_1$ and $T_2$, it is necessary to make the following modifications by comparison with the entropy transformers represented in FIG. 1:

Fitted on the piston 2 are valves of the type 3 through which the cold gas can flow into the working volume from a buffer space, formed by the cylinder 1, which is large relative to the change in the working volume. A regenerator system similar to 11 is arranged between these valves and the driven flat frame 6 of the regenerator 8. The heat exchanger 7 can be eliminated. The sequence of movements, and the change in the mean temperature $T_m(t)$, or the pressure in the working volume P(t) correspond nevertheless largely to the qualitative representations in FIG. 4, FIG. 5, FIG. 6. Gas at the temperature $T_1$ or $T_2$, respectively, is drawn in through the respective valves in the time period g-h-a. Given an appropriate setting of the ratio of the masses of the drawn in gas quantities $m_1$ ($T_1$) and $m_2$, a linear temperature profile is yielded in the stroke direction. This would have to prove ideal for the efficiency. The gas quantities flowing into the working volume must be appropriately controlled by valves. If the cooler gas is to experience only a slight temperature change, as described above gas must be sucked from the working volume by a ventilator through a further valve (cf. 35) during this inflow process. Arriving at the flow channel 12 is a further flow channel, arranged with mirror symmetry relative to the regenerator 8, for the gas flowing from the working volume. Respectively adjoining each of these flow channels are the valves 4 and 35 or corresponding valves, by means of which it is possible to vary the temperature intervals for the exchanged gas quantities over wide ranges (cf. FIGS. 1*b*, 1*c*). Overall, this entropy transformer is possibly easier to construct, since there is no need for a heat exchanger (for example an automatic cooler). Moreover, steam cannot suddenly develop because of escaped cooling water.

As already shown above in the case of the gas compressor, this design can also be operated such that lukewarm gas at a higher pressure is forced by a turbine into the working volume and, as a result, the flow direction, but not the periodic sequence of movement (cf. FIG. 4, FIG. 5, FIG. 6)

is changed, and hot and cold gas flow out from the working volume at a lower pressure.

Combination of a Refrigerating Machine and Prime Mover

If hot gas and cool gas or cooling water at the temperature $T_k$ are available, gas can be cooled by an entropy transformer with 2 working volumes below the cooling water temperature $T_k$. In principle, for this purpose in the case of one of the refrigerating machines described above the driven ventilator 14 is replaced by one of the apparatuses described above and acting as a gas compressor, the hot gas being accepted by the working volume, which can be assigned to the gas compressor, and being output in the case of higher pressure through the outlet valve 4 of this working volume into a space of the pipeline system to which a buffering pressure vessel can be connected, and from which the gas, possibly after prior cooling to approximately $T_k$, flows through the valve 4 acting as inlet valve, into the working volume which can be assigned to the refrigerating machine. The gas, cooled to below $T_k$, flows out from this working volume through the valves 3 and, possibly, 35. (As represented above), the periodic flow through the valves 35 of the two working volumes can be set appropriately to tune pressure and temperature differences. If the movements represented in FIG. 4, FIG. 5, FIG. 6I proceed simultaneously in a working volume, the buffering pressure vessel can be of smaller dimension, or be eliminated. It is also interesting to use this combination as a heat pump for liquid. Further interesting combinations serve to increase the calorific value to a value of above 1. Thus, one hot and cold gas quantity each are admitted from a first working volume, as described above, and output again at higher pressure as a cool gas quantity and accepted by a second working volume, which outputs it again as a warm gas quantity at the output pressure. In this process, the liquid of a heat exchanger was cooled in the second working volume, or an additional gas quantity was cooled.

Constant Working Volume

Figure 8:
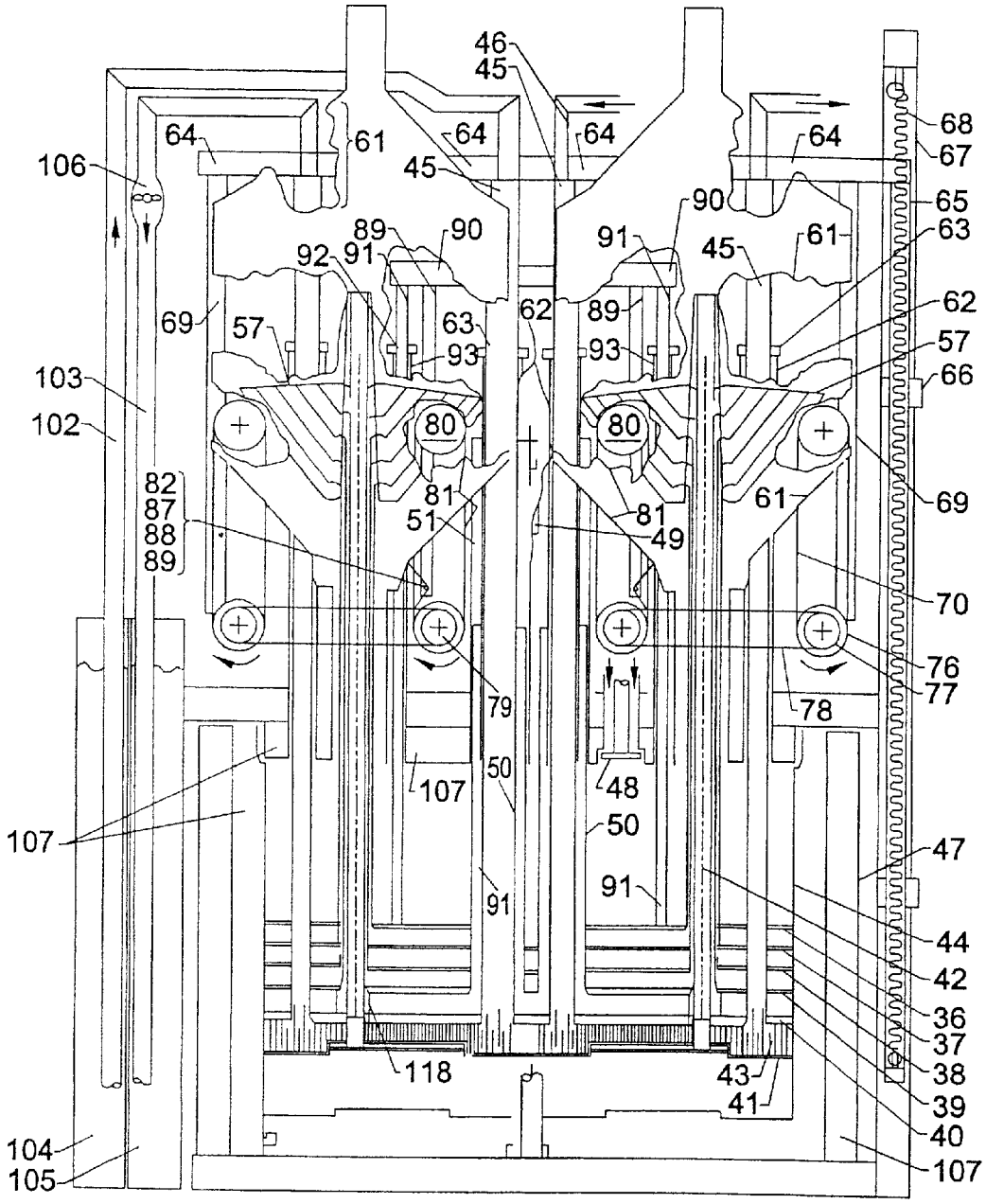
FIG. 8 is a cross-sectional view of another embodiment of the present invention.
Figure 9:
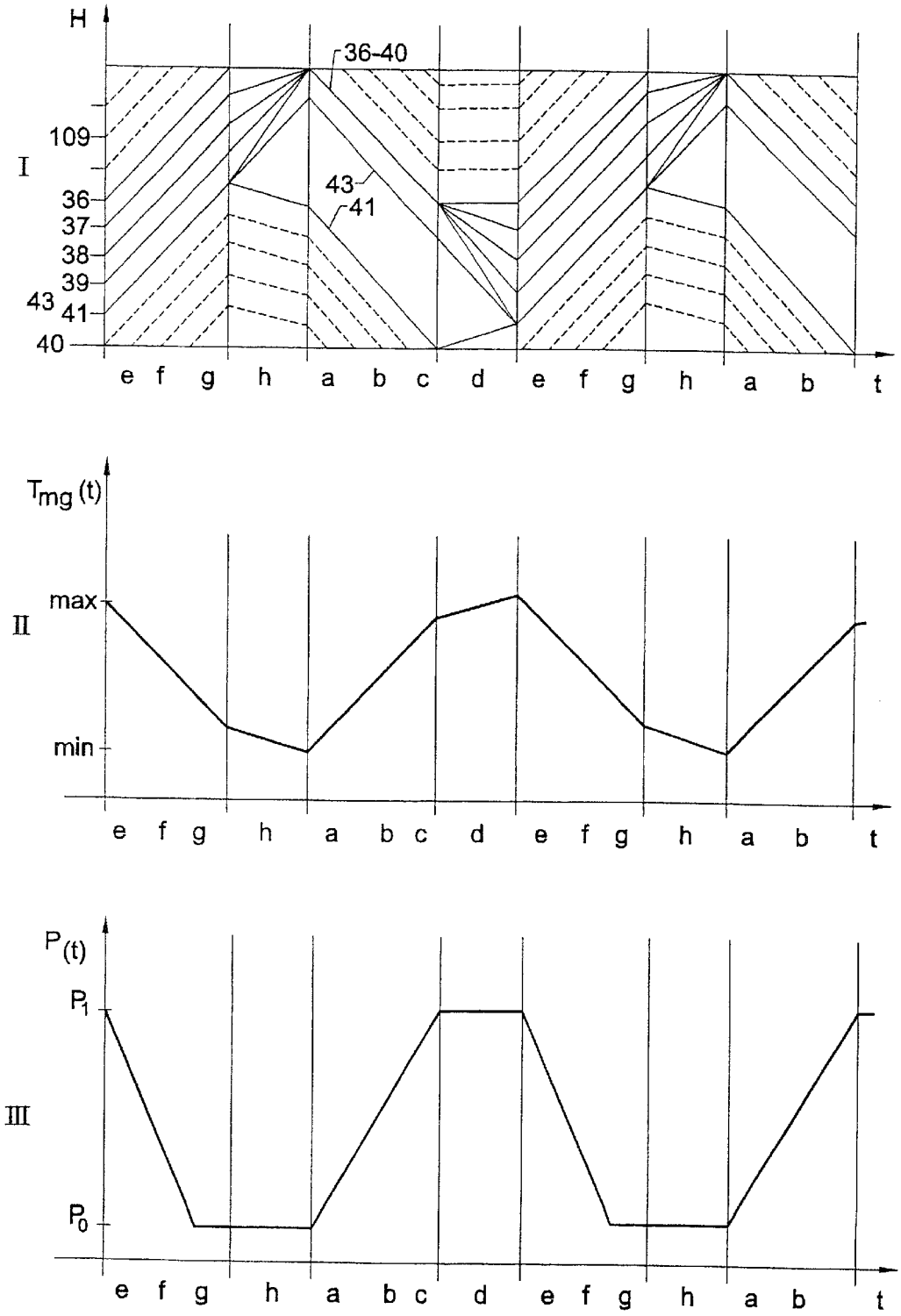
FIG. 9 shows: at the top (I) the height H(t) [m] of the moving elements of the apparatus shown in FIG. 8 vs. time; in the middle (II) a T-t diagram showing temperature T(t) of the fluid within the workspace vs. time [s]; and bottom (III) the associated pressure P(t)[Pa] of the fluid.
Figure 10:
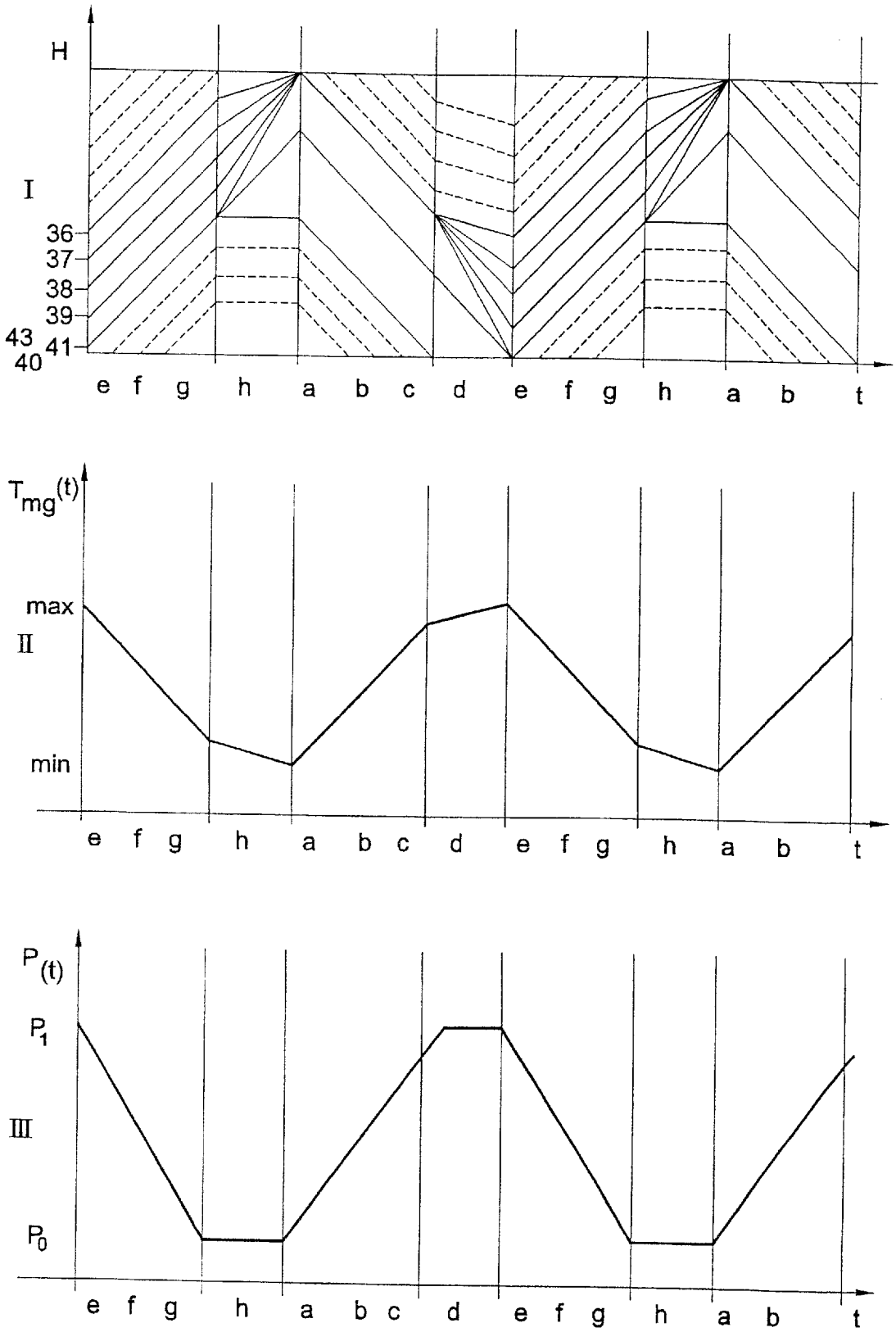
FIG. 10 shows at the top (I) the height H(t) [m] of the moving elements of the apparatus shown in FIG. 8 vs. time; in the middle (II) a T-t diagram showing temperature T(t) of the fluid within the workspace vs. time [s]; and bottom (III) the associated pressure P(t)[Pa] of the fluid.
Figure 11:
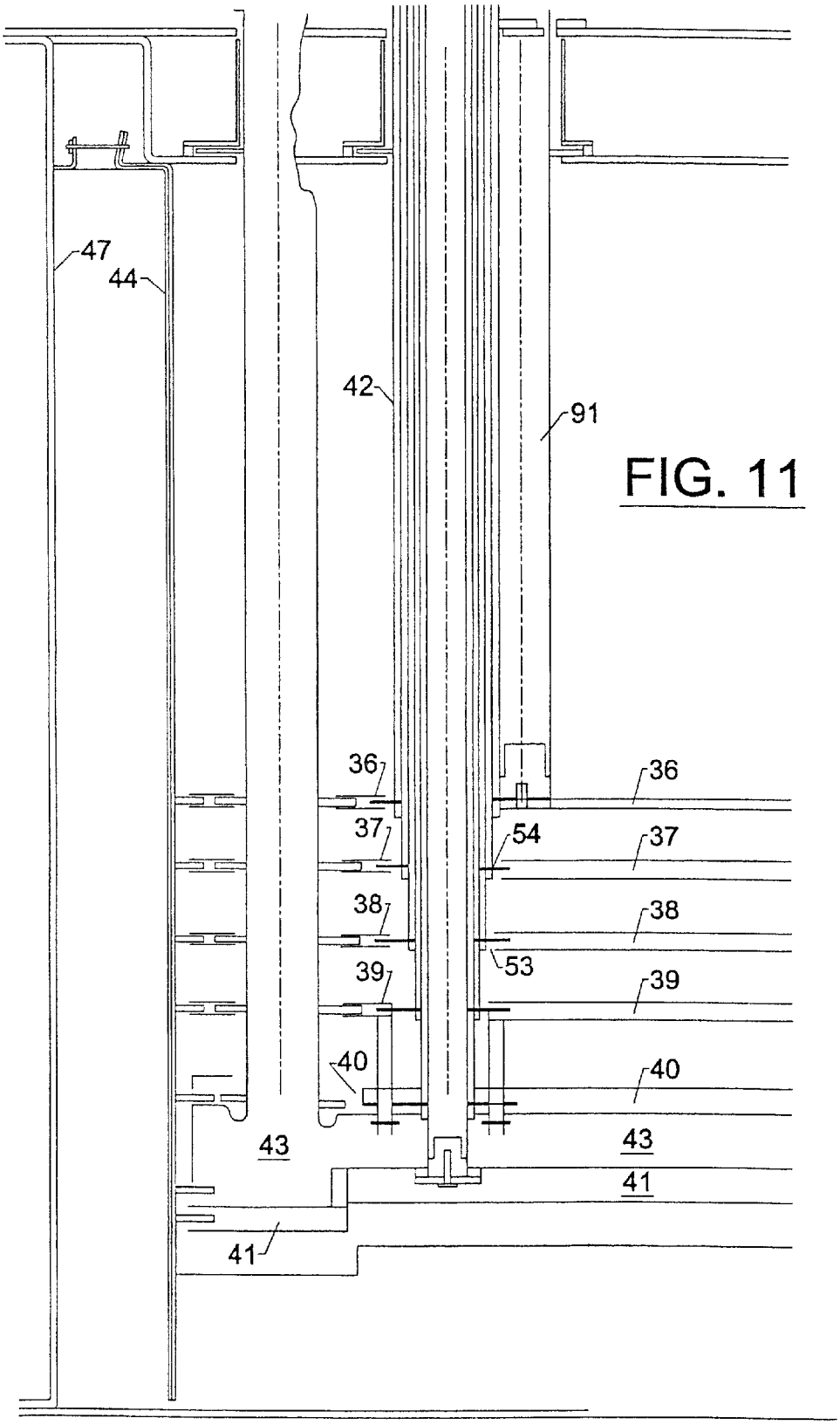
FIG. 11 is a partial view of a lower left portion of the apparatus shown in FIG. 8 with heat exchangers down.
Figure 12:
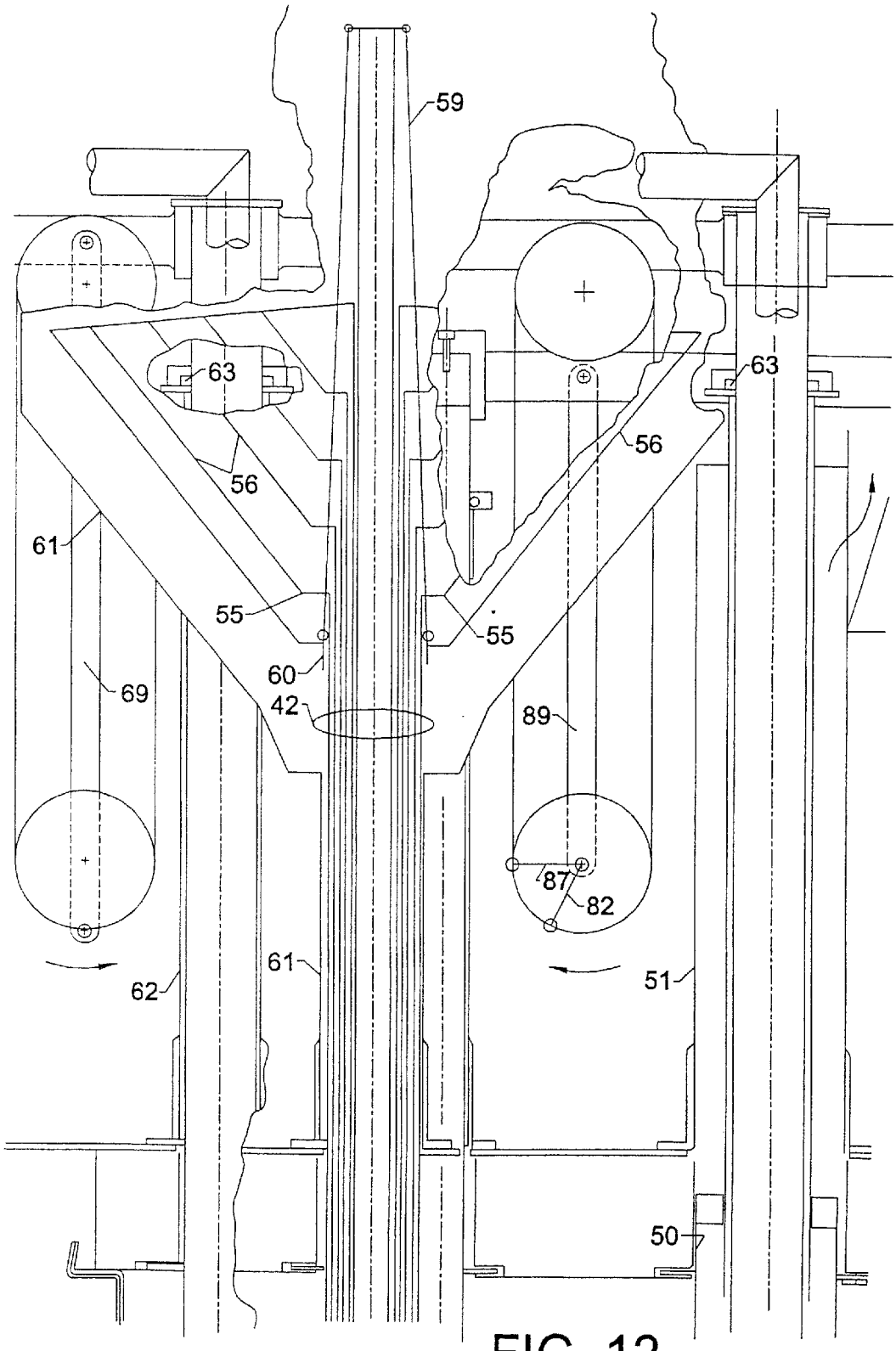
FIG. 12 is a partial view of an upper left portion of the apparatus shown in FIG. 8 with heat exchangers down.
Figure 13:
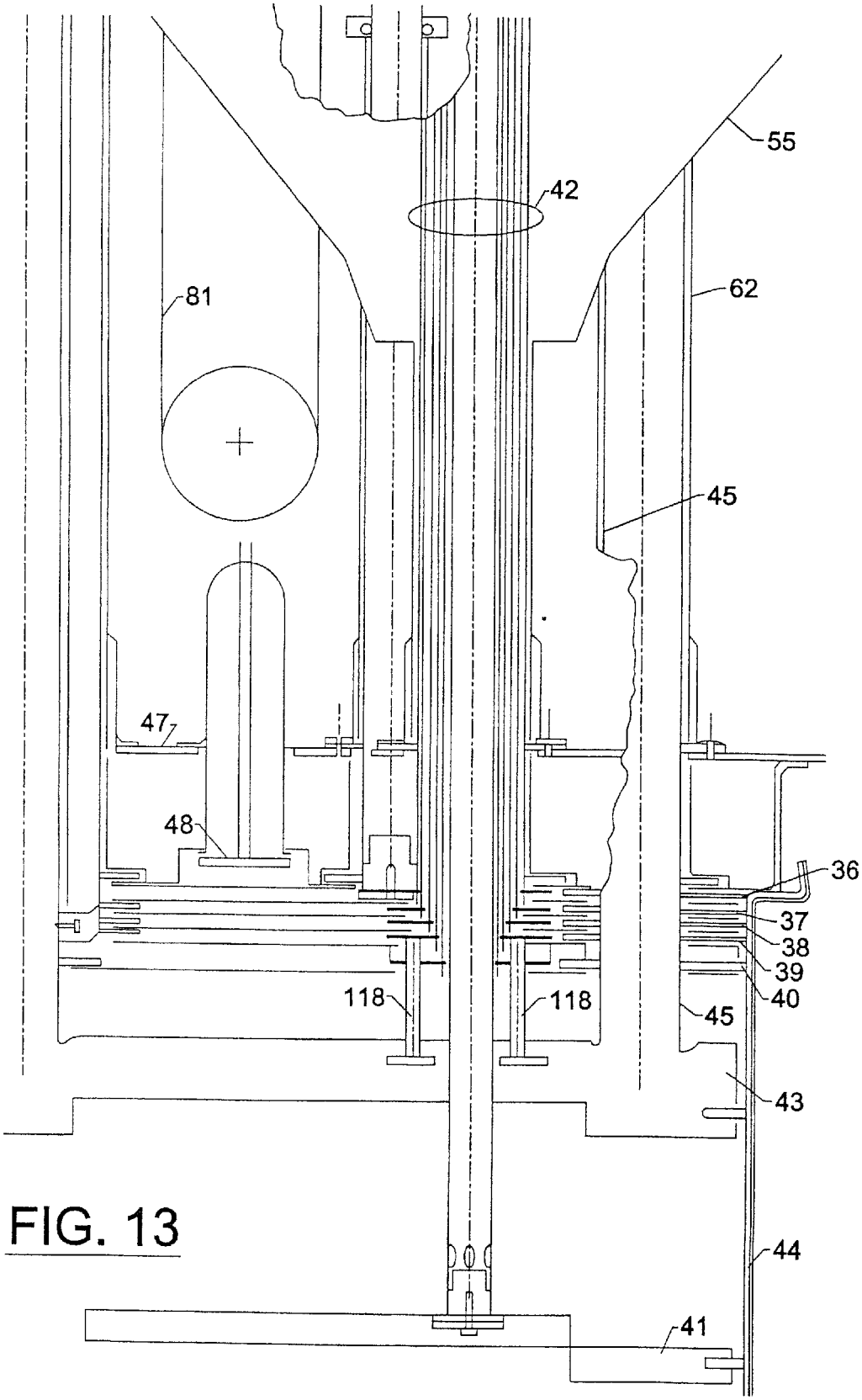
FIG. 13 is a partial view of the lower left portion of the apparatus shown in FIG. 8 with heat exchangers up.
Figure 14:
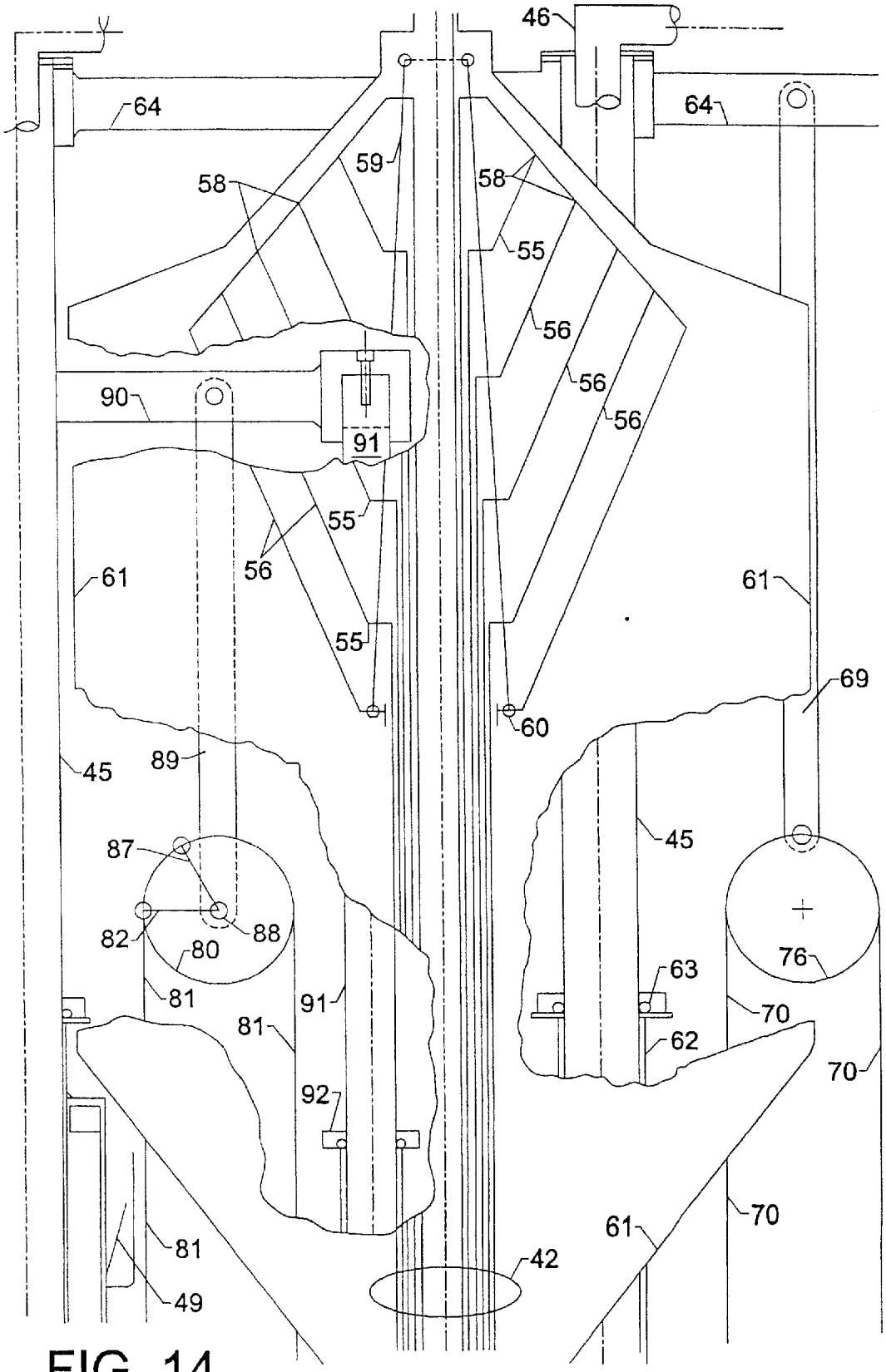
FIG. 14 is a partial view of the upper left portion of the apparatus shown in FIG. 8 with heat exchangers up.
Figure 15:
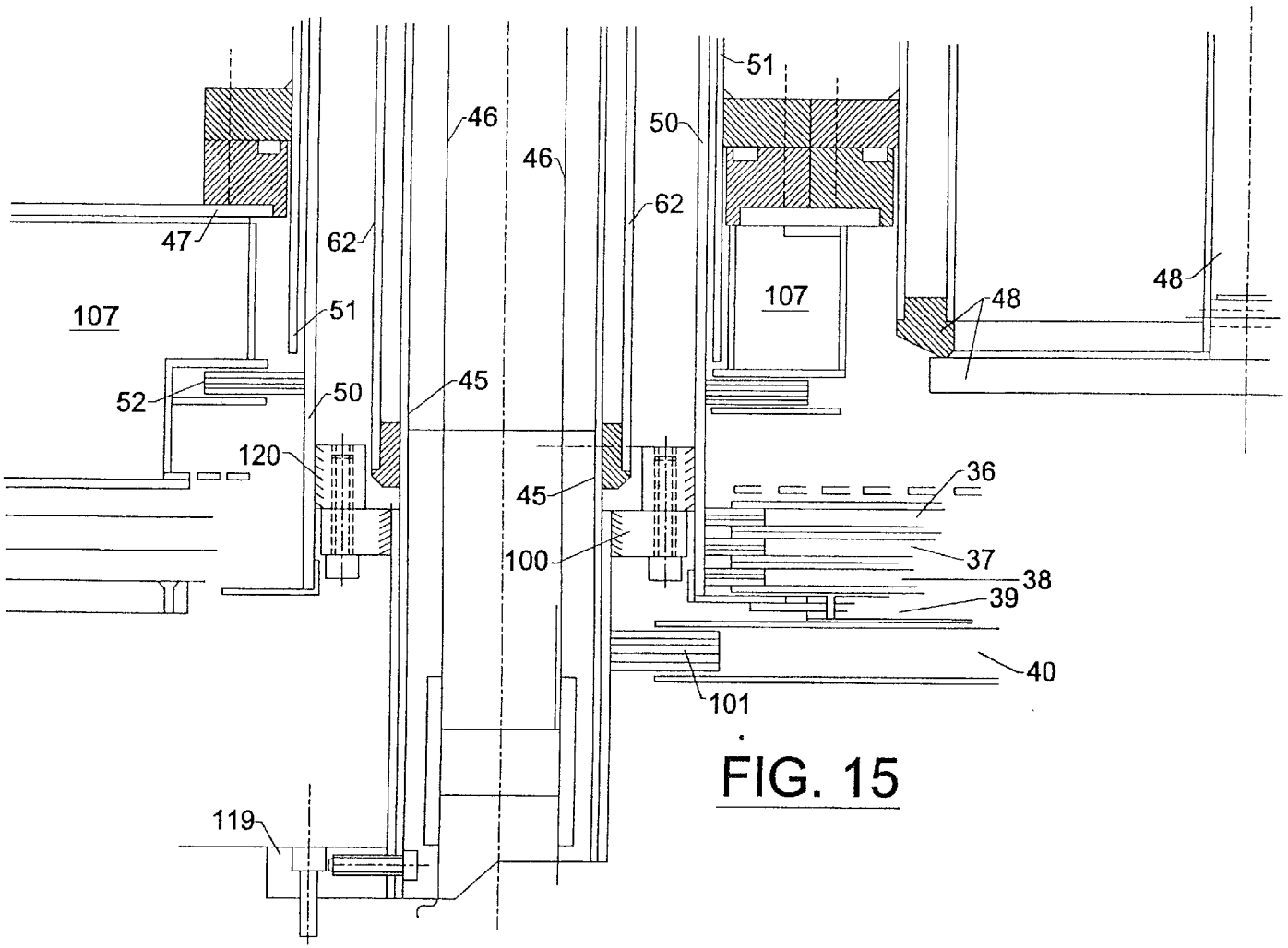
FIG. 15 is a partial view of FIG. 11 showing the connections and sealings of a supply passage.
Figure 16:
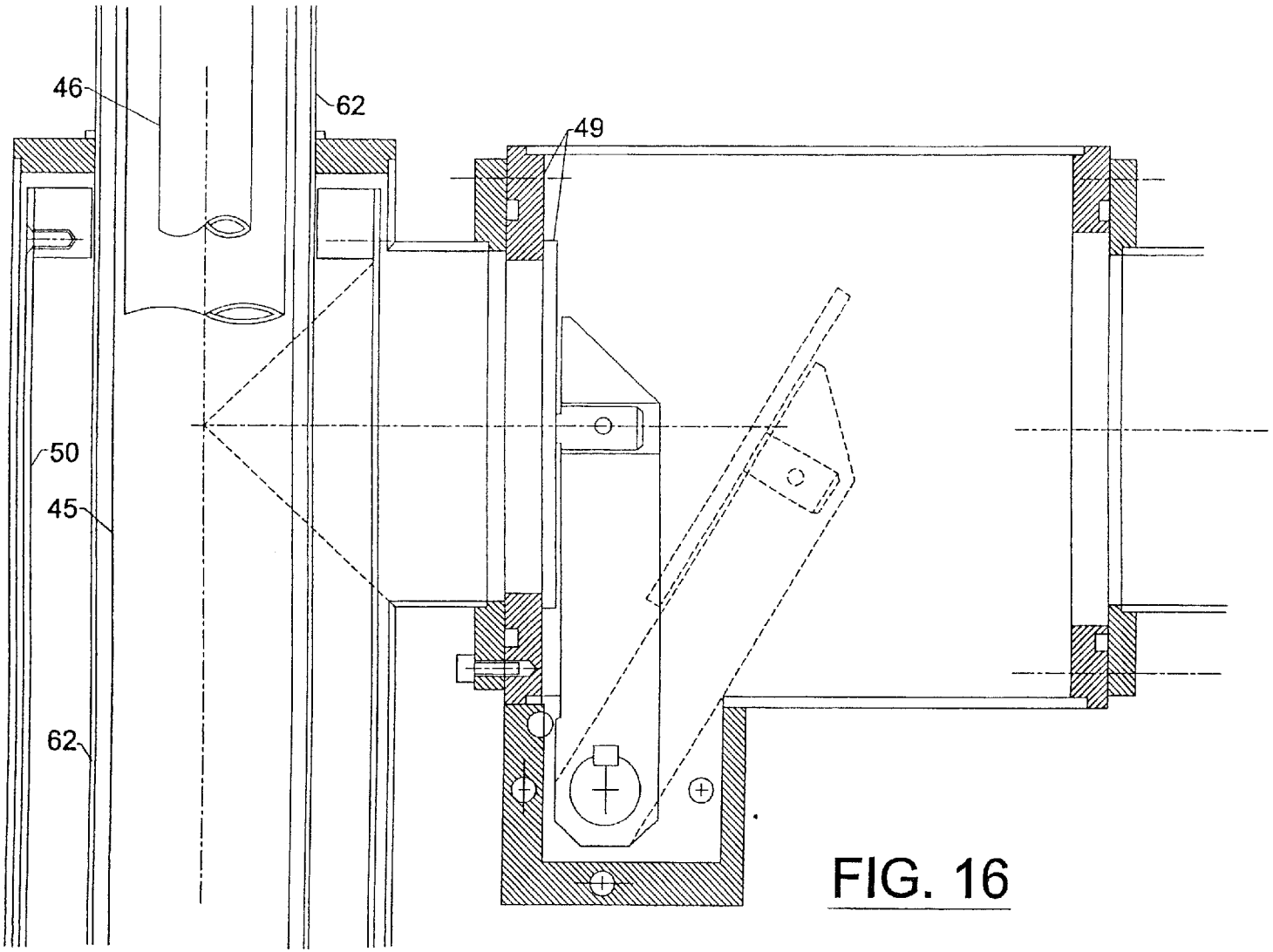
FIG. 16 is a partial view of FIG. 8 showing a valve working as an outlet valve or an inlet valve respectively.
Figure 17:
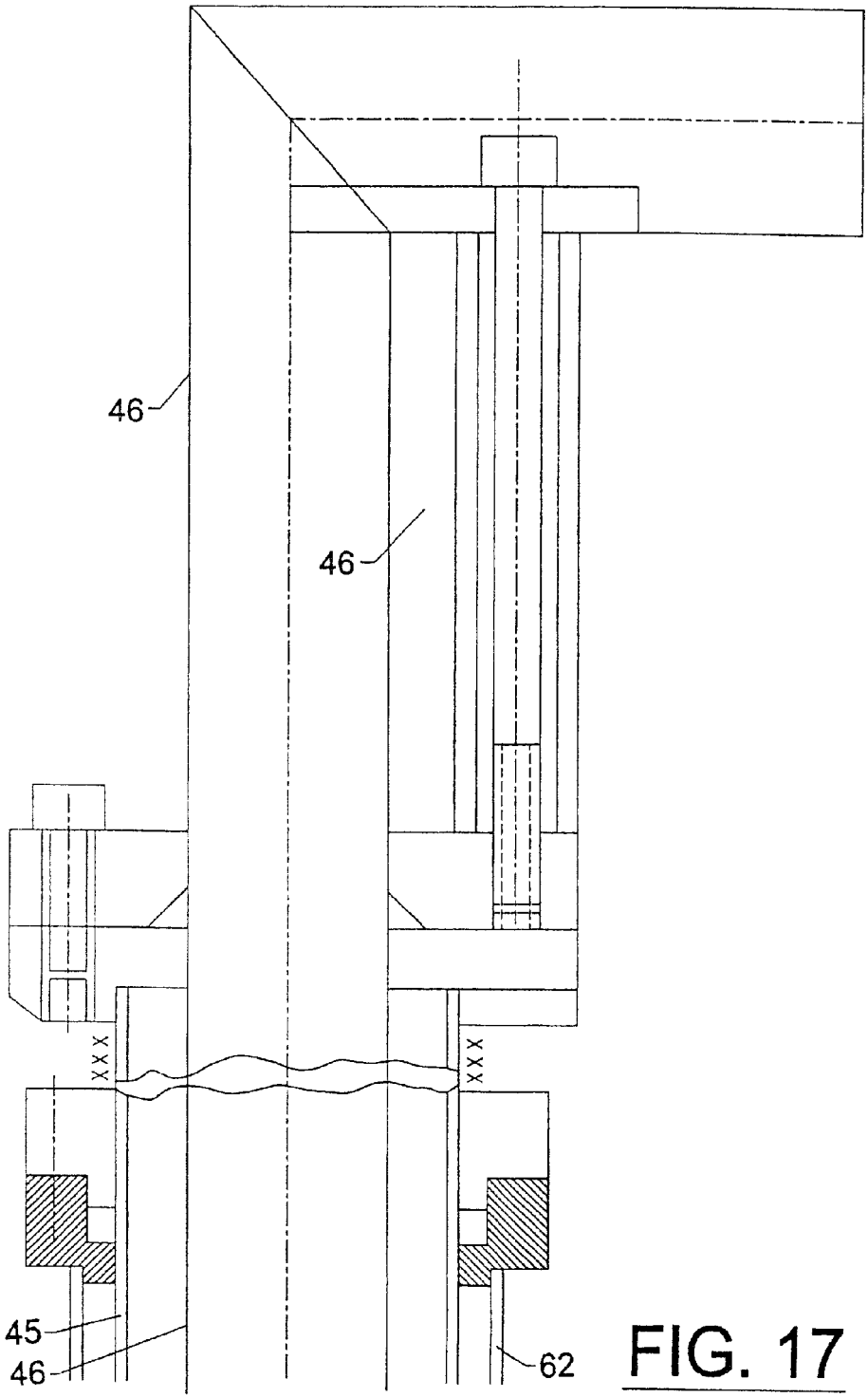
FIG. 17 shows the upper end of the supply passage shown in FIG. 15.
Figure 18:
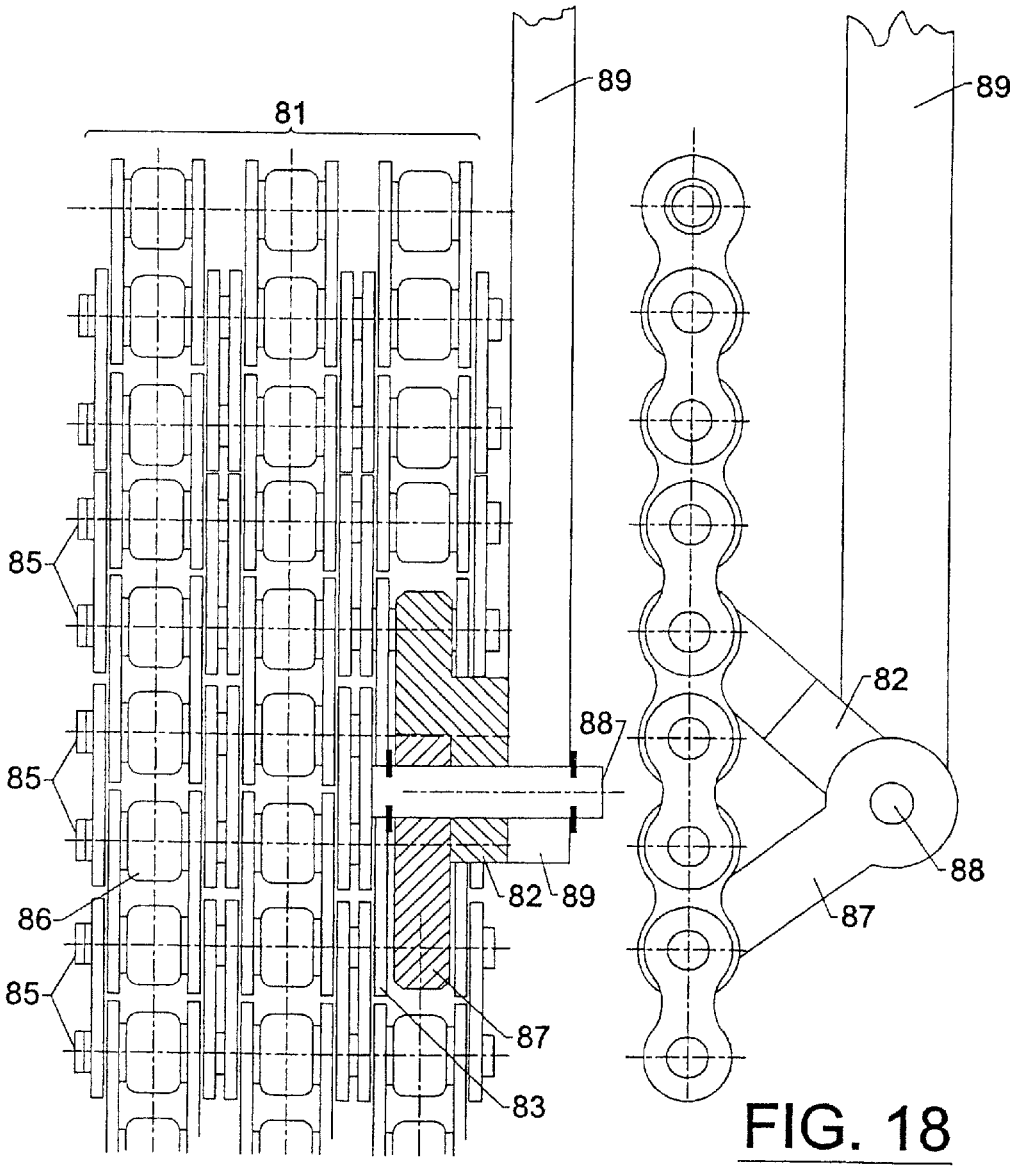
FIG. 18 is a partial view of FIG. 12 showing a chain device in vertical and side view respectively.
Figure 19:
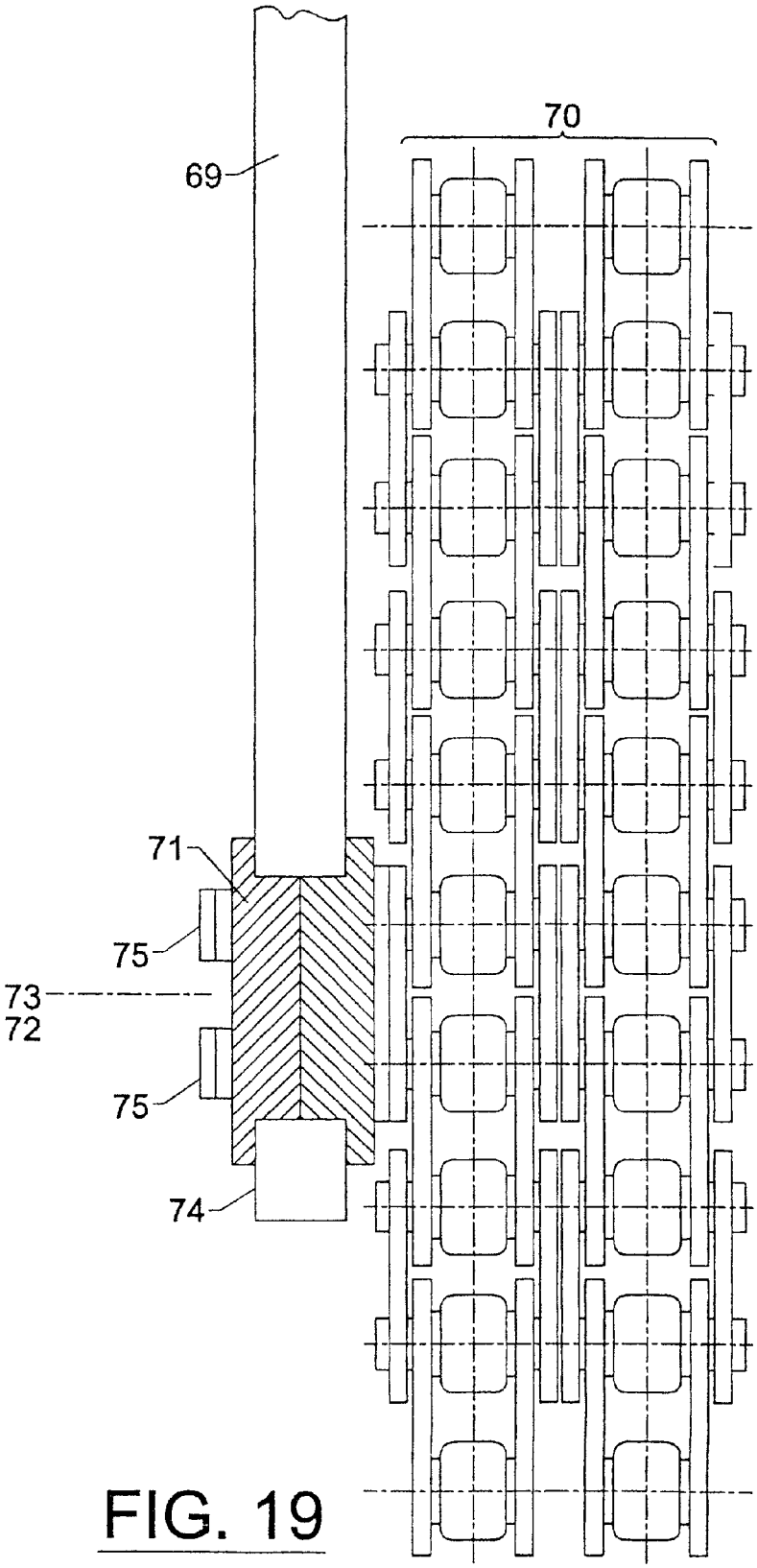
FIG. 19 shows the chain device shown in FIG. 18 with a connecting rod acting directly on moving heat exchangers.

Function described: part of a gas compressor (prime mover) As part of a prime mover, for example, the working volume, represented in FIG. 8, FIG. 9 or FIG. 10, of an entropy transformer has two differences decisive for the thermodynamics, by comparison with that shown in FIG. 1 or FIG. 4, FIG. 5, FIG. 6: Firstly, the size of the working volume is not changed. Secondly, instead of the relatively homogeneous regenerator system 11, represented in FIG. 1, there are active in the working volumes relating to FIG. 8, FIG. 9 or FIG. 10 four discrete, rigidly constructed regenerators 36, 37, 38, 39 on which, as on the two further regenerators 40 and 41, four tubes each are fastened which are respectively part of one of the four concentric arrangements of tubes 42 of the control system. These components 36–41 and the frame with the heat exchanger 43 acting as a cooler are sealed with V2A sealing brushes on bronze cylinder wall metal sheets 44, as also the tubes for the heat exchanger liquid 45, 46 such that they are flowed through between the seal and cylinder wall in the operating state by the working means with a minimum flow loss (below 10%). The periodic sequence of movements of these components is represented qualitatively in FIG. 9I or FIG. 10I with the designations H: for stroke and t: for time. The regenerators are constructed from a lower V2A perforated sheet with as small as possible a metal surface fraction and having U profiles made from V2A which are welded on for reinforcement and are parallel to the perforated sheet, and into which metal fibres (centroid of the diameter at 40 micrometers) are pushed which are sheathed with V2A fabric (wire diameter approximately 0.1 mm) and are clamped and enclosed by a further perforated sheet. The two perforated sheets are held together by a wire winding at the point where the perforated sheets have been deformed such that the outer surfaces of these regenerators have no local elevation despite the wire winding. At the edge, the perforated sheet merges into a sheet without perforations, as a result of which the seals are held and sealed relative to the metal fibres such that the latter are flowed through. Otherwise, a working volume filled with gas as working fluid is largely enclosed by a pressure housing 47, and inlet and outlet valves 48 and 49, respectively, in a fashion similar to the prime mover as in FIG. 1, FIG. 4, FIG. 5, FIG. 6. The gas can flow into the partial volume between the cylinder cover and the regenerator 36 through the inlet valves from a space of the pipeline system which corresponds to 15 in FIG. 1, and flow out from a space between the regenerators 39 and 40 through a tube 50 in which a tube 45 with the line 46 for the heat exchanger liquid runs concentrically and in a permanently connected fashion, and is inserted periodically, in a fashion sealed with brushes 52, into one of the tubes 51 which bound the working volume and are not periodically moved. From this tube 51, the gas can pass through the outlet valves 49 into a space of the gas pipeline system which corresponds to that in FIG. 1 13. In the case of the periodic movement, represented in FIG. 9I, of the elements 36–41, 43, the latter are guided in the stroke direction in the middle of the working cylinder on a stationary tube. Fitted on each of the 6 regenerators 36–40, 41, are four carriages 53 which can be moved only in the direction of the surface centroid of the regenerator and on which of each of the four concentric tube arrangements 42 one tube is fastened with a bayonet lock 54 such that the carriages 53 also serve as a guide for the inner tube. In each case two tubes of the tube arrangements 42 which bear against one another have a larger length difference and stroke difference (cf. FIG. 9I), the tube with the smaller diameter being longer. The tubes which are movably connected at one end to the regenerators 36–40 by the carriages 53 are connected at the other end via in each case two holders, situated opposite one another relative to the tube axis, for bearings 55 with the aid of two levers 56 which are movably connected at the other end to in each case two levers 57 which are oppositely situated per tube arrangement 42 with reference to the tube axis and on which the point of action 58 for the movable connection is removed the further from the tube axis in a plurality of uniform spacings the larger the tube diameter is. The tube connected at one end to the regenerator 41 and situated entirely inside in the tube arrangement 42 is connected at the other end to a short length of tube 60, via two rods 59 guided past laterally at the levers of the other tubes, which tube 60 can slide on the tube fastened on the regenerator 36, and to which, as described above, there are likewise movably connected two levers of the type 56 which are connected to the levers 57 at the other end with the greatest distance from the tube axis. The entire moving structure of 55–60 is also surrounded tightly in the operating state by a housing 61 such that as little dead space as possible remains, since the pressure is periodically changed inside this housing, which is connected to the working volume, that is to say this housing is part of the pressure container. Since in the case of the use of automatic coolers and the space requirement for the frame carrying them, the surface of the heat exchangers which is flowed through is decisively smaller than the surface in the working volume perpendicular to the stroke, the sequence of movements represented in FIG. 9I was selected, no regenerator being against the heat exchanger structure 43 in the time period a-b-c and, above all, the automatic coolers being flowed through by the gas. In the time period e-f-g, the regenerators 40 and 41 bear tightly against the heat exchanger structure, whose large-volume interspaces are filled with wood (or FRP) in a fashion capable of being flowed through such that the regenerators are flowed through as uniformly as possible. In this case, in the heat exchanger structure 43 the gas flowing past by the automatic cooler must overcome a decidedly larger flow resistance than that flowing through an automatic cooler, so that the automatic cooler is flowed through by gas in the time period a-b-c in conjunction with an only slight bypass gas flow. In the case of the regenerator 39, the displaceable carriage 53 is connected to the frame of the heat exchanger structure 43 at fixed spacings with the aid of screws and spacer tubes (118), which are guided by the carriages of the regenerator 40. Also connected to this frame are the tubes 45, inside which the lines 46 for the heat exchanger liquid are arranged. These tubes are led out of the working volume and connected to a frame 64 by tubes 62, which also form part of the pressure housing, and seals 63. Two tubes 65, which are fastened to this frame in a flexurally stiff fashion, run in the stroke direction and are arranged opposite one another in the stroke direction with reference to the central axis of the working volume, are guided in parallel in the stroke direction by in each case two sliding bushes 66, which are fastened on a tube 67 running in parallel and permanently connected to the pressure housing. Tension springs 68, which are loaded between the upper ends of the permanently standing tube 67 and the lower end of the tube 65 fastened on the moving frame 64, partially compensate the weight force of the moving structure. Two connecting rods 69 are fastened movably on the frame 64 such that the bearings are arranged situated opposite in the stroke direction with respect to the central axis of the working volume. The other ends of these connecting rods 69 are fastened in each case to chains 70 with a bearing axis parallel to the chain studs.

The bearing fastened on the chain 70 is formed by two identical discs 71 with two bores 72 each, the discs 71 engaging in the bore 73 of the connecting rod 69 from both sides, surrounding the bearing rod 69 with their collar 74, and being fastened with the aid of the bolts of the chain joint 75 of a three-fold chain on the two-fold chain 70 and installed in it. In each case one of the chains 70 runs over two sprockets 76, which are mounted unilaterally such that the parallel bearing axes are arranged perpendicular to and with a displacement symmetry in the stroke direction, and the connecting rod does not hit as the chain revolves. Fastened on the same spindle on the lower of these sprockets is a further sprocket 77 with an adjustable relative angle, which is coupled via a further chain 78 to a sprocket 79 which is connected to one of two two-fold sprockets 80, mounted on one axis, on a spindle with an adjustable relative phase, over which a three-fold roller chain 81 runs such that it projects over the sprocket in the direction of the chain stud on the side on which no spindle leads to the sprocket. The pitches of the sprockets 77 and 79, as well as 80 and 76 are of the same size in each case, and the chains 81 and 70 are of equal length.

A chain link with rollers is removed from the roller chain, and in return a lever 82 is inserted between two metal sheets 83, originating from the chain, with in each case two holes together with a singly drilled disc 84 through two chain joints (plug-in links with spring locks) 85 and further chain links 86 at the point where there is no contact with the sprockets because of the overhang of a chain.

At another point of the chain in the same track, a further lever 87 is rotatably fastened in the same way at one end and offset such that the other end is rotatably fastened on a bearing 88 between the ends, mounted on the same axis, of the other lever 82 and of the connecting rod 89. The spacing of the lever axes of the levers 87, 82 corresponds to the pitch of the two-fold sprockets 79 or 76. The connecting rod 89 is fastened mounted in a rotatable fashion on the other end on a further frame 90. Fastened on the frame 90 are four tubes 91 which run in the stroke direction and dip through seals 92 into tubes which belong to the pressure housing and are connected at the other ends to the carriages 53 of the upper most regenerator 36. The axes of the lower sprockets 76 which are the outer ones in the stroke direction with reference to the central axis of the working volume, are so long that sufficient space remains to be able to fasten on the other mounted end a further sprocket 94 which is connected to a chain 95, 96, guided thereover, with a sprocket 97 which is fastened on a spindle which forms part of the electric geared motor (which is fitted with the additional flywheel on the motor axis). So that the abovementioned far-reaching mirror symmetry of the chain drive also holds for the direction of revolution of the sprockets, a chain is guided by 2 chain rollers 98 such that the sprockets 97 and 94 engage in the links of the chain 95 from different sides. In order to be able to achieve the movements, represented qualitatively in FIG. 9I, in conjunction with acceptable accelerations, the spacings of the bearings of the levers 82, 87 must be suitably selected, and the chains must be appropriately clamped and suitably adjusted by setting the phase of the sprockets 77 and 76 or 79 and 80, which are fastened on one spindle. With reference to the direction of revolution, as well, the overall chain bearing largely has a mirror symmetry with reference to the plane in which the central axis in the stroke direction of the working volume and one parallel to the bearing spindles of the sprockets lie. This movement is characterized in that the regenerators 36–40 largely bear against one another in a time period a-b-c of the cycle, and is flowed through from the cooler in the case of the movement of a portion of the gas in the working volume. The conduit 46 penetrates the fastening of the tube 45 on the lower stroke frame 90, is sealed there against the tube 45 and fastened by a screw running in a spacer tube present there such that for mounting purposes it can be pushed into the tube 45 by approximately 10 cm. The short connecting hose from the conduit to the automatic cooler stub can be mounted in this way.

Pushed over each of the tube lengths 45, in which the conduit lengths 46 for the heat exchanger liquid (water with antifreeze agent) run, in a closely fitting fashion on the end in the working volume is a tube sleeve 99 on which the seals 100 of the regenerator 40 slide and on which there are permanently welded small metal parts 101 with holes in the stroke direction to which it is screwed to the air guide tube 50 with the aid of permanently welded nuts 120. At the common end, the tube length 45 and the tube sleeve 99 are screwed in the radial direction to a metal piece 119 to which the frame which carries the heat exchanger is screwed. As a result, during mounting the tube lengths 45, 46 can be pushed into the pressure vessel from outside through seals 63. The periodically moved rigid pipeline system for the heat exchanger liquid of a heat exchanger has upstream and downstream of the heat exchanger in the through flow direction two tubes 102, 103, running in the stroke direction, which in each case dip from above into a separate standing vessel 104, 105 with heat exchanger liquid, a pump 106 pumping the heat exchanger liquid from the heat exchanger in the working volume into the vessel 105, from where it flows into the other vessel 104 after outputting heat in a further idle heat exchanger (for example cooled by groundwater). The liquid level of these vessels with an opening should, other than as represented in FIG. 8, be below the working volume so that in the event of a leak or hole in the liquid circuit there is no relatively large accumulation of liquid in the working volume, which could lead to a dangerous sudden development of steam, but that gas is drawn into the heat exchanger liquid conduit system, and the pipeline system is thereby emptied. In order to be able to achieve this emptying completely, a thin hose (garden hose) is pushed into the tube 102 from the vessel 104 as far as the deepest point of the heat exchanger in the working volume. The thermal expansion of the material becomes a problem in the case of the targeted order of magnitude (100 liters working volume) of the machine. It is countered in that the pressure vessel 47 itself remains largely at ambient temperature and is insulated in a space filling fashion against the hot interior (for example with glass foam 107). The cylinder wall 44 in the stroke direction is then formed from two layers of sheet-metal strips, arranged offset, of width 20–30 cm, the approximately 3–5 mm wide joints running in the stroke direction. The surfaces of the pressure housing, which are arranged largely perpendicular to the stroke direction, are likewise largely insulated in a space-filling fashion, likewise with glass foam 107, for example, against the interior, which is held by a reinforced flat metal sheet. At the perforations, of the elements of the control system, for example, this metal sheet must be cut out generously in the direction of its surface centroid and have an appropriate spacing at the edge in relation to the adjoining one. The valves 48 and/or 49 are opened or held open via a Bowden cable or a linkage by a lever which is pressed with a roller onto control plates which are fastened on the chain links of the chains 70 or 81. In order to be able to open these valves even in the case of a larger pressure difference and underpressure in the working volume, a valve parallel thereto and having a substantially smaller cross-sectional surface is opened in advance by the same drive for the purpose of lowering the pressure difference. In the partial volume which is delimited from the working volume only by the regenerator 41, grid planes 108, which are to be flowed through by the gas and are arranged perpendicular to the stroke direction, are moved by the control system, as characterized in FIG. 9I, such that in relation to this regenerator 41 or the neighbouring, already moved grid plane, they either keep a specific spacing (for example 20% of the total stroke) or remain as close as possible to the boundary surface of the pressure vessel. Largely the same applies to the drive of the grid planes 109 in the partial volume of the working volume which is delimited only by the regenerator 36. In the case of this periodic sequence of movements, in the operating state these grid planes are flowed through largely only by gas at constant temperature, and the formation of eddy flows, which can cause mixing of gas quantities with the maximum temperature differences into this partial volume is strongly impeded. fashion, likewise with glass foam 107, for example, against the interior, which is held by a reinforced flat metal sheet. At the perforations, of the elements of the control system, for example, this metal sheet must be cut out generously in the direction of its surface centroid and have an appropriate spacing at the edge in relation to the adjoining one. The valves 48 and/or 49 are opened or held open via a Bowden cable or a linkage by a lever which is pressed with a roller onto control plates which are fastened on the chain links of the chains 70 or 81. In order to be able to open these valves even in the case of a larger pressure difference and underpressure in the working volume, a valve parallel thereto and having a substantially smaller cross-sectional surface is opened in advance by the same drive for the purpose of lowering the pressure difference. In the partial volume which is delimited from the working volume only by the regenerator 41, grid planes 108, which are to be flowed through by the gas and are arranged perpendicular to the stroke direction, are moved by the control system, as characterized in FIG. 9I, such that in relation to this regenerator 41 or the neighbouring, already moved grid plane, they either keep a specific spacing (for example 20% of the total stroke) or remain as close as possible to the boundary surface of the pressure vessel. Largely the same applies to the drive of the grid planes 109 in the partial volume of the working volume which is delimited only by the regenerator 36. In the case of this periodic sequence of movements, in the operating state these grid planes are flowed through largely only gas at constant temperature, and the formation of eddy flows, which can cause mixing of gas quantities with the maximum temperature differences into this partial volume is strongly impeded. Like the working volume in FIG. 1, the working volume represented in FIG. 8 is connected to a pipeline system and integrated into the surrounding system.

In the case of the regenerator 39, the displaceable carriage 53 is connected at fixed spacings to the frame of the heat exchanger structure 43 with the aid of screws and spacer tubes 118, which are guided through the carriage of the regenerator 40.

At the common end, the tube length 45 and the tube sleeve 99 are screwed in the radial direction to a metal piece 119 on which the frame which carries the heat exchanger is screwed.

Pushed over each of the tube lengths 45, in which the conduit lengths 46 for the heat exchanger liquid (water with antifreeze agent) run, in a closely fitting fashion on the end in the working volume is a tube sleeve 99 on which the seals 100 of the regenerator 40 slide and on which there are permanently welded small metal parts 101 with holes in the stroke direction to which it is screwed to the air guide tube 50 with the aid of permanently welded nuts 120.

Cycle of the Gas in the Constant Working Volume Represented in FIG. 8

The basic considerations which are undertaken in relation to the system characterized in FIGS. 1 or 3 and used, inter alia, as a gas compressor, also hold for this system characterized in FIG. 8 or FIG. 9 and acting as a gas compressor. Thus, it may also be assumed for this purpose that in the equilibrium operating state the regenerators 36–40 have a temperature profile whose mean temperature $T_{mg}$ is substantially above the temperature $T_k$ of the cooler. The qualitative time profile of the mean temperature in the working volume $T_m$ (t) is yielded therefrom directly and is represented qualitatively in FIG. 9II.

As shown in FIG. 1, the inlet and outlet valves are to be connected to the surrounding systems, that is to say because of the standby space 17 the pressure $P_0$ in the part of the pipeline system upstream of the inlet valves 48 corresponds to atmospheric pressure. The turbine 14 in FIG. 1 is to operate such that the pressure $P_1$ is varied only slightly relative to the pressure difference $P_1-P_0$ by the co-operation with an upstream compensating pressure vessel in the space of the pipeline system adjoining the outlet valve 13. The valves 49 and 48 are opened and/or closed by the (flow) pressure of the gas. In the equilibrium operating state, the gas in the working volume has reached its lowest mean temperature $T_m$(t), cf. FIG. 9I, at the instant a. Directly thereafter, the inlet valve is closed by the flow pressure of gas flowing from the working volume as a consequence of the raising of the mean gas temperature $T_m$ in the working volume. As long as the pressure in the working volume is lower than the pressure $P_1$ on the other side of the outlet valve 49, the latter is also closed. The increase in the mean gas temperature $T_m(t)$ in the working volume leads to a rise in the pressure in the time period a-b-c from $P_0$ to $P_1$:

$$P = k_B * N * \frac{1}{\int_V \frac{1}{T(\vec{r})} d^3 r}$$

In this case, thermal energy is output to the cooler by the compressed gas. At the instant e, the gas in the working volume has reached the highest mean temperature $T_m(t)$. Upon the subsequent lowering of $T_m(t)$ in the time period e-f-g, the outlet valve is closed again by the pressure in the working volume, which is lowered by comparison with $P_1$. The pressure in the working volume is still too large for an opening of the inlet valves, so that the lowering of $T_m(t)$ leads to a reduction in the pressure P(t) in the working volume. In this case, thermal energy is taken from the regenerators 37–40 (cf. $Q_{efg}$), since the gas flowing through is expanded again between two regenerators. Upon a further increase in $T_m(t)$ in the time period c-d-e, the outlet valve is opened by the somewhat higher pressure in the working volume, and a gas quantity of mass $m_A$ flows out.

The maximum mean temperature of the gas in the working volume is reached at the instant e. The mass of the gas in the working volume is smaller in the subsequent time period e-f-g than in the time period a-b-c. The pressure difference of $P_1-P_0$ is already reached after a slight lowering of $T_m(t)$. Upon the further lowering of $T_m(t)$, the gas quantity of mass $m_A$ of the working volume is admitted through the inlet valve at constant pressure $P_0$ until the smallest value for $T_m(t)$ is reached again at the instant j=a. The gas quantity which has flowed in is cooled by the output of thermal energy to the regenerators 36–40, and upon thorough mixing with cooler gas.

It holds in general that: thermal energy is extracted over a complete period from a partial volume divided off from the working volume by the components characterized in claim 1 when said partial volume is (considerably) smaller on average during the time period of the pressure rise than during that of the pressure drop. If in the case of this machine all the valves are suddenly closed in the operating state of equilibrium, a process proceeds which is very similar to that of a Vuilleumier heat pump. In this case, thermal energy is extracted from the partial volumes of the working volume between the regenerators 36–40, and partially output in the cooler. This partial cycle drives a second partial cycle which pumps from the partial volume of the working volume, which is delimited only by the regenerator 41, into the partial volume which is delimited from the working volume only by the regenerator 36.

This process can be prevented from being set in train inadvertently by a jamming valve, and instances of destruction owing to overheating can be prevented by means of a valve which is controlled by the temperature of the partial volume at risk and which reduces a constant pressure in the working volume in an emergency. If, by means of an appropriately low selection of the pressure $P_1$ the outlet valve is already opened a small fraction of the time period a-b-c after the instant a at which the lowest mean gas temperature prevails in the working volume, the pressure in the working volume is then increased in this cycle above all when the partial volume delimited only by the regenerator 41 and that adjoining the cooler are at their maximum size, and the partial volume delimited only by the regenerator 36 and the partial volumes between two regenerators are largely at their minimum size. The other extreme ratio prevails during dropping of the pressure in the working volume. As a result, with reference to these partial volumes the thermal energy is turned around by this overall cycle into the other direction than that in the case of closed valves (cf. above). The pressure $P_1$ can be selected between these two extremes such that on average per period no thermal energy is extracted from or fed to the partial volume of the working volume, which is delimited only by the regenerator 36, by means of the cycle.

The thermal energy which is fed by irreversible phenomena such as the shuttle effect, thermal conduction and the unfavourable efficiency of the regenerator to the partial volume of the working volume which is delimited only by the regenerator 41 is extracted again at this pressure $P_1$ by the specific sequence of movements, represented in FIG. 9I, of the regenerator 41, and fed to the cooler.

The sequence of movements characterized in FIG. 10 has the advantage that the flow channels for the gas exchange are covered only to a small extent by the moving regenerators, or are better constructed. By contrast with the representations in FIG. 8, for this purpose the lower stroke frame 90 must be connected to the lowermost regenerator 41. It is also possible to set the pressure P1 for this sequence of movements in the working volume so as to produce a similar thermal energy balance for the corresponding partial volumes.

Thermal energy is extracted from the partial volumes of the working volume between in each case two of the regenerators 36–40 by virtue of the fact that the gas flowing through is further expanded in the time period e-f-g between two regenerators. Thermal energy is fed to these partial volumes during a period by virtue of the fact that on the basis of the gas quantity of mass $m_A$, which is admitted in the hot state into the working volume through the inlet valve 48 and output through the outlet valves 49 in a cooler state, the regenerators 36–39 are flowed through by a gas quantity which is larger by this gas quantity of mass $m_A$ when through flow is from the hottest side rather than from the cooler side. In this case, a temperature profile with a steeper gradient in the through flow direction is formed on the cooler side of one of these regenerators, which are assumed to be homogeneous. Given the assumed uniform quality of the regenerators, more thermal energy is fed to than extracted from one of the above defined partial volumes during the periodic through flow. The thermal energy output during the cooling of the gas quantity of mass $m_A$ which flows periodically in a hot state into the working volume and out again in a cooler state is partially absorbed by the cycles proceeding in parallel between the partial volumes and exhibiting a largely isothermal absorption and output of thermal energy. As a result, a linear temperature profile is formed in the working volume, as represented in general above in relation to FIG. 4, FIG. 5, FIG. 6. As a result, the average temperatures of adjoining partial volumes of the working volume between in each case two of the regenerators 36–40, given the same size and temporal order of magnitude, exhibit the same difference as represented in general above relative to FIG. 4, FIG. 5, FIG. 6. The maximum amount of work which can be performed in this case is reduced by W_by comparison with the exergy ($T_u$=$T_k$), as explained in relation to FIG. 3. Losses at the regenerators 36–39 are reduced in part by W_. Because of the irreversible phenomena such as thermal conduction or the losses of the regenerators, only a relatively low pressure ratio $P_1/P_2$ is achieved, and the gas quantity $m_A$, must, above all in the case of an apparatus constructed as in FIG. 8 enter the working volume at a temperature which is higher than $T_1$.

One of the valves 49 in FIG. 8 can be used like the valve 35 in FIG. 1 in order in conjunction with the same ratio of the pressures $P_1/P_0$ to achieve the described changes in the temperature differences during cooling or heating of a fraction of the exchanged gas.

Note

A ventilator for drawing in hot air is not necessarily mandatory, since hot air is drawn into the working volume as soon as the regenerator is moving. As long as the regenerator 40 is distant from the inlet valve 48, hot air is drawn in, cold air is blown out and the regenerators 36–39 are heated. The flow resistance of the regenerator is active in this case. When the regenerator 40 moves towards the inlet valves, the valves remain closed. The transition into the periodic operating state represented above and in FIG. 9 then occurs with the rise in the mean temperature in the working volume. In order to make the arrangement described operate as a gas compressor, it is sufficient to drive the regenerators with an electric motor to execute the periodic movements corresponding to FIG. 9.

Cooling of the Gas over a Larger Temperature Difference $T_1-T_2$

If larger temperature differences in the gas accepted by and output from the working volume are to be reached in the system represented in FIG. 8, this is achieved by virtue of the fact that in the time period g-h-a a gas quantity of mass am flows through one of the valves 49, which is used like the valve 35 in FIG. 1 between the regenerators 39 and 40 from the part of the pipeline system 15.

With $T_1$, $T_2$, $P_0$ unchanged, $P_1$ can be selected such that the gas quantity drawn in overall remains constant, that is to say this measure reduces by $m_H$ the mass $m_A$ of the gas which is drawn in in a hot state and forced out at a lower temperature and higher pressure. Less thermal energy is therefore exchanged during a period with the regenerators 36 to 39. The pressure ratio $P_1/P_0$ must be lower in the operating state of equilibrium.

With $T_1$, $P_1$, $P_0$ unchanged, the same quantity of thermal energy is fed during a period to the regenerators 36 to 39 only whenever the exchanged gas quantity is more intensely cooled.

A larger temperature difference $T_1-T_2$ can thus be achieved given the same pressure ratio $P_1/P_0$. Given a constant pressure ratio $P_1/P_0$, the temperature $T_2$ can be stabilized relatively simply by a simple thermostat control for the valve 49 corresponding to the inlet valve 35 in FIG. 1. The inlet valve 35 is opened in this case only whenever the gas (just) exceeds the stipulated temperature at 15. If appropriate, it is also sufficient to reduce the flow resistance in the region of the inlet valve in conjunction with rising temperature of the gas at 15, for example by a baffle, controlled by a bimetal, which changes the cross section for the flow.

Cooling of the Gas over a Smaller Temperature Difference $T_1-T_2$

If the aim in the system represented in FIG. 8 is to achieve a higher pressure ratio $P_1/P_0$ during the cooling of the exchanged gas by a specific temperature difference, the gas quantity of mass $m_B$ is sucked from the partial volume between the regenerators 39 and 40 through the (driven) valve 49, which corresponds to the outlet valve 35 in FIG. 1, in the time period g-h-a with the aid of a ventilator which, in the ideal case, uses adjustable elements to apply the pressure difference to $P_0$, which is small relative to $P_1-P_0$, required for this purpose only in this time period, and this gas quantity is fed to the space 15 of the pipeline system. Four working volumes operate with a phase shift of 90°, that is to say a specific ventilator can run uniformly, and only the outlet valves 35 must be controlled with some expenditure of force and energy. Consequently, with $T_1$, $T_2$, $P_0$ unchanged, the exchanged and cooled gas quantity $m_A$ is enlarged by $m_B$, and a larger quantity of thermal energy is fed to the regenerators 36 to 39 during this time period. This more substantial thermal energy is partially extracted again from the regenerators 36 to 39 in the time period e-f-g during the effectively isothermal expansion of the gas from $P_1$ to $P_0$, it being possible to achieve a higher pressure ratio $P_1/P_0$, resulting in more energy being converted overall per period, in which case the thermal energy exchanged overall at the regenerators 36 to 41, and also the thermal losses associated therewith are increased in a far lower ratio. A better efficiency is thereby achieved overall. If the mass flow through the adjustable ventilator can be set in 3 stages (out, average, large), and the stage of large can always be switched on by a thermostat whenever a specific temperature is undershot, the temperature $T_2$ can thereby be stabilized sufficiently at a value with a relative low outlay.

Note

A ventilator for drawing in hot air is not necessarily mandatory in order to operate the described arrangement as a gas compressor, since hot air is periodically drawn into the working volume as soon as the regenerators are moving. As long as the regenerator 39 is distant from the inlet valve 48, hot air is drawn in, cold air is blown out and the regenerators 36 to 39 are heated. The flow resistance of the regenerator is active in this case. When the regenerator 39 moves towards the inlet valves, the valves remain closed. The transition into the periodic operating state represented above and in FIG. 9 then occurs with the rise in the mean temperature in the working volume. In order to make the arrangement described operate as a gas compressor, it is sufficient to drive the regenerators 36 to 39 with an electric motor to execute the periodic movements corresponding to FIG. 4, FIG. 5, FIG. 6.

Application as a Refrigerating Machine

The above-described system acting as a prime mover and having the working volume represented in FIG. 8 can also, after a few changes, be operated as a refrigerating machine which cools a gas quantity over a large temperature interval. For this purpose, the ventilator (turbine) 14 then driven must force the gas from the part of the pipeline system 15 at the pressure $P_0$ into the part 13 at $P_1$. The sequence of movements represented qualitatively in FIG. 9I or FIG. 10I is run through in the reverse temporal sequence. The outlet valve 49 becomes an inlet valve by virtue of the fact that it is held open against the flow pressure in the time period a-h-g, by the control system, in conjunction with an unchanged stop direction. In this time period a-h-g, the partial volumes between these regenerators are enlarged, and the mean temperature of the gas in the working volume is thereby lowered starting from the maximum value. The gas then flowing in at the pressure $P_1$ outputs thermal energy to the regenerators 36 to 39 upon cooling.

During the following time period g-f-e, thermal energy is extracted from these regenerators by the expansion of the gas between in each case two regenerators (cf. above: prime movers). The lowering of the pressure in the working volume is performed with closed valves on the basis of the lowering of the mean temperature of the gas to the minimum value by a displacement in conjunction with constant relative spacings of the regenerators 36 to 41. As shown above in the case of the description of the prime mover, with the refrigerating machine, as well, the co-operation of the partial processes in the time periods a-h-g and g-f-e forms in the regenerators 36 to 39 a stepped temperature field T(r) which is linear in the stroke direction and whose mean temperature $T_m$ is below the cooler temperature in the case of the refrigerating machine. The temporal development of $T_m(t)$ corresponds to the qualitative representation in FIG. 9II in the case of reversal of the temporal sequence and substitution of max. $T_m(t)$ by min. $T_m(t)$. The mean temperature of the gas in the working volume is increased in the time period e-d-c following thereupon upon telescoping of the regenerators 36 to 39. The inlet valve 48 of the prime mover in FIG. 8 acts as outlet valve in the case of the refrigerating machine when it is held open against the flow pressure in this time period e-d-c, by the control system, is in conjunction with an unchanged stop direction, and inter alia because of the increase in the mean temperature in the constant working volume, gas flows out at a constant pressure $P_0$ into the part of the pipeline system 15. Before this gas is compressed anew by the ventilator (turbine), it absorbs in the heat exchanger 18 the thermal energy originating from the cooling of the other gas flow. When the gas to be cooled is introduced directly into the pipeline system of the refrigerating machine at 15 (cf. FIG. 1) and extracted again at 15, the losses and the design outlay of the heat exchanger 18 can be eliminated. In the subsequent time period c-b-a, the mean temperature of the gas in the working volume is increased to the maximum value by the displacement of the regenerators 36 to 39 which because of the closed valves leads to a pressure increase and the closure of the cycle. Thermal energy is (additionally) extracted from the partial volume of the working volume, which is divided only by the regenerator 36, by virtue of the fact that the valve 48 or a valve, acting in parallel therewith, with a smaller cross-sectional area is already opened before the pressure difference is completely compensated.

Similarly, thermal energy is fed to the partial volume of the working volume, which is delimited only by the regenerator 41, by virtue of the fact that a valve acting in parallel with one of the valves 49 is already opened before the pressure difference is completely compensated.

Cooling of the Gas over a Larger Temperature Difference $T_1-T_2$

As in the case of use as a prime mover, in the case of the apparatus represented in FIG. 1 it is possible for a larger temperature difference of the gas quantity of mass $m_A$ accepted and output by the working volume to be achieved when in the time period e-d-c a gas quantity of mass $m_H$ flows out into the space 15 through the valve 49, which acts in this case as an outlet valve like the valve 35 in FIG. 1 in conjunction with a stop changed relative to FIG. 8, and which is held open in this time period e-d-c against the flow pressure by the control system. With $T_1$, $P_1$, $P_0$ unchanged, the same quantity of thermal energy is fed during a period to the regenerators 36 to 39 only whenever the gas is more intensely cooled. A larger temperature difference $T_1-T_2$ can thus be achieved given the same pressure ratio $P_1/P_0$. Given a constant pressure ratio $P_1/P_0$, the temperature $T_2$ can be stabilized by a simple thermostat control. The outlet valve 49 corresponding to the valve 35 in FIG. 1 is opened in this case only when the gas (just) exceeds the stipulated temperature at 15.

Cooling of the Gas by a Smaller Temperature Difference $T_1-T_2$

The system represented in FIG. 1 and described with the action of a gas compressor can, as already represented above with reference to FIG. 1, also be operated as a refrigerating machine when the working volume and parts of the control system are exchanged for the arrangement represented in FIG. 8. If, as in the case of the prime mover, the aim is also to operate with a specific pressure difference $P_1-P_0$ in the case of the refrigerating machine for a lesser cooling, this can be achieved when the gas quantity of mass $m_B$ in the time period e-d-c is blown in from the space 15 through a further (driven) valve 49, corresponding to the inlet valve 35, between the regenerators 39 and 40 with the aid of a ventilator. As a result, in the operating state the regenerators 36 to 39 are fed a larger quantity of thermal energy by comparison with operation without the valve 49, corresponding to the valve 35 and correspondingly more thermal energy is extracted again in the case of the isothermal expansion in the time period e-f-g by an expansion with a higher pressure ratio $P_1/P_0$. The advantages of these measures, or the control of the temperature $T_2$ are largely the same as in the case of the prime mover relating to FIG. 1.

Heat Pump

The systems described above with the action of refrigerating machines and in which the working volume represented in FIG. 8 is integrated act as a heat pump when the control system drives the regenerators 36 to 41 with an unchanged periodic sequence of movements, and the working direction of the turbine 14 is maintained, but the pressure increase is exchanged, on the basis of an opening of a valve through which the gas flows in, with the pressure drop on the basis of an opening of a valve through which the gas flows out. As a result, only the partial volume, delimited by the regenerator 36, of the working volume is heated, and the partial volume delimited only by the regenerator 41, of the working volume is cooled. Compared with the refrigerating machine described above, the temporal sequence of the mean temperature $T_m(t)$ and the pressure P(t) against the stroke H(t) is displaced by half a period.

The Cycle in the Case of Use as a Heat Pump

In the time period g-f-e, the pressure of the gas in the working volume is increased to the maximum value because of the rise in the mean temperature of the gas owing to the displacement of the regenerators 36–41 in the case of closed valves. Because of the adiabatic compression of the gas flowing through the partial volumes between in each case two of the regenerators 36 to 39, these regenerators are fed thermal energy. Upon telescoping of the regenerators 36 to 39 in the time period e-d-c, gas at the temperature $T_H$ is admitted by the turbine from the working volume at the pressure $P_1$ through the valve 49, which is being held open, since the mean temperature is lowered. In the time period c-b-a, the pressure of the gas in the working volume is lowered from. $P_1$ to $P_0$ because of the lowering of the mean temperature of the gas to the minimum value owing to the displacement of the regenerators 36–41 in the case of closed valves. The gas in the partial volume which adjoins the cooler is expanded adiabatically and cools in the process. In the time period c-b-a, the mean temperature in the working volume is increased with the displacement in conjunction with a constant spacing between the regenerators 36 to 39, the cooled gas flows through the heat exchanger and extracts thermal energy at the temperature $T_k$, and at $P_0$ the valve 48 outputs gas at temperature $T_1$ in the time period a-h-g, since the mean temperature $T_{mg}(t)$ of the gas in the working volume is increased. If, simultaneously with this, gas with the temperature of approximately $T_H$ is pushed by the ventilator out of the space 15 into the partial volume between regenerators 39 and 40 through the valve 49 acting like the valve 35 in FIG. 1, the difference in the temperatures $T_H$–$T_1$ is reduced in conjunction with the same pressure ratio $P_1/P_0$. As in the case of the prime mover, this measure of making a change leads to a larger conversion of mechanical energy in conjunction with thermal losses of approximately the same magnitude (cf. FIG. 1). If gas passes from the working volume into the space 15 of the pipeline system through the valve 49, which corresponds to valve 35, controlled via the gas temperature at 15 in the time period a-h-g, it is thereby possible to achieve a larger temperature difference of the exchanged gas (cf. refrigerating machine or prime mover corresponding to FIG. 1). Fresh air can be filtered and heated with this heat pump. The regenerators in the working volume act as filters and can be easily exchanged in the case of contamination. The thermal energy fed to the fresh air originates partly from a colder heat reservoir such as the ambient air or the groundwater. The thermal pump sketched can be designed such that the air virtually does not come into contact with lubricants, and that the filters can be changed easily upon contamination. In order to be able to achieve a higher pressure ratio $P_1/P_2$, the gas is extracted from the partial volume of the working volume between the regenerators 36 and 37. The design required for this purpose is comparable to that for the exchange of gas into or from the partial volume between the regenerators 39 and 40. Use is made in a similar way for the purpose of guiding air, (cf. 50), of a tube 205 which is fastened on the regenerator 36 and, while being slidingly sealed from the pressure housing, dips into a tube 206 (cf. 51) connected thereto, from which the air is exchanged through valves.

Water in the Pressure Vessel

Figure 20:
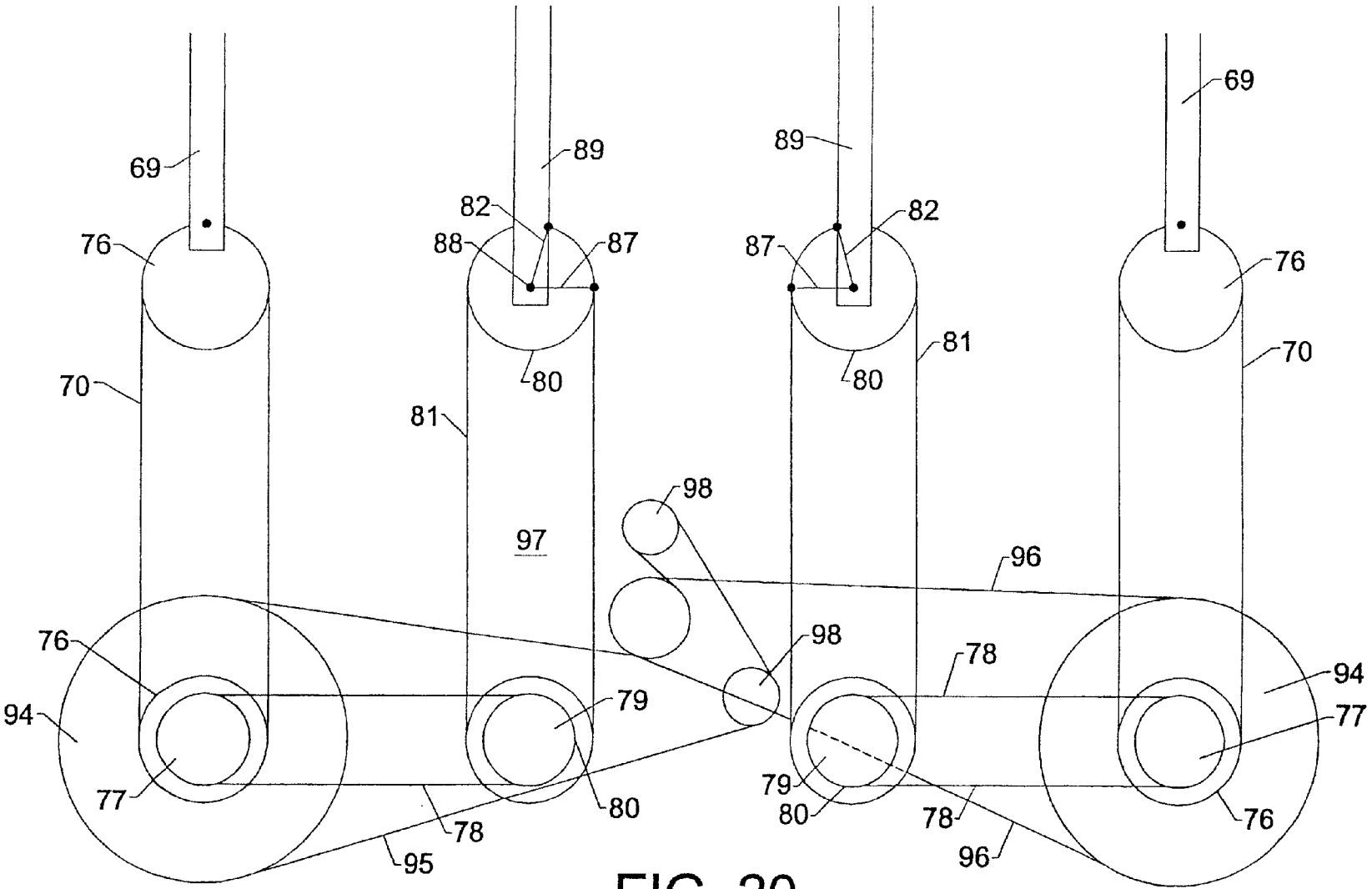
FIG. 20 shows the chain run of the apparatus shown in FIG. 8.

By comparison with the representation in FIG. 8, the outlay on a pressure vessel with the many seals can be substantially reduced to a parallelepiped or cylinder with few openings when, instead of being guided into a separate space 61 of the pressure vessel, the tube bundle 42 is guided in the other direction into a space which is bounded only by the heat exchanger structure of the cooler 43. For this purpose, the diameters of the tubes must be assigned to the regenerators in the reverse sequence. These tubes are connected movably to one another by a lever structure such as 57, 58. The regenerator 41 is eliminated, and the valve 48 remains unchanged. The air guidance tube 50 likewise points in the other direction and slips in a slidingly sealed fashion into a tube which corresponds to 51 and is connected in a sealed fashion to the pressure vessel, it being possible to fit the outlet valve corresponding to 49 on the pressure vessel. Fastened in each case on each of four tubes, which are fastened in each case on one of two different regenerators (ideally: which are temporarily as far distant from one another as possible) are two tensioned belts of which one is wound on during the rotation of a shaft led out in a sealed fashion from the pressure vessel, while the other is wound off. The tubes of each regenerator are thus driven by two shafts, and the regenerators are guided in parallel. Two each of these shafts are coupled outside the pressure vessel to sprockets and a chain guided thereover on which in each case the connecting rod 89 or 69 of the chain drive shown in FIG. 20 acts. The pressure housing is filled with water to the extent that the cooler structure 43 dips in largely completely in its lowermost position. As a result, the conduits 45 and 46 and the perforations 63 and 62 for the cooling liquid are superfluous. This water is exhausted from the upper region and cooled or heated in the closed circuit by a heat exchanger outside the pressure vessel. The tube 50 also serves as overflow for the water level in the pressure vessel. Overflowing water is separated by centrifugal force from the gas in a pressure tank arranged in the pipeline system downstream of the valve 49, since the water-gas mixture enters the pressure tank, which has a vertical cylinder axis, tangentially at medium level, and is extracted again in the middle at the top through a tube which projects approximately 30 cm into the pressure tank. The water is led back from this pressure tank into the pressure vessel around the working volume through a tube which can be sealed by a valve actuated with the aid of a float by the water level in this pressure tank.

The water level can be varied periodically (by actuating a compression device) in the pressure vessel, and an (additional) pressure change can thereby be achieved. It is also possible thereby to achieve for the flow through the regenerators 36 to 40 that there is fastened in a sealing fashion on the edge of each of these regenerators a metal sheet which also always dips into the water in the periodic operating state. In order to minimize the losses owing to the heat transfer surface, this metal sheet must be provided with a water repellent surface of low thermal conductivity.

Functioning of a Gas Compressor According to the Invention

Hot gas+cold gas yields warm gas at a higher pressure

Figure 24:
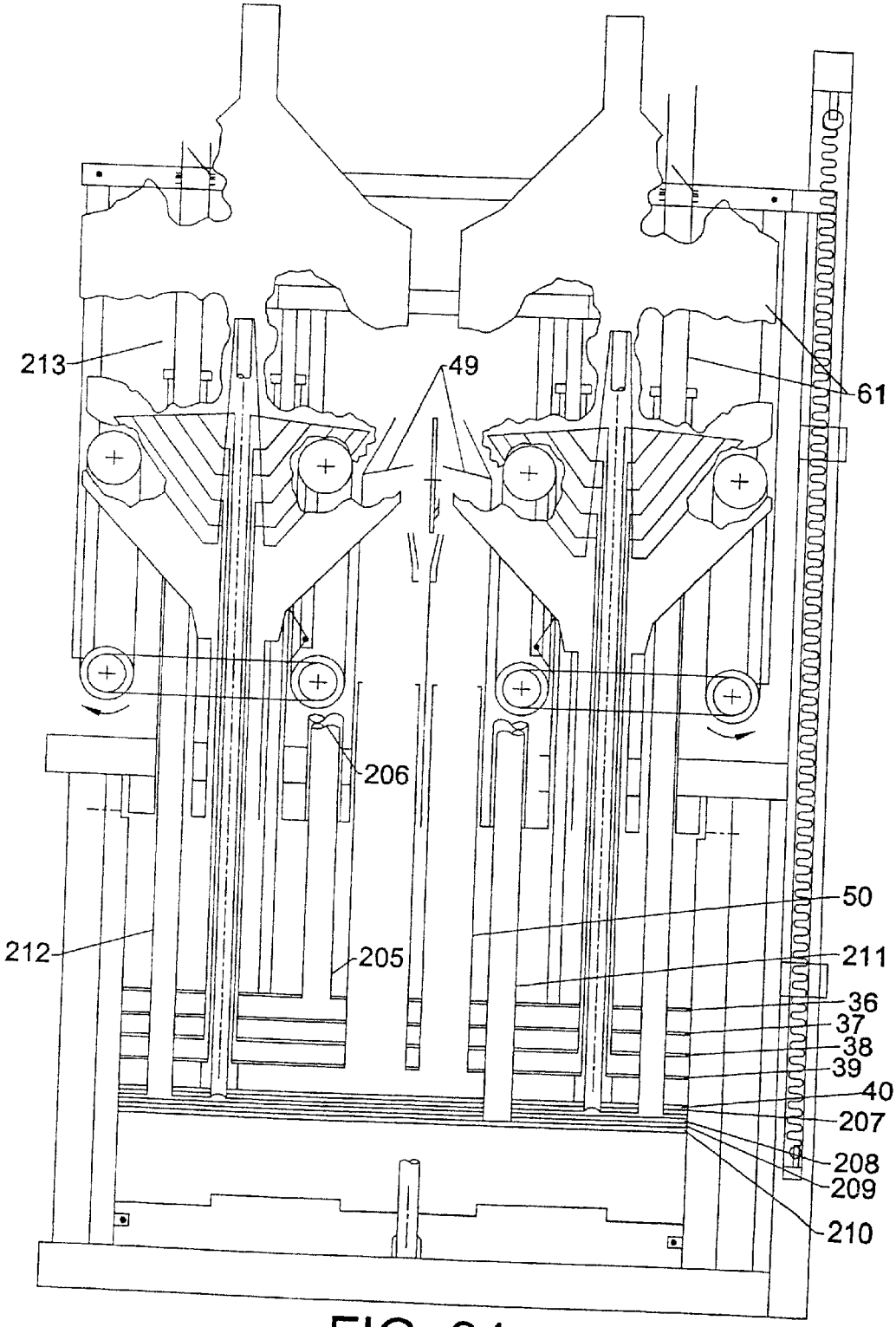
FIG. 24 is a cross-sectional view of another embodiment of the present invention.
Figure 25:
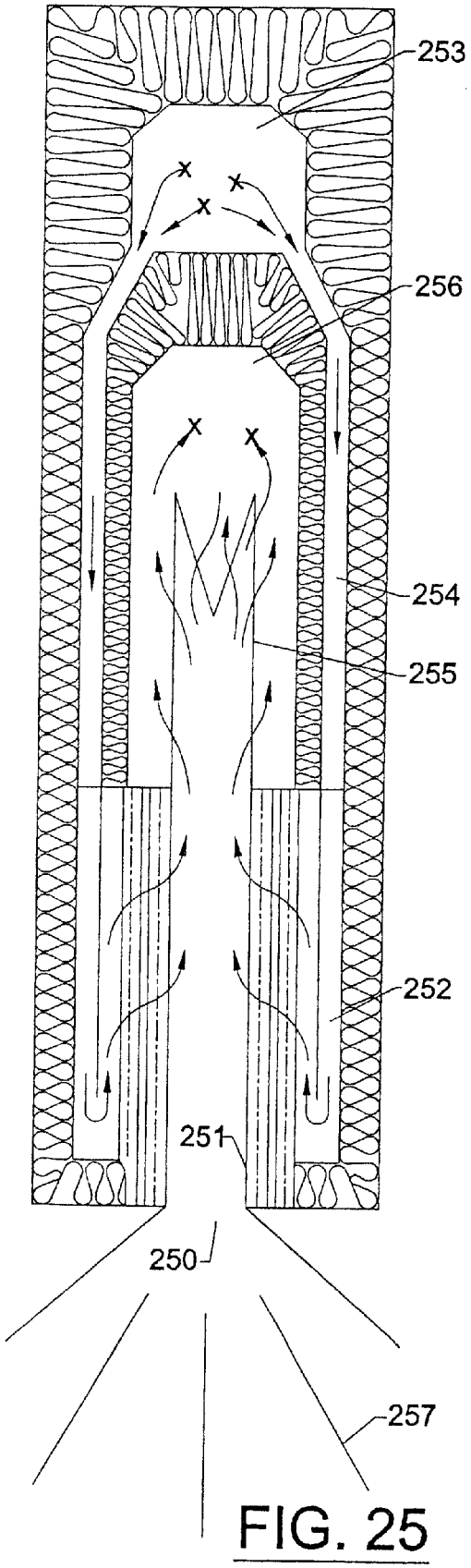
FIG. 25 is a cross-sectional view of a solar radiation absorber.
Figure 27:
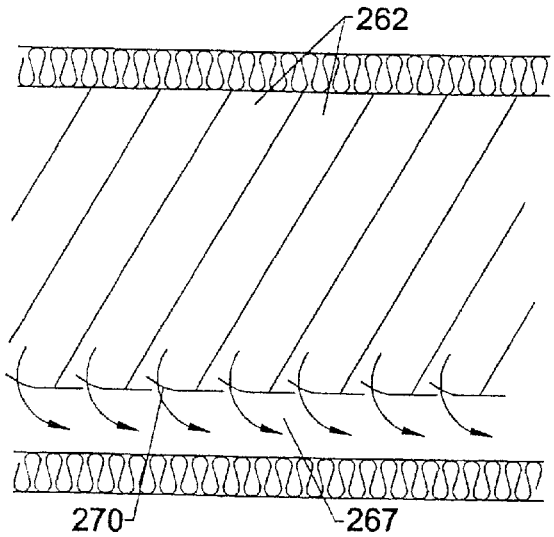
FIG. 27 is a cross-sectional view of a solar radiation absorber looking in the direction of radiation where fluid passages are located normal to the direction of radiation within the most intensively irradiated portion.
Figure 28:
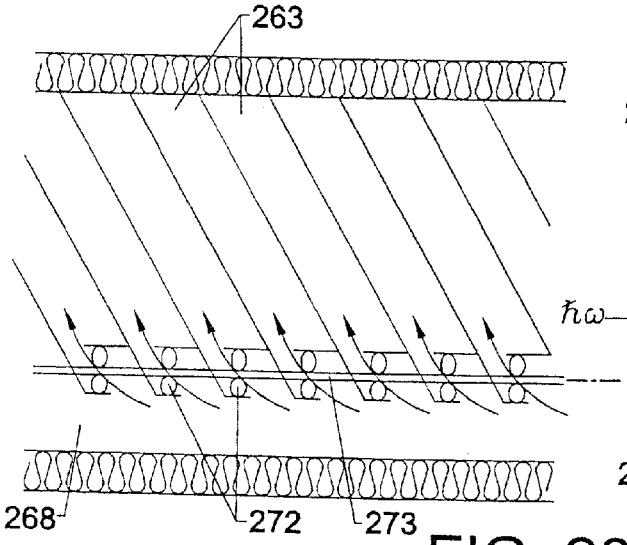
FIG. 28 is a cross-sectional view of a solar radiation absorber looking the direction of radiation where fluid passages are located normal to the direction of radiation within a portion irradiated with a medium dose.

In order to be able to admit two gas quantities of masses $m_1$, $m_k$ at the temperatures $T_1$ and $T_k$, respectively, into a working volume, and to output them again at a higher pressure at temperatures $T_3$, $T_4$ lying between $T_1$ and $T_k$, it is necessary to make the following modifications by comparison with the working volume represented in FIG. 8, as shown in FIG. 24: The regenerator 41 is eliminated, and the heat exchanger 43 is replaced by the regenerator 207. The regenerators 39 and 207 are therefore interconnected at a fixed spacing, and the regenerator 40 temporarily bears against them in each case. Similarly, the regenerator 208, bearing temporarily against the regenerator 207, is permanently connected to the regenerator 38 temporarily bearing against the regenerator 39, the regenerator 209 temporarily bearing against the regenerator 208 is permanently connected to the regenerator 37 temporarily bearing against the regenerator 38, and the regenerator 210 bearing temporarily against the regenerator 209 is permanently connected to the regenerator 36 temporarily bearing against the regenerator 37.

The exchange of air through the air guidance tubes 205 and 211 is likewise performed predominantly simultaneously like the exchange of air through the air guidance tubes 50 and 212. One of the valves 49 or one of the valves 213 through which the air flows out of or into the air guidance tube 212 is used like the valve 35 in FIG. 1 in the case of a changed stop direction.

The sequence of movements and the change in the mean temperature $T_m(t)$, or the pressure in the working volume P(t) largely correspond nevertheless to the qualitative representations in FIG. 9. In the time period g-h-a, gas at the temperature $T_1$, or $T_k$ is drawn in through valves. As shown above, a linear, stepped temperature profile is yielded in the stroke direction in the regenerators between the valves. The gas quantities flowing into the working volume must be appropriately controlled by valves in order to maintain a specific temperature difference in the cooling or heating of the periodically exchanged gas quantities. If the cooler gas is to experience only a slight temperature change, as described above in the process of flowing in through a valve 49 acting like the valve 35 gas is sucked out of the working volume with the aid of a ventilator. Since the gas from two different partial volumes which are separated from one another by a regenerator 40 can flow out from the working volume through different valves 49 and 213 into different spaces of the pipeline system, the temperature differences occurring in the event of the temperature change can (together with a valve which acts like the valve 35) be varied over wide ranges. This type of entropy transformer is simpler to construct overall, since no heat exchanger (for example automatic cooler) is required. Moreover, steam cannot suddenly develop from escaped cooling water. As already shown above, a system acting as a gas compressor can also act with slight changes as a heat pump or refrigerating machine. This design can also be operated such that lukewarm gas at a high pressure is forced periodically into the working volume by a turbine, and that hot and cold gas at a lower pressure flow out from the working volume periodically. In this case, it is essentially possible to make use both of the cycle represented above in relation to the heat pump, and of that relating to the refrigerating machine. The respective temperature differences can additionally be set with the aid of a valve which acts like the valve 35.

Combination of Refrigerating Machine and Prime Mover

If hot gas and cooling water at the temperature $T_k$ are available, gas can be cooled by an entropy transformer with 2 working volumes below the cooling water temperature $T_k$. In principle, for this purpose in the case of the refrigerating machine described above the driven ventilator 14 is replaced by a prime mover described above, the hot gas being accepted by the working volume, which can be assigned to the prime mover, and being output in the case of higher pressure through the outlet valve 49 or 4 into a space of the outline system to which a buffering pressure vessel can be connected and from which the gas, possibly after prior cooling to approximately $T_k$, flows through the valve 49 acting as inlet valve, into the working volume which can be assigned to the refrigerating machine. The gas, cooled to below $T_k$, flows out from this working volume to the valve 48, and possibly the valve 49 acting like the valve 35. As represented above, the periodic flow through these valves of the two working volumes can be set appropriately to tune pressure and temperature differences. If the movements represented in FIG. 4, FIG. 5, FIG. 6I proceed simultaneously in a working volume, the buffering pressure vessel can be of smaller dimension, or be eliminated. This combination can also be used as a heat pump for heating a liquid.

Further interesting combinations serve to increase the calorific value to a value of above 1. Thus, one hot and cold gas quantity each are admitted from a first working volume, as described above, and output again at higher pressure as a cool gas quantity and accepted by a second working volume, which outputs it again as a warm gas quantity at the output pressure. In this process, the liquid of a heat exchanger was cooled in the second working volume, or an additional gas quantity was cooled.

If an isothermal heat source and an isothermal heat sink are available, it is of interest for the purpose of heating or cooling gas for the compressor to be replaced in the case of the systems described above (acting as a refrigerating machine or heat pump) by a known thermal compressor with isothermal absorption and output of thermal energy.

Additional Change in the Working Volume

Because of the flow through the regenerators in conjunction with the drop in pressure in the working volume, the gas expands virtually isothermally. In this process, the gas temperature changes only relatively slightly, since the gas volume flowing through in a period is decisively larger compared with the size of the partial volume of the working volume between two regenerators. As a result, the irreversible phenomena in the case of contact between gas and heat exchange surfaces of the regenerators are less pronounced. These advantages can be employed particularly effectively when, in the case of the machine relating to FIG. 8, the working volume is reduced by a piston moved periodically by the control system in the time period in which the pressure in the working volume would also rise in conjunction with an unchanged working volume. It is particularly important in this apparatus that, as shown above, above the regenerator 36 and below 41 grid planes 108 and 109, respectively, prevent eddies and are moved by the control system such that they are largely flowed through only by the gas of constant temperature. Owing to the effect described above that a valve acts like the valve 35 in FIG. 1, it is possible in the case of this design as well to set the temperature interval in which the gas to be exchanged is cooled or heated. If the gas volume is changed without the regenerators being flowed through in the meantime, the gas between two regenerators is adiabatically expanded or compressed in the process from $P_1$ to $P_0$ and thereby cooled or heated, respectively. The periodic sequence of movements is similar in this case to FIG. 4, FIG. 5, FIG. 6. The irreversibility in the case of a subsequent flow through one of the adjoining regenerators affects the efficiency more strongly the larger the temperature change which occurred in the process was. Since this effect also occurs in the case of the known Stirling engines, interest also attaches to a structurally simple design which corresponds largely to FIG. 1 except for the regenerator system 11, with the change that the regenerator system 11 is replaced by the regenerators 37–40 with the associated control system 42–55 from FIG. 8. The periodic sequence of movements can be gathered from FIG. 4, FIG. 5, FIG. 6I.

Displacer with Ambient Flow

Figure 21:
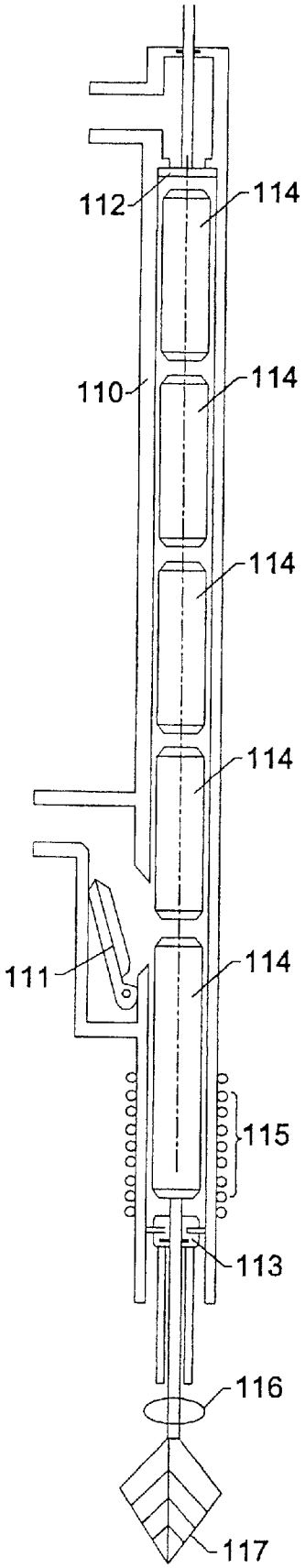
FIG. 21 is a cross-sectional view of another embodiment of the present invention.

In the machine represented in FIG. 21 the working volume largely enclosed by a cylinder as pressure housing 110, the valves 111, 112 and the slidingly sealed piston 113 is divided by cylindrical displacers 114 into partial volumes: These displacers 114 can be flowed around by the working fluid, the gap between displacer and cylinder wall acting as a regenerator, and have in the direction of the cylinder axis an extent which is 3–10 times as large as their maximum length of movement with respect to the pressure housing. In the case of use as a prime mover, cooling is performed by cooling conduits 115 outside the pressure housing. A single displacer 14 acts as one of the corresponding regenerators 36–40 in FIG. 8. The arguments relating to FIG. 9 can be taken over directly in the case of a transferable cycle of movements for a constant working volume (that is to say stationary piston in FIG. 21). The valves 111 and 112 correspond in this case to the valves 49 and 48, respectively. The displacers 114 are driven, as in the case of the regenerators in FIG. 8, by a bundle of concentric tubes 109, the tube with the largest diameter being slidingly sealed with respect to the piston 113, and each other tube being slidingly sealed relative to the two tubes with the next smaller, or next larger diameter. Outside the working volume, driving can then be performed in conjunction with only a relatively slight change in the working volume (up to 10%) by the piston 113 with the aid of a lever structure 117, as in FIG. 8. The corresponding connecting rods of the chain drive described in relation to FIG. 8 can act directly on the corresponding tubes of the tube bundle 109. This design is all the more interesting the lower the ratio of working volume to cylinder surface is, since the heat exchange with the cylinder surface is designed to act in this case like a regenerator. In order to intensify this action, this active surface must be enlarged by fine slots (in the stroke direction) in the case of working fluids of low thermal conductivity. If an even larger heat transfer surface is required to achieve a high level of efficiency, a regenerator to be flowed through must be arranged in the interior of the displacer, and the flow resistance in the gap between the cylinder wall and displacer must be of the same order of magnitude as in the case of the regenerator, in conjunction with a comparable rate of flow. An additional seal can be required for this purpose. The heat transfer surface for cooling through the cylinder wall 115 is enlarged in this case by slots in the stroke direction, and the working fluid flows around the displacer in this region and must also flow through a regenerator in this displacer.

This machine can also be designed for operation with a liquid as working fluid in the working volume.

The technical problems arising in this case (pressure resistance, temperature, stability, seals) were solved by Malone in 1931 for water as working fluid in machines which resemble a Stirling engine in design. Sources: Malone: A new prime mover—J. of the Royal Society of Arts, Vol. 97, 1931, No. 4099, p. 680–708 or: Die Entwicklung des Heißluftmotor [The development of the hot air engine] by Ivo Kolin, Professor of Thermodynamics, translated into German by Dr C. Forster, pages 54, 55 c E. Schmitt, D-6370 Oberursel, PO Box 2006, Tel: (06171) 3364, Fax: (06171) 59518. As shown in FIG. 1, this working volume can be coupled to surrounding systems, when these are designed for the appropriate pressures and pressure differences for liquids, for example: instead of a gas ventilator or gas turbine, a high-pressure pump. As already shown by Malone, compact machines with a high mechanical output can be built by using a liquid as working fluid.

Sealed Displacer

Figure 22:
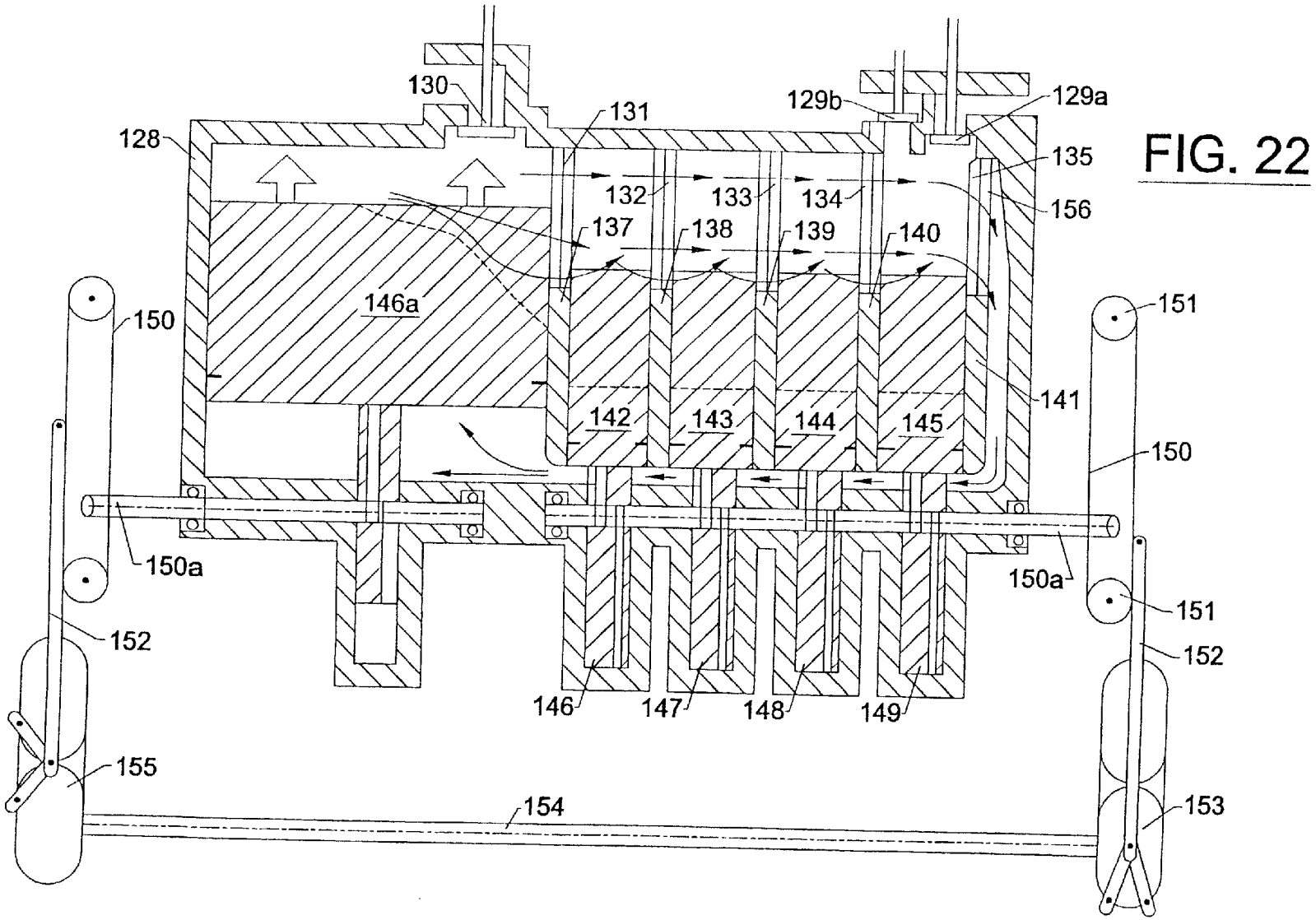
FIG. 22 is a cross-sectional view of another embodiment of the present invention.

Thermodynamically, the working volumes of the entropy transformers in FIG. 22 can be described using the same models as can be linked to FIG. 4, FIG. 5, FIG. 6 or FIG. 9. The design represented in FIG. 22 looks very different, in contrast.

The working volume is largely delimited by a pressure housing 128 and inlet and outlet valves 130 and 129*a, b*. Partial volumes are delimited in this working volume by the regenerators 131–135, which are stationary relative to the pressure housing, the partitions 137–141, which are connected to the regenerators 131–135, walls of the pressure housing, and displacers 142–146, 146*a,* which are slidingly sealed on these walls. In the operating state, the periodic change in size of these partial volumes corresponds to the periodically changed stroke difference of the corresponding regenerators in FIG. 9I. In order to achieve this periodic cycle of movements, the displacers 142–145 can be moved periodically in a simultaneous fashion. The gear racks 146–149 fastened on these displacers are driven by gear wheels on a shaft 150*a.*

This shaft is led in a sealed fashion through the pressure housing out of the working volume and wound on to or off it are the ends of a chain 150 which is tensioned over two sprockets 151, and which is acted upon by the connecting rod 152 of a chain drive design such as that driving the regenerator 36 in FIG. 8. The shaft 154 driven by an electric motor connects this chain drive to a further similar chain drive 155, which moves the displacer 146*a* in the same way, such that there is a phase shift of approximately a quarter period relative to the movement of the other displacers.

By contrast with the displacers in FIG. 21, each of the displacers 142–145 in FIG. 22 is adjoined by one of the partial volumes between two of the regenerators 131–135, and by the partial volume adjoining the cooler 156. The displacers 142–145 are no longer permitted to be flowed around in practice, since the targeted equilibrium is not created otherwise. So that the regenerators 131–135 can be flowed around as uniformly as possible in the time period a-b-c, d-e-f, g-h-j (cf. FIG. 9), in the region which is inserted between two regenerators the displacers have slots running from one regenerator to the other and in the stroke direction. The dead volume thereby produced can have a very unfavourable effect in some applications. A further valve 129*a* can be used like the valve 35 in FIG. 1.

As represented in FIG. 8, it is also possible to construct or use the design of FIG. 22 as a prime mover, refrigerating machine, heat pump, . . . .

Liquid Displacer Piston

Figure 23:
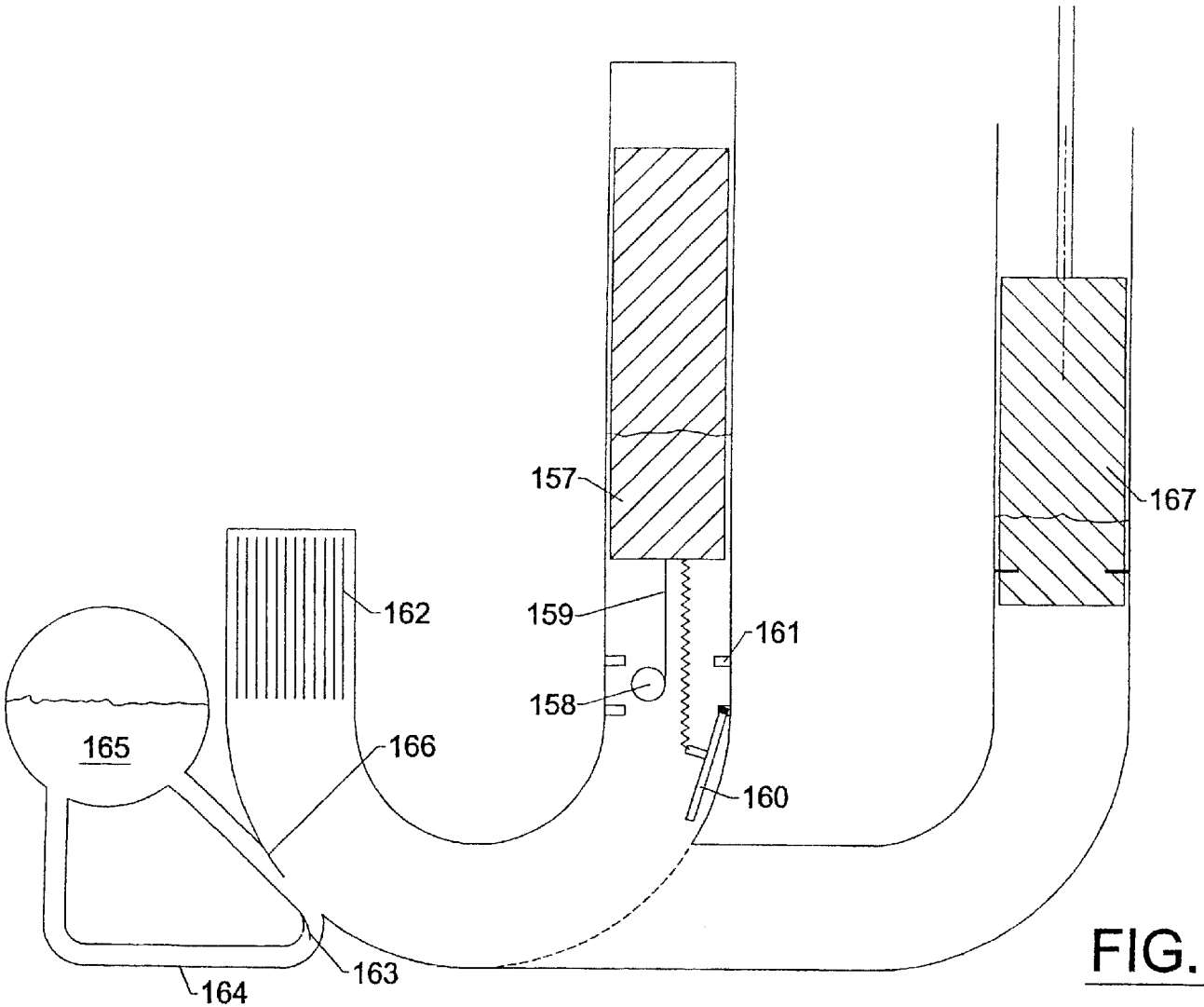
FIG. 23 is a cross-sectional view of another embodiment of the present invention.

The design represented in FIG. 22 and as represented in FIG. 23 is modified for a different design. In this case, the displacer pistons are designed as an oscillating liquid column with a float in a U-shaped container. The movement of the liquid displacer piston is controlled and driven by a belt 159 which is wound onto a shaft 158 in a tension fashion and fastened on the float 157. Since the liquid displacer pistons largely execute the same periodic movements as explained in relation to FIG. 22 with FIG. 9, it is possible in the operating state in the case of this design, as well, for a plurality of liquid displacer pistons corresponding to the displacer pistons 142–145 to be driven from a shaft 158 corresponding to 150*a.* The periodic movement of this shaft 158 can be controlled and/or driven as described in relation to FIG. 22. Before liquid can pass into a hot space past a float 157, which could lead to a dangerous explosive development of steam, the valve 160 is to be closed by the extreme position of the float 157 and the flow rate. In order to achieve a periodic movement more similar to FIG. 9, this valve 160 remains closed by being temporarily locked during the time periods a-b-c with an extreme position of the corresponding float. For the same purpose, the displacer 157 is also temporarily locked when it is pressed against the seal 161 permanently connected to the pressure housing. The surfaces of the heat exchanger 162 are heated or cooled by being dipped into the oscillating liquid. Overall, thermal energy is exchanged by the pressure vessel and the surroundings partly by the continuous exchange of the liquid oscillating in the pressure vessel. During the time period with an above average pressure in the working volume, a portion of this liquid will flow through the valve 163 and the heat exchanger with the surroundings 164 into the standby space 165 in which, because of the enclosed gas volume, a pressure change can take place only by a change in the liquid quantity contained. This quantity of the liquid flow during the time period with a below average pressure flows back again through the valve 166 to the periodically oscillating liquid. The valve 166 acts like a nozzle in relation to use as a prime mover. The oscillating movement of the liquid column is driven thereby. In order to amplify the compression, in the operating state the working volume for the working fluid, which traverses the cycle, is reduced in common with the total volume of the working volume and the volume of the oscillating liquid by displacing the slidingly sealed piston 167 in the time period a-b-c, and enlarged again in the time period e-f-g. The mechanical energy thereby exchanged can be temporarily stored at least partially in the oscillating liquid column which adjoins the piston 167.

Minimum of Two Heat Exchangers in a Pressure Housing According to the Invention

If a liquid is to experience a temperature change over a large interval through contact with a cycle, each of the regenerators 131–134 in FIG. 22 must be provided with a heat exchanger on the same side with reference to the through flow as in the case of the regenerator 135. The liquid can then flow through these heat exchangers in sequence and exchange thermal energy at a plurality of temperature levels in the process (cf. FIG. 3). The quantity of the working fluid in the partial volumes of the working volume which are divided without overlap by the regenerators with heat exchangers are then largely at the temperature of the heat exchanger in each case. If the working means flows in the operating state into a working volume of a prime mover in accordance with FIG. 8, it mixes with cooler working fluid. The thermal energy thereby output is equal to the irreversible phenomena owing to thermal conduction, shuttle losses or limited quality of the regenerators. The result of this overall is a smaller periodic change in the mean temperature of the working fluid and thus, in particular in the case of a smaller temperature difference from 200° C., a substantial decrease in the converted mechanical energy. Since the irreversible phenomena (cf. above) are reduced to a much lesser extent with this temperature decrease, the result is a substantial reduction in efficiency. Likewise associated with a lesser design outlay is a design based on FIG. 23 or FIG. 21, since here, as well, the heat exchangers need not be moved, and the connections for the liquid exchange of the heat exchanger present no problem.

If a change in temperature of the gas which corresponds approximately to the change in temperature of the liquid through the heat exchangers is achieved by the adiabatic expansion in the external turbine, the arrangement of the inlet and outlet valves is performed as in FIG. 22. In the case of the prime mover, the gas exits from the partial volume of the working volume at its highest temperature and enters the partial volume adjoining the heat exchanger at the appropriate temperature. If the change in temperature of the gas is substantially smaller in the case of the adiabatic expansion in the external turbine than the change in temperature of the liquid, the gas is accepted through valves into a (the hottest) partial volume of the working volume and output again therefrom. What is important in general is that gas quantities are mixed or contact takes place with heat transfer surfaces in conjunction with the smallest possible temperature differences.

Integration of Engine+Thermal Gas Compressor

The thermal energy output by the exhaust gas of a spark-ignition or diesel engine upon cooling can be used to generate additional mechanical or electrical energy or to supercharge the engine with filtered fresh air at a higher pressure, and thereby not to have to expend mechanical energy for a turbocharger or compressor, thereby achieving a better performance volume and in any case a higher level of efficiency in relation to an engine without this supercharging. By comparison with an engine without supercharging, a more favourable engine performance volume is possible in conjunction with an improved level of efficiency, since the compression of the air is performed at an unfavourable level of efficiency when an engine is supercharged by a compressor or turbocharger. Further synergy effects are achieved by virtue of the fact that no turbine and no additional generator are required to convert the energy of the compressed air into electrical energy.

Integration of Gas Turbine and Thermal Gas Compressor

In a fashion largely similar to above in the case of the internal combustion engine, the thermal energy output by the exhaust gas of a gas turbine during cooling can be used to feed filtered, cool fresh air at high pressure to the gas turbine. The compressor of the gas turbine used in this process can be designed such that it requires less drive energy in conjunction with an unchanged pressure in the combustion chamber and with an unchanged gas flow rate, and this leads directly to a higher load power in conjunction with the same fuel consumption, and to a higher level of efficiency. Because of a synergy effect, in this case the level of efficiency is higher than the sum of the level of efficiency of the original gas turbine and the level of efficiency of the thermal compressor (gas compressor), since the power produced by the thermal compressor for the partial gas compression can be achieved by the original compressor of the gas turbine only with a less favourable level of efficiency, driven by the tapping of mechanical shaft output. The use of a conventional gas turbine is also possible, if appropriate. It is then possible to expect a relative pressure rise in the gas turbine which decreases continuously from the fresh air inlet up to the exhaust gas outlet, as a result of which there is an increase in the power density and the level of efficiency.

Special Solar Absorber for Heating Working Means

Design principle

Combination of optical concentration by means of a parabolic fluted mirror, translucent insulation and flow through the translation insulation. It is thereby possible for high temperatures to be achieved with a low outlay, and for the advantages of the principle of the invention to be fully utilized for the use of the solar energy. In this case, glass rods 251 are arranged in a fashion largely parallel to a plane which divides the reflected insolation of a parabolic fluted mirror into two beams of equal intensity, and in a fashion virtually adjacent to a plane, perpendicular thereto, through the focal line 250 of the parabolic fluted mirror such that only a small fraction of the radiant power reflected in the direction of the focal line arrives, in conjunction with an ideal alignment of the parabolic fluted mirror, in the region of the end face near the focal line of these elements. The surfaces of the glass rods 251 which run parallel to the perpendicular to the focal line finally reflect the irradiated sunlight in a directed fashion, and the thermal radiation of a blackbody at a temperature of 700° K is absorbed as far as possible. These glass rods are arranged in a plurality of rows with only small slots and, together with a glossy metal sheet which has surfaces parallel thereto, surround a flow channel 252 parallel to the focal line 250 which is supplied with air from a flow channel 253 parallel to the focal line 250 and with a larger cross section through at least one connecting channel 254, and from which the air flows through the slots between the glass rods 251. This air is directed away from the focal line by the concentrated insolation onto an absorber structure 255 on which the air is heated by the solar energy while flowing through. Adjoining the absorber structure is the hottest flow channel 256, which guides the hot air to a collector channel. The solar radiation is absorbed on surfaces which also reflect in a directed fashion, absorb blackbody radiation at the temperature 700° K and are arranged such that the absorbed energy per surface is as constant as possible so that the heat transfer from this surface to the working means proceeds (despite the low thermal conductivity or thermal capacity of said means) takes place with minimal exergy losses (for example a glazed slotted metal sheet). The surface of the absorber can be increased by increasing the number of the surfaces, which are always aligned to be ever more parallel with the increasing number, the air being required to flow through only one surface from the focal line in order to pass into the hottest flow channel 253. Fitted upstream of the focal line in the direction of irradiation is at least one glazed flat slotted metal sheet 257 in whose plane the focal line also lies. When a larger quantity of air flows overall through the glass rods 251 per time interval in a specific section of the focal line than flows through the absorber structure 255, an air flow is formed in the region of the focal line against the direction of radiation and ensures by the formation of a nonlinear temperature profile that a specific quantity of air arrives in a hotter state at the absorber structure than without the formation of this temperature profile.

In order to be able to implement a satellite solution of the power supply by means of solar energy, for example for a remote hospital in a desert region, an entropy transformer is required in which the described collector with a parabolic fluted mirror heats air which heats a heat exchanger, likewise described, and at least two parallel-connected working volumes which are coupled to this circuit in parallel with the heat exchanger and in each case supply with compressed air a turbine which drives a generator. Cooling by water is performed via a large water tank which serves as an intermediate store, so as to be able to cool the water to lower temperatures at night. Wherever thermal energy is required at temperatures above 80° C., as in the laundry industry, large-scale catering or in disinfecting, hot air is directly cooled from the store. As a result, these consumers cause the appearance of a lower peak load in the network.

A solar collector which heats a gas over a larger temperature interval is protected by the dependent claim 155 and the following claims.

Figure 26:
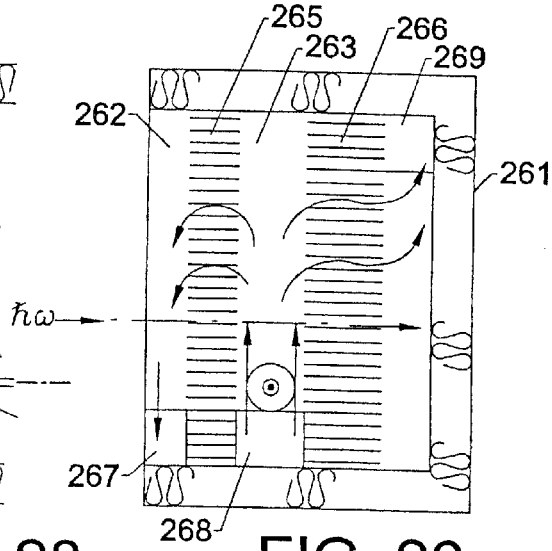
FIG. 26 is a cross-sectional view of a planar solar radiation absorber looking in a direction normal to the direction of radiation.
Figure 29:
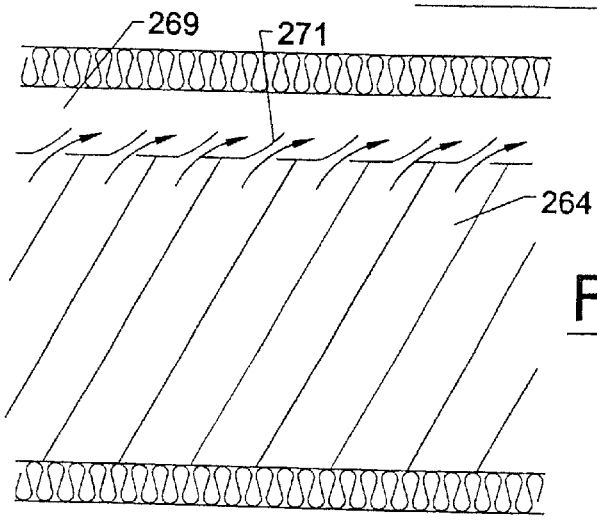
FIG. 29 is a cross-sectional view of a solar radiation absorber looking in the direction of radiation where fluid passages are located normal to the direction of radiation within the least intensively irradiated portion.
Figure 30:
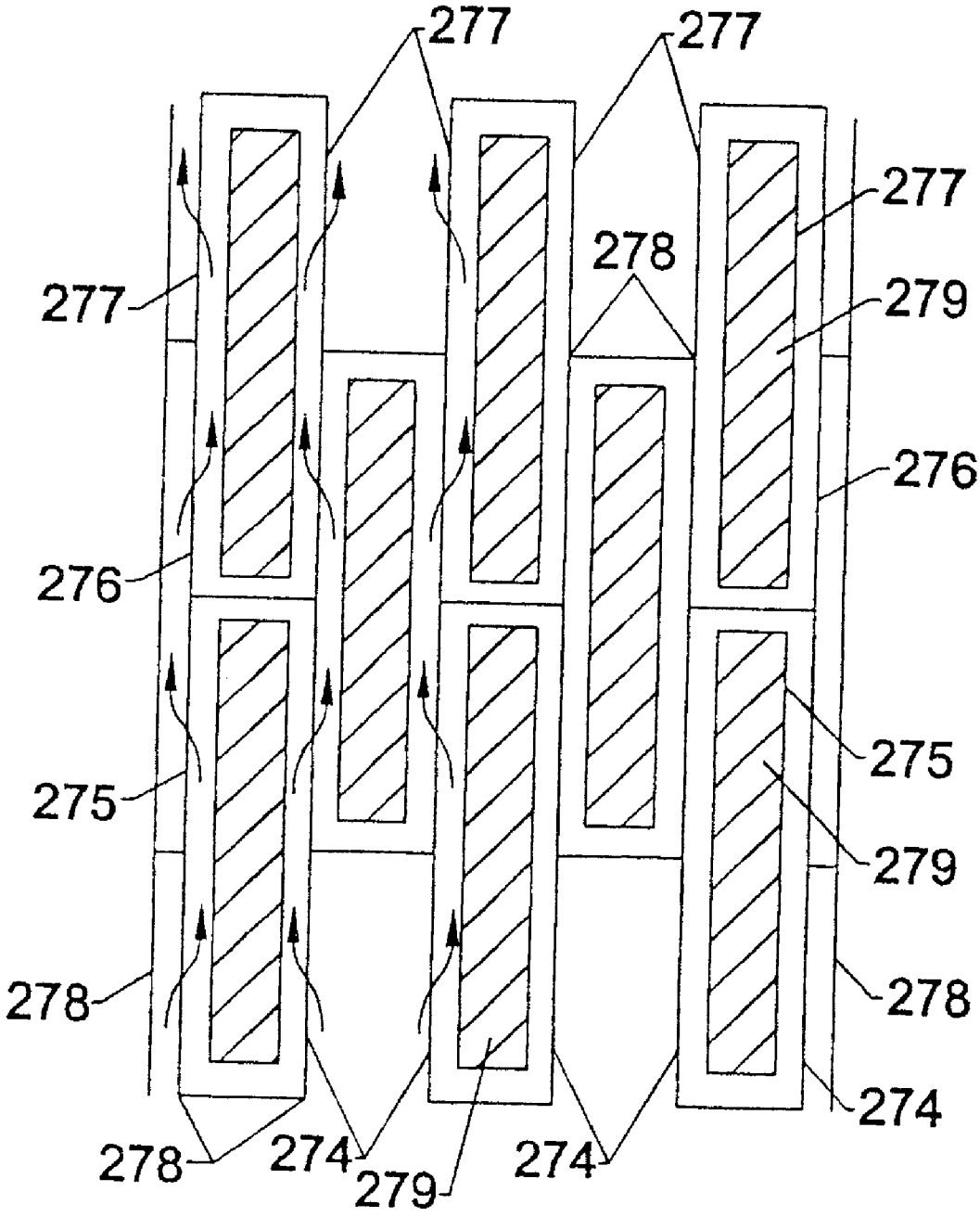
FIG. 30 shows a layout of regenerators different to that shown in FIG. 22.
Figure 31:
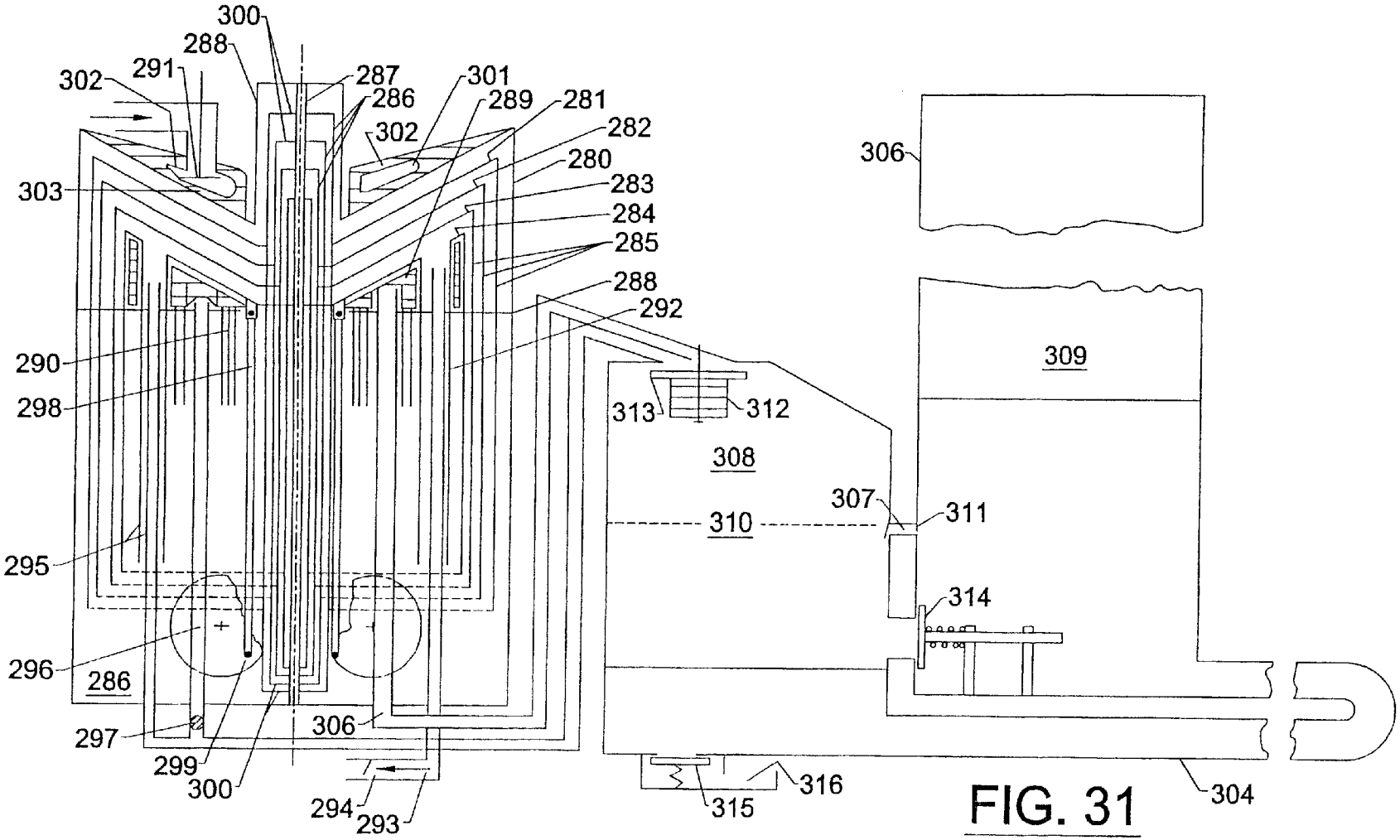
FIG. 31 is a cross-sectional view of another embodiment of the present invention.
Figures 32, 33, 34:
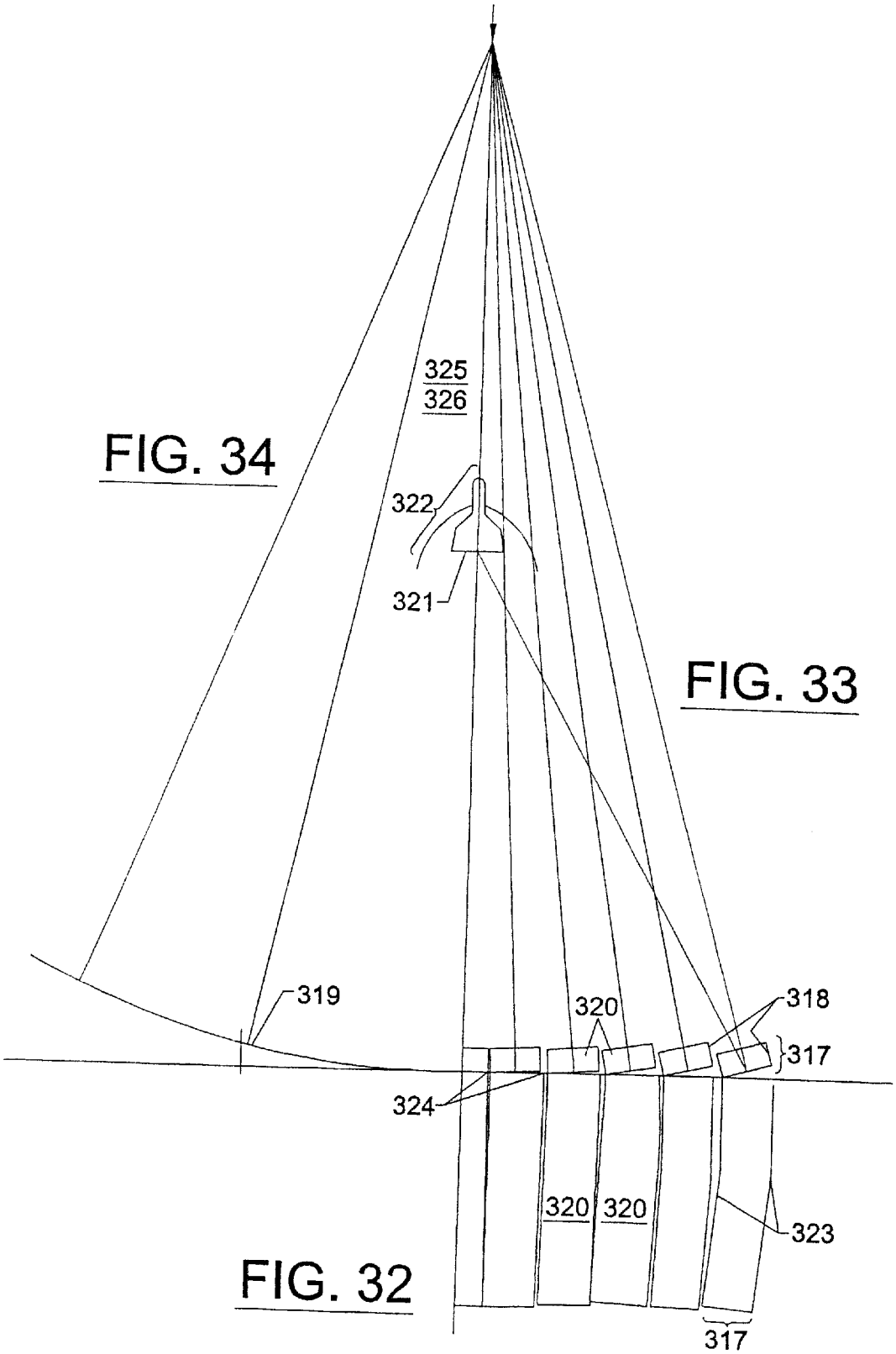
FIG. 32 is a horizontal section of a solar panel with parallel parabolic mirrors inclined against each other.
FIG. 33 is a side view of the solar panel shown in FIG. 32.
FIG. 34 is a vertical section of the solar panel shown in FIG. 32.
Figure 35:
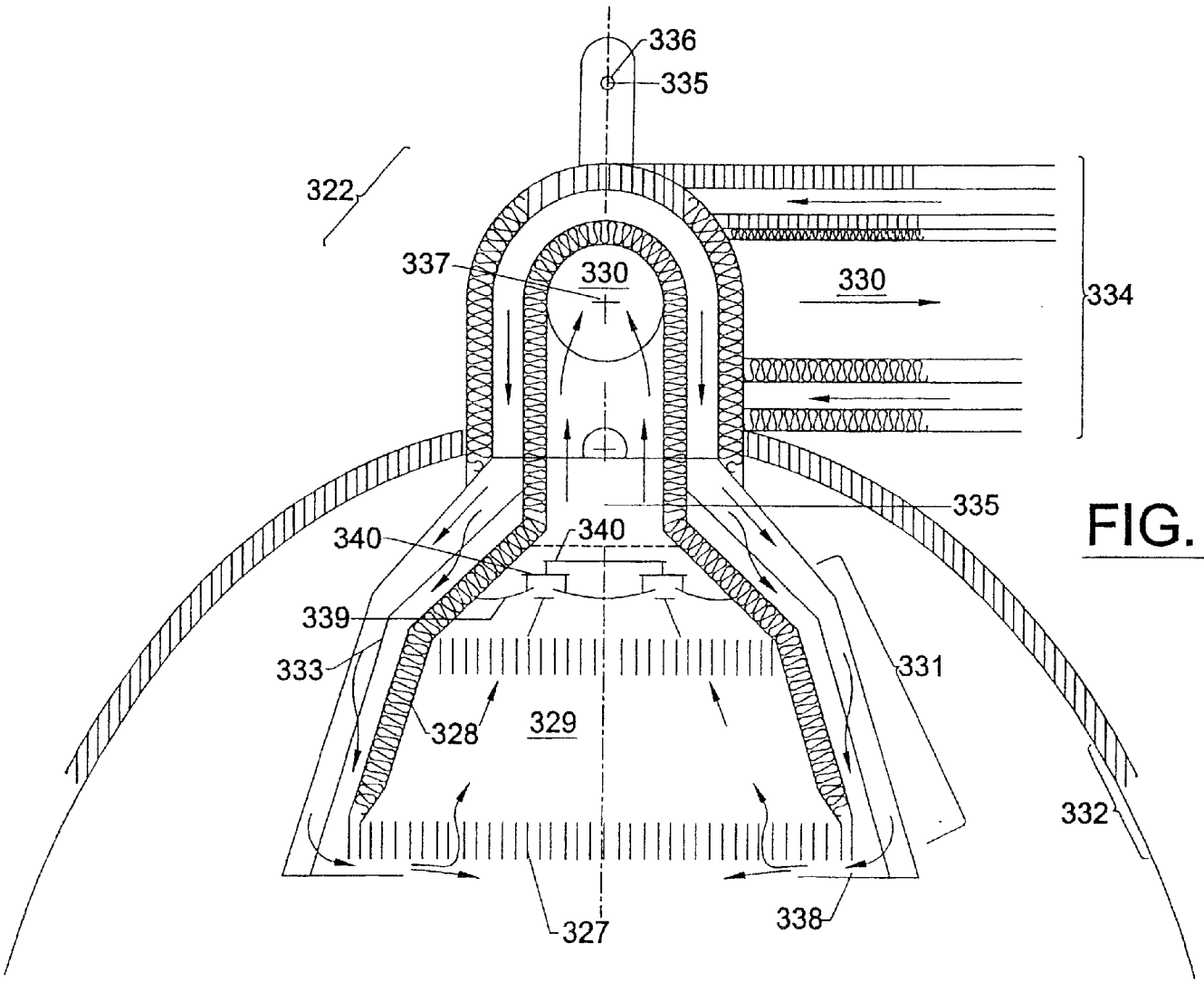
FIG. 35 is a cross-sectional view of a solar radiation absorber.
Figure 36:
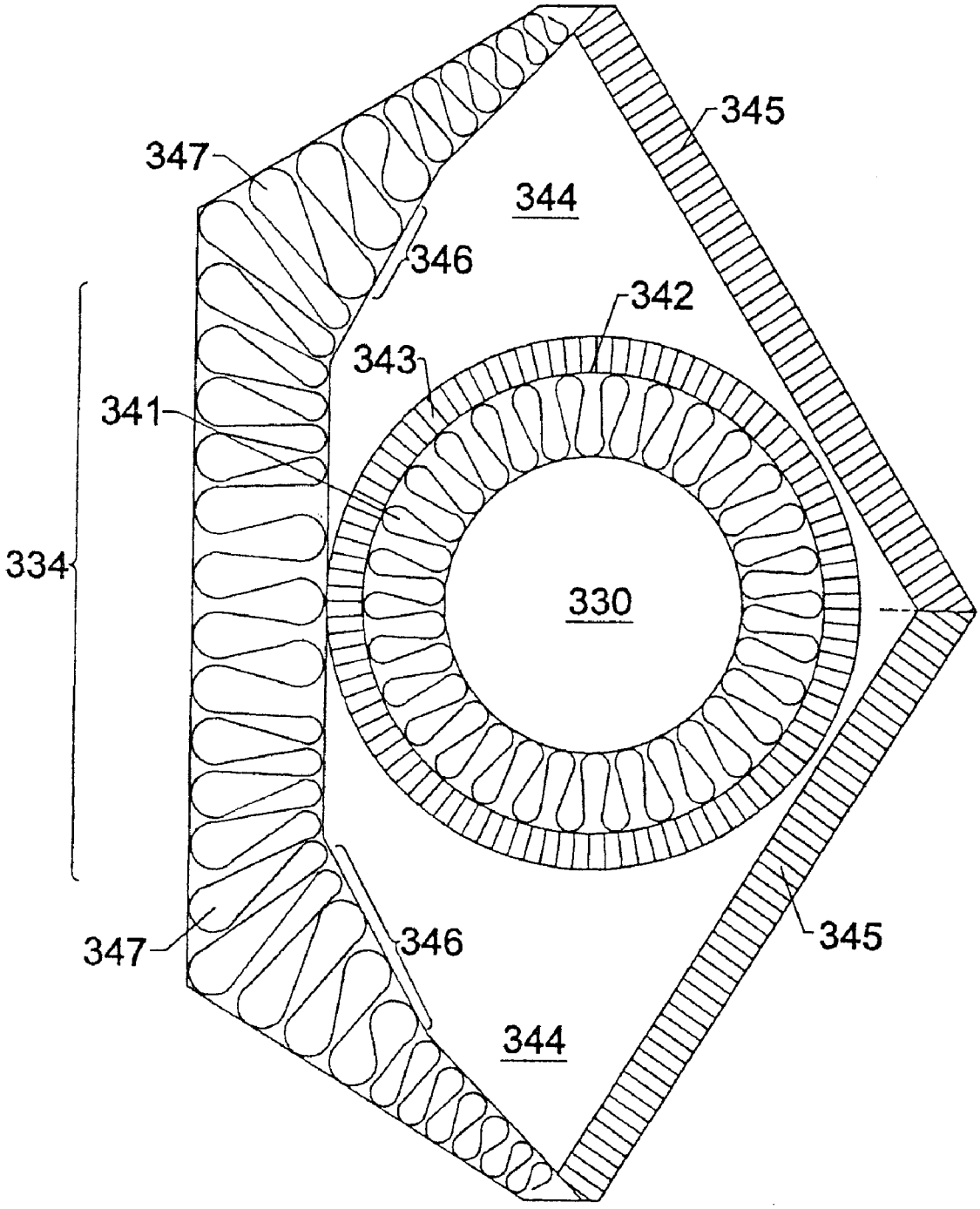
FIG. 36 is a cross-sectional view showing a supply passage of the solar panel.
Figure 37:
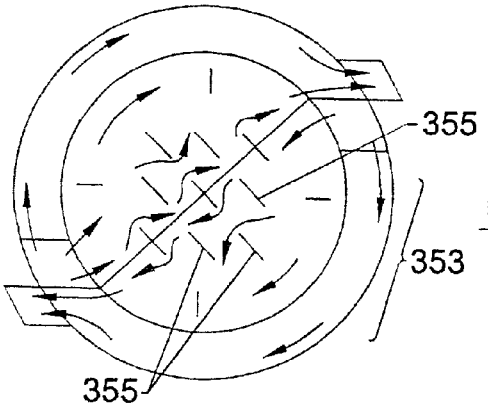
FIG. 37 is a horizontal cross-sectional view of the upper layers of a thermic reservoir.
Figure 38:
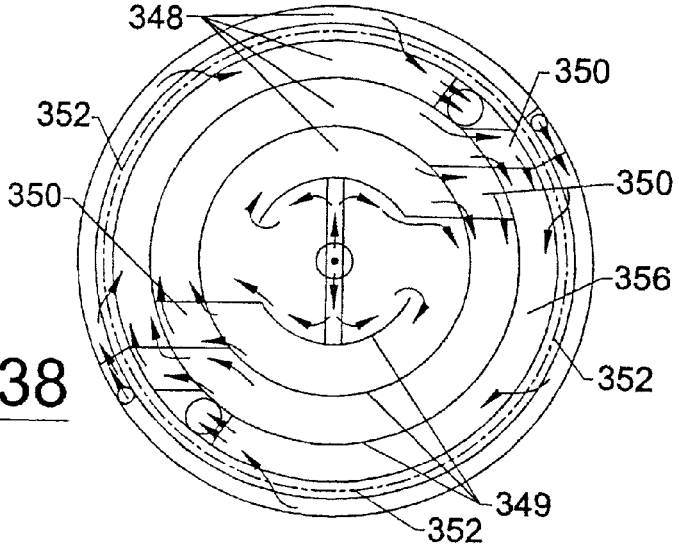
FIG. 38 is a horizontal cross-sectional view of the center of the thermic reservoir.
Figure 39:
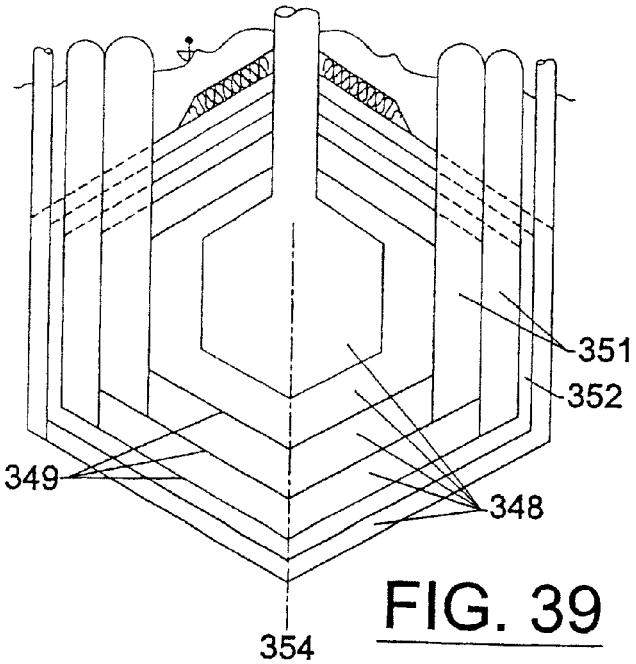
FIG. 39 is a vertical cross-sectional view of the center of the thermic reservoir.

An exemplary embodiment characterized in FIG. 26 has two layers of translucent insulation 265, 266 between a transparent cover 260 and an insulated rear wall 261, arranged in parallel, between three spaces, running parallel thereto, with flow channels 262, 263, 264 for the gas. The flow channels run at an angle of 45° to the collector channels 267, 268, 269 running in parallel. Flow channels which are separated from one another (262 and 263) (263 and 264) only by a layer of translucent insulation cross one another. The gas flowing from the translucent insulation is extracted from each flow channel 262, 264 which adjoins the translucent cover and the insulated rear wall, the extraction being performed by a collector channel through a valve 270 or 271 controlled as a function of temperature, the differential temperature in relation to the outside air being decisive at the transparent cover 260, and the absolute temperature being decisive at the insulated rear wall 261. Gas is blown into each flow channel 263 arranged therebetween by a ventilator 272 from the appropriate collector channel 268. These ventilators 272 are all arranged on a shaft 273 and dimensioned such that flowing into each flow channel 263 is a gas mass flow which is largely proportional in each case to the radiant power irradiated onto the surface of the appropriate flow channel. The translucent insulations 265, 266 consist of optionally uncoated or coated metal foil which absorbs the infrared radiation of a blackbody at a temperature of 700° K as far as possible and reflects the sunlight in as directional a fashion as possible, or of a thin metal sheet with an appropriate surface and slots 274 parallel to the transparent cover. By means of an alternating arrangement of flat and corrugated layers (cf. corrugated cardboard), it being possible to lay through each point of the metal a line which runs as far as possible overall in the material or is at least not far distant therefrom, and is parallel to a main direction, it is possible to achieve a structure which passes the direct insolation without significant losses by absorption or scattering at least given a suitable alignment. The smallest surface largely bordered by metal and perpendicular to the main direction in the translucent insulation has a size in the region of 0.25 $cm^2$ to 2 $cm^2$. A metal fabric 275 which is coated in an optically selected fashion or blackened is optionally arranged in the region of the insulated rear wall adjacent to the translucent insulation, thus providing an enlargement of the flow resistance. The aim of this flow control is to achieve a flow rate through a maximum surface area in the translucent insulations which is as constant as possible. The transparency of the gas is used in this case when the translucent insulation is flowed through. Formed as a result of the cooperation of through flow, thermal conduction and absorption of the radiant energy is a nonlinear temperature profile which runs flatter on the side of the insulation, which is flowed through, in the region of a plane from which the flow enters the insulation. A lower energy flux is therefore transferred through this plane by thermal conduction. The overall arrangement must track the solar position such that the direction of irradiation corresponds to the main direction of the collector. Overall, a final temperature which is very high for flat collectors can be achieved with this type of collector, particularly when several are connected in series. A series connection with the collectors described above, which also exhibit optical concentration, is very effective, since each collector is used in a fashion corresponding optimally to its possibilities.

Pressure Change and Mechanical Energy

A cylinder which dips with a vertical axis and a downwardly directed opening into a container with liquid can, for example, be used for directly driving a depth pump for conveying water when gas flows into the cylinder, which is moved vertically periodically, at its deepest position and flows out again through controlled valves at its highest position. The valve control is as for a historical steam engine. The difference in the hydrostatic pressure corresponds approximately to the change in pressure of the gas as it expands through this partial system. The result without valves is a partial system which functions and is designed like a historical water-wheel in conjunction with exchange of liquid and gas, both at the top and at the bottom. In this case, an apparatus such as a historical water-wheel is moved largely below the liquid surface of an overall container. Because of the low viscosity of the gas as compared with the liquid, it is necessary here to pay greater attention to sealing. This is solved without a problem by having the gas flow into and out of a container whose opening and axis of symmetry are oriented in a tangential direction and perpendicular to the shaft axis. The container is moved by the rotation such that apart from the liquid surface of the overall container there are only liquid surfaces adjoining the container wall during the predominant time periods. Gas is fed into or extracted from a container in as low as possible a position as far at the top as possible from the side through the lateral cover, which is fitted around the wheel perpendicular to the shaft axis and sealed in a fashion sliding thereagainst. The other periodic exchange of gas occurs when the container is flooded, or runs empty upon surfacing above the liquid level. This arrangement can also be used for compressing gas when the shaft is driven in the reverse direction to the case of use as a drive.

In order to achieve high powers above a few 100 kW under atmospheric pressure conditions, the surface of the regenerators 274–277, through which flow occurs, must be appropriately enlarged. In order to achieve a compact housing shape 278, the stationary regenerators 274–277 are multiply folded at a largely constant spacing along parallel lines 278 and surround on both sides at least one disc-shaped displacer element 279, moving parallel thereto periodically, as far as into the region of the central axis of the displacer element, which is parallel to the fold edges. The other half of the displacer element is correspondingly surrounded by the adjacent regenerator. In the case of a round design, the fold edges of the regenerator lie correspondingly on concentric circles.

At least one of the regenerators is optionally connected to a hydraulic or pneumatic piston, which can be moved in the stroke direction, or a membrane bellows which is emptied or filled via control valves with liquid or gas from the space around the liquid surface, removed from the corresponding working space, of the coupled oscillating liquid column.

In order also to be able to implement more specific movements such as are required, for example, for directly driving the bipartite displacer structure described below with liquid in the working space and moving regenerators, the movement is optionally tapped by a rod or a tensioned draw element (such as a cable or chain) via a movable connection by an endless draw element such as a closed chain or toothed belt which is tensioned in a force-closed fashion over a plurality of wheels, rotating at a relatively uniform angular velocity, such that the angle between the two elements during time periods of the operating state in which the driven element is to be moved only slightly in the working space (regenerator, displacer) is about 90° and becomes smaller the quicker the movement of the driven element in the working space is to be performed.

A pipeline system with underpressure, such as the boiler over a heater, is coupled to the inlet valve of a heat engine according to the invention. This system is used as a dust-extractor.

The outlay on the housing 280 around the working space can be decisively reduced by using curved shapes. The moving regenerators 281–284, designed in the form of a lateral conical surface, have good dimensional stability, can be produced with an acceptable outlay, and can be driven exclusively in the region of the cone vertices. For sealing purposes, each regenerator is connected to the lateral surface 285 of a sheet-metal cylinder or to a comparable lateral surface of a pointed conical frustum which dips at the lower end continuously into a liquid 286 and thus prevents the regenerator from being flowed around in the event of stroke movements parallel to the cylinder axis of the sheet-metal lateral surface. Conical frustums which narrow upwards are favourable as a shape for the sealing elements 285 dipping into the liquid and for the lateral housing 280, and present no problem since an expansion of the upper region takes place owing to the temperature increase. The angle of the conical frustum must be relatively acute so that the gap between two sealing elements 285 is not too greatly enlarged when they are moved apart from one another, since irreversible processes proceed in this gap owing to the heat transfer. The purpose of driving and guiding the regenerators and sealing cylinders is served by concentric tubes 286 which are guided on a stationary tube 287 on the common axis of the cylinders, and are connected to the regenerators 281–285 in the region of the cone vertices. The tubes 286 are provided in this-region in the axial direction at least with a slot through which the inner tubes are connected to the corresponding regenerators 281–284. The tubes 287 project upwards decisively over the uppermost regenerator 281 into a special indentation 288 in the working space surrounded by the housing, and are guided there in a sliding fashion on a stationary tube 287. Below the liquid surface 288, the cylinders 285 are likewise respectively connected to one of the tubes 286 also guided slidingly in this region. The space between the liquid surface 288 and the lowermost regenerator 284 at its lowermost position in the operating state is largely filled by an at least bifurcate displacer structure 289 which is moved apart in the event of an upwards movement and clears flow channels for the working gas on the parting surfaces running obliquely relative to the direction of movement. This displacer structure 289 is likewise guided in the region of the cylinder axis and moved either via a separate drive or by springs between the regenerator 284 and individual displacer elements and a sprung stop for the stop at the liquid boundary surface 288. If this displacer 285 is optionally permanently connected as an alternative in unipartite form to the lowermost regenerator 284, two parts fewer need be moved. In return, there is an increase in the dead space because of the necessary permanently present air channels through the displacer 289 or on its surface. The heat exchanger 290 is optionally fastened directly below the lowermost regenerator 284 and flowed through by a heat exchanger medium, or it is fastened with the lowermost regenerator 284 on the cylinder 285 and/or the corresponding tube 286, and dips into the liquid 286 in the lowermost position, there being an exchange of the thermal energy which is compensated in the case of continuous operation by a stationary heat exchanger which is connected, for example, to the hot water treatment system of the building. Working gas is periodically exchanged through at least one valve 291 in the housing above the uppermost regenerator 281. This exchange is compensated by the exchange of working gas, which is performed in the stroke direction from the partial space above the lowermost regenerator 284 by at least one penetrating tube which is fastened directly thereon at one end and always dips into the liquid 286. Arranged concentrically in this tube in a fashion sealingly connected to the housing is a tube 293 which projects above the liquid level 288 and from which the gas exchange is performed through at least one valve 294. Liquid can flow into this tube in the event of a rapid movement or a blockage of the lower regenerator. If this has to be avoided because of a disturbing or critical development of steam there is arranged therein at least one further tube whose upper edge projects even further beyond the liquid level. The interspace is connected through a separate valve, which is controlled together with the gas valve, to a space which is also connected to the space with which the working space exchanges gas through the adjoining tube. Depending on the design of these valves, it can optionally be simpler as an alternative to monitor the water level via an additional corresponding tube arrangement, cf. 295, in which the tube for the gas exchange is eliminated. This tube, cf. 295, is also fed water via a further tube, cf. 296, which is used as an overflow and is arranged in the stroke direction largely inside the liquid with an opening at the level of the largely stationary liquid level, without penetrating a regenerator. A porous structure, cf. 297, is integrated into the lower region of the overflow, cf. 296, without the possibility of being flowed around, in order that the lowermost regenerator cannot be flowed around by this tube arrangement.

Movably fastened on a plurality of regenerators 281–284 or elements rigidly connected thereto are intermediate levers which in each case are connected movably at the other end to different points of at least one further main lever which is movably connected to the housing optionally directly or via a lever. The uppermost regenerator 281 acts movably directly or indirectly on the main lever at a point which is arranged closest to the point at which the direct or indirect movable connection to the housing is made. The mirror symmetry of this lever arrangement relative to a plane in which the stroke direction also lies has the effect that no lateral forces are transmitted onto the regenerator structure, particularly when the lever arrangement is situated below the surface centroids.

One of the lowermost regenerators is movably connected via connecting rods 298 to two driven crankshafts 299 which are arranged and moved in a mirror-symmetric fashion relative to a plane in which the stationary guide element 287 lies in the stroke direction. It follows that in relation to the stroke direction weaker lateral forces are transmitted to the regenerator arrangement 281–285 which would have to be absorbed by the guides 300 and lead to additional wear, particularly when the connecting rods 298 run below the surface centroid of the regenerators 281–284. Fitted on the crankshaft 299 opposite the connecting rod bearing are masses which at least partially compensate the weight of the regenerator arrangement by their weight force. As an alternative for the drive system of the regenerators, a plurality of regenerators are optionally movably connected at least to one each of the connecting rods, which are mounted with the other ends on spindles of at least one crankshaft, all of which can be intersected by a line through the axis of rotation, parallel thereto, of the crankshaft, the bearing for a connecting rod of the lowermost regenerator being furthest distant from the axis of rotation of the crankshaft, and the bearing of the uppermost regenerator being closest. As in the case of a comparably used Stirling engine, at least one regenerator is driven with a phase shift of a quarter (25%) of a period relative to the volume change. In the time period with the lowest pressure in the working space (working space= working volume) with a periodically varying volume, in the case of operation as a prime mover the periodic acceptance, and in the case of operation as a heat pump or refrigerating machine the periodic output of working fluid is performed through a valve 291 which adjoins in the working space a partial space 301 of constant volume which is completely surrounded by two regenerators 302–303, one of these regenerators 302 adjoining the housing relatively directly. As an alternative to the drive described above, at least one guide element is optionally designed in the stroke direction 287 at least partially as a threaded rod or recirculating ball screw, and an element engaging therein moves at least one regenerator, connected thereto, by rotating the threaded rod or recirculating ball screw in the stroke direction. As a specific alternative, the threaded rod or recirculating ball screw optionally has regions with different screw pitches in which the connecting elements of the regenerators moved at different speeds engage, with the result that they are moved at different speeds in the stroke direction during a rotation of the threaded rod or recirculating ball screw, it being possible thereby for the number of moving parts to be substantially reduced. A heat engine according to the invention can thus be designed with only five moving parts and the necessary valves.

In these alternatives, a recirculating ball screw and connecting elements engaging there which each have a closed, intercrossing threaded track are optionally used to move the regenerators periodically up and down during rotation of the recirculating ball screw at constant speed in the stroke direction, or at least one threaded rod or recirculating ball screw is periodically rotated in a different direction, optionally by a mechanical control system or directly by an appropriately controlled motor. In this case, for a design which can be implemented using commercially available parts, the lowermost regenerator engages in a recirculating ball screw with a closed track, and at least a portion of the other regenerators engage, rather, in conventional threaded tracks whose tracks are not closed. The lowermost regenerator is thereby prevented from striking the liquid surface. The guide tube is periodically or continuously flowed through in the middle by working gas from the coolest partial space. A radial ventilator is connected to the tube with the aid of a thread or recirculating ball screw, and the tube in this region is opened laterally just as in the coolest partial space on the other side of the middle of the tube. A separate pipeline for working gas leads from the space adjoining one opening of the guide tube to the space which adjoins the other opening in the region of the liquid surface. It has already been shown that a periodic compression increases the energy conversion by periodically changing the volume of the working space. This is achieved most effectively by virtue of the fact that a tube 304 with a water column 305 oscillating in the operating state is coupled to the coldest region in the working space. For this purpose, a tube 306 is guided out of the housing 280 in the stroke direction with an opening above the liquid level 288. In the case of a system with a single working space, the other end of the coupled tube 304 of the liquid column 305, which resonates periodically, is connected to a pressure vessel 306. The two spaces 308, 309 adjoining the ends of the liquid column 305 are optionally connected 307 at the level of the targeted average liquid surface 310 to a pressure reducing valve 311, with the result that for pressure compensation only a negligible quantity of liquid, but a substantial quantity of gas, can flow through periodically, or a lower fraction of the working gas is fed per period from the working space to the pressure vessel through a tube system with a non-return valve and a further pipeline with a non-return valve is connected to the pressure vessel at the targeted average level of the liquid surface, which leads into the space which adjoins the other end of the liquid column, as a result of which only a negligible quantity of liquid, but a substantial gas flow, flows periodically. The quantity of gas in the pressure vessel is stabilized thereby. Fitted on the connection from the working space to the tube with the oscillating liquid column is a valve 312 which has in the flow direction of the working space a stop against which the valve plate 313 is sealingly pressed as soon as the liquid column has moved too far in the direction of the working space. When this valve is closed, the overpressure building up upstream of it can reach the other end 309 of the oscillating liquid column 305 through a pressure relief valve, leading out of this space 308 and connected correspondingly to the tube system of the oscillating water column, and a specific tube (into the pressure container).

A further pressure release valve 315, coupled to the same space 308, leads to an external container 316 instead of to the pressure vessel 309. The liquid level in this container is kept constant at the highest possible level. It is connected with the aid of a further non-return valve to an end of the tube system around the oscillating water column, through which a small quantity of the liquid can flow back again in specific time periods. Fastened on the lowermost periodically moving regenerator is a tube 295*a* which runs in the stroke direction and into and from which gas can flow unimpeded from the partial space adjoining thereabove, and whose lowermost end always dips into the liquid. Arranged concentrically in this tube 295*a* in a fashion sealingly connected to the housing is a tube 295*b* whose upper edge corresponds to the level of the maximum liquid surface 288 present at the sealing cylinder 285 of the regenerator, and which leads, in a region in the working space above the safety valve 313 at the access to the oscillating water column 305, from which the possibly overflowing liquid reaches the liquid of the oscillating liquid column 305. A tube 299 whose upper edge ends in the lowermost partial space at the level of the targeted liquid surface 288 in the working space is connected as far down as possible to the previously described tube 295 which leads to the oscillating liquid column 305. When the liquid level in the working space 288 is higher than the connection of the tube end, connected thereto, at the oscillating liquid column in the case of the valve 313, a porous structure 297 which cannot be flowed around is integrated into the abovedescribed tube system upstream of the inlet. Every time the machine is started, a specific quantity (for example 31) of liquid is fed to the working space through a valve. The remainder of the management of the various liquid quantities in the machine is performed automatically using the design described above and the functional relationships.

The pressure vessel can optionally be replaced by a further working space in which the thermodynamic cycle proceeds offset by half a period in conjunction with an identical length of period.

The principles of optical concentration and translucent thermal insulation are combined in the design of the solar collector. The mirrors therefore do not have to lead to high concentration factors (>100). Because of the only one-dimensional curvature, it is favourable to use mirror flutes 317 to construct the collector inexpensively. In craft terms, a fluted mirror 317 is implemented with a high degree of flexibility as regards dimensions and shape, without an expensive production structure from commercially available materials such as, for example, from wood and sheet metal. For this purpose, the profile 319 of the flute is cut out from a plate material 318 such as plywood, with the aid of a compass saw. At least two of these plates are connected in a largely parallel fashion such that the two profile edges are ideally touched at any desired point by a line perpendicular to the plates 318. A flexible flat material 320 such as sheet metal or thin (5 mm) plywood is optionally fastened to the profile edges 319. The sheet metal can itself have a reflecting surface. Mirrored foil or a thin glass mirror must be applied to plywood. A plurality of these mirror flute elements 317 are arranged such that above all in spring and autumn at 12 noon the solar radiation reflected by the individual mirror flute elements 317 can be absorbed on as small a surface 321 as possible. This design of the concentrating mirror can be well integrated on a house roof in terms of construction and architecture: The optical concentration factor is also still good enough when only the absorber 322 is tracked and the mirror is permanently connected to the house roof. The edges of the mirror segments 323 emphasize the vertical, and so the mirror is more easily accepted as a roof in emotional terms. A flute 324 in which water can run off is arranged between two mirror elements. The mirror system thus forms the uppermost covering of the roof. As an alternative to a solidly constructed building, it is optionally favourable to produce this structure with the aid of an appropriately shaped concrete flute. The described structure also has a favourable effect here, since no horizontally running flutes are constructed in which water or wet snow can collect, something which can lead to the ingress of water, damage by frost and leakiness. As an alternative, the mirror structure is optionally moved about an axis. Thus, it is advantageous when a surface perpendicular thereto penetrates the mirror in a largely parabolic line and the absorber 322 is tracked such that and rotated such that its main axis or axis of symmetry 325 corresponds to the main direction 326 of the absorbed radiation. The absorber 322 is in this case always located in the plane of symmetry of the parabolic fluted mirror 317, resulting in a good concentration ratio. The core region of the absorber 322 comprises a flat translucent thermal insulation (=TTI) 327 which, together with an insulated container 328, surrounds an interior 329 from which the charged heat transfer medium (for example the heated air) is extracted through a pipeline system 330. The absorber is arranged at a relatively large spacing of the order of magnitude of the extent of the TTI from the TTI, the side walls being mirrored so that a more uniform radiation density occurs at the absorber. The insulated container 328 with a reflecting inner wall forms the rear wall of an upstream solar collector 331 which feeds energy to the heat transfer medium before it can flow through the TTI 327. This collector 331 is supplied with solar radiant energy, which the TTI 327 has just been missing, by a further mirror 332 connected to the absorber 322. In the case of this collector 331, as well, the absorber 333 is flowed through in the beam direction by the heat transfer medium, which is fed to the entire absorber structure by the pipeline system 334 via at least one movable connection. The absorber structures 322 of a plurality of mirrors aligned in parallel and having identical focal lengths are linked relatively directly to a co-moving pipeline system 334. An absorber is movably connected to three fixed points via three gear racks, and the spacing can be changed in each case by a displacement in the rack direction under the control of motor power. At least one absorber 322 is displaceably connected to a gear rack in the rack direction under the control of motor power, which rack is movably connected via two further gear racks to two fixed points in each case, and the spacing can be varied in each case in the rack direction under the control of motor power. At least one absorber is movably connected to another absorber and is moved only with the aid of two gear racks. The connecting tube 334 of the heat transfer medium is used also to determine the orientation of the absorbers 322, which are fastened thereon, with reference to the tube axis. The rotation of an absorber about an axis of rotation perpendicular to the horizontal east-west axis and to the axis of symmetry of the absorber in the main beam direction is performed by parallel coupling with the aid of cables to a gear rack which at 12 noon runs as closely as possible on a vertical plane in north-south direction, the points of rotation 336 of the cables being arranged on a plane through the axis of rotation 337 of the absorber 322 or the axis of rotation of the fastening of the gear rack on the absorber structure and are situated on both sides of these axes of rotation 337, . . . and in the case of a projection into a plane perpendicular to the axis of rotation 337 of the absorber 322 also form with the connecting line through the axes of rotation 337, . . . at least approximately parallelograms whose angles are ideally 90° at 12.00 noon. As an alternative to the cable structure just described, the rotation of an absorber 322 about an axis of rotation perpendicular to the horizontal east-west axis and to the axis of symmetry of the absorber in the main beam direction is performed by parallel coupling with the aid of racks to a gear rack which at 12 noon runs as closely as possible on a vertical plane in north-south direction, the points of rotation of the racks being arranged on a plane through the axis of rotation of the absorber or the axis of rotation of the fastening of the gear rack on the absorber structure and in the case of a projection into a plane perpendicular to the axis of rotation of the absorber also form with a line through the axes of rotation at least approximately a parallelogram whose angles are ideally 90° at 12.00 noon. The gear rack is formed by a carrier on which there is fastened a chain in which a sprocket engages which is driven by a motor via an irreversible gear. The sprocket is guided on the chain by at least one roller which is pressed from the other side against the carrier. A gear rack can be set up vertically to such an extent and lengthened down to near the ground such that the absorber structure can be lowered down to near the ground along this gear rack by moving the engaging drive.

The fulcrum for the absorber structure with gas guidance channels 322 is further distant in the beam direction from the large-area main mirror 319 than the fulcrum for the smaller mirror 332, arranged additionally around it. Consequently, in the case of oblique incidence the optical error can be more effectively compensated, in order to achieve a higher degree of collector efficiency. The translucent thermal insulation 327 comprises a flat carrier structure, arranged in the direction of a radiation, such as, for example, a plurality of slotted metal sheets with slots arranged perpendicular to the direction of radiation, which structure is surrounded by a transparent structure and/or above all by a structure which reflects in the direction of radiation and is made from glass fibres in the direction of radiation. Optionally in addition, or as a substitute to the glass fibres, glass tubes or rods are optionally arranged in the beam direction. The collector 16 is completely covered by glass 23. The TTI 327 is covered by glass 337 only to the extent required for guiding the heat transport medium of air in a flow sufficiently parallel to the TTI 327. As a result, this TTI 327 is rendered insensitive to contamination of the pipeline system, and no reflection occurs during transmission of the radiation. The air flows are controlled, in particular in the case of attenuated solar irradiation, such that more air is blown out of the collector 331 upstream of the TTI 327 than is exhausted by the TTI 327. In addition to the screening of the TTI thus achieved by the build-up of a hot gas cushion, contamination of the TTI by unfiltered outside air is thereby reduced.

Because of the tracking, the solar radiant energy is concentrated by the mirror structure above all onto the translucent thermal radiation TTI 327 of the absorber. The solar radiation will penetrate at least the front part of the TTI 327 predominantly without absorption, and subsequently be absorbed in the absorber structure. The thermal energy can escape against the beam direction from the absorption region only after overcoming decisive hurdles owing to the TTI 327, since the thermal radiation of the absorber or of each emitting surface is largely absorbed only by surfaces which have a relatively small temperature difference, and in addition the convection is suppressed by the large surfaces of the TTI 327, which subdivide the relevant convection space. A substantial portion of the thermal energy which has been transferred by the processes mentioned into less hot regions of the TTI 11 is absorbed there from the flow of the heat transfer medium (for example air flow) in the beam direction. This yields a curved temperature profile whose gradient increases decisively with increasing temperature. Since the gradient on the cooler side the TTI 11 becomes smaller with an increasing rate of flow of the heat transfer medium through the TTI 327 in the case of a constant temperature difference at the surfaces of the TTI, the flow of waste heat through the cooler surface of the TTI is reduced.

The absorber is subdivided into regions through which flow is controlled as a function of temperature, in order to avoid thorough mixing of heat transfer medium with large temperature differences in the output manifold 330. The cross section through which flow can occur is intended to remain constant in this region, in the process. This is achieved by virtue of the fact that the throughflow is controlled by bimetals 339 of which in each case two are connected to a beam 340 as in the case of a set of scales, the suspension of two corresponding beams being movably connected again to a centrally suspended beam.

The pipeline 330, through which the hot gas is removed from the absorber 322, is sheathed with an insulation 341 with an outer surface 342 with good thermal conduction and, optionally, good or selective absorption, which in turn is largely completely sheathed by a translucent thermal insulation 343 and runs in a space 344 which is flowed through by the hot gas of the thermal energy carrier circuit on the way to at least one absorber 322, and which for the alignment at 12 noon in autumn is surrounded on the directly irradiated side by a translucent insulation 345, which cannot be flowed through, and from the other side by a mirror 346, the upwardly directed surface of which is adjoined by an insulation 347 and a weather guard and which reflects the incident light above all onto the side of the inner tube 342 not directly irradiated, and is thus completely sheathed.

A bulk material store functions effectively in thermodynamic terms and is designed with an acceptable outlay by virtue of the fact that the bulk material 348 flowed through by the heat transfer medium (for example air) is divided by at least one insulting interlayer 349, which cannot be flowed through, into concentric shells with a cylindrical lateral surface with a vertical axis and outwardly curved base and top surfaces, and the transitions 350, which can be flowed through, take place from an inner shell, filled with bulk material, to the adjoining outer shell through openings in the insulating cylinder lateral surface 349, which are arranged in the region of a plane through the cylinder axis on both sides in each case, and the flow is guided by connections, which cannot be flowed through, running in the region of this plane such that the shells can be flowed through only in one direction of revolution about the vertical cylinder axis.

A transition between two half shells filled with bulk material is possible only in the case of flow through a vertical shaft 351 via which it is also possible to exchange heat transfer medium. As a result, by reducing the inflow channel in places it is possible to control the flow such that only heat transfer medium in a narrow temperature range flows in the shaft.

One of the outermost insulation layers 352 is flowed through from one bulk fill layer to the other. A decisive curvature of the temperature profile is formed thereby, as a result of which on the basis of the shallower gradient on the cooler side only a lower rate of flow of lost thermal energy occurs on the cooler side than without the throughflow against the temperature gradient.

The flow paths are lengthened by additional smaller barriers 355, which cannot be flowed through, in the horizontally running bulk material layers 353, above all in the region of the cylinder axis 354. As a result, these bulk material layers 353 are also flowed through in a relatively uniform fashion, the flow paths are approximately of equal length as in the cylinder lateral surface 356, and there is no unfavourable mixing of heat transfer medium at a different temperature.

For the purpose of seasonal storage, the bulk material store is heated in conjunction with the cooling of hot inflowing air and cool outflowing air to far above 100° C., and a few weeks later thermal energy is extracted from the bulk material store by air which flows at approximately 50° C. into the outer region of the store and is extracted through one of the air channels at 120° C.–150° C. and subsequently cooled by a heat exchanger which heats water from approximately 40° C. to 100° C. which is extracted from an insulated water reservoir in the lower region and fed into the upper region. The waste heat from the heat engine operated as a hot gas engine is used in buildings to supply energy for heating and hot water. An accumulator is interposed in order to decouple the operation of the machine from the heat requirement in terms of time. A high synergy effect is achieved when the accumulator is filled not with pure water but with biological waste and faeces. Particularly when the aim is seasonal heat storage, the faeces are too hot in summer for decomposition reactions or biogas production to be able to proceed to a considerable extent. This effect is used in a similar way in the preservation of fruit. The production of biogas can ensue when this accumulator is cooled in late autumn or winter. Not only is thermal energy stored seasonally thereby, but there is also an indirect storage of biogas.

It will be apparent to those skilled in the art that various modifications and variations can be made in the present invention without departing from the scope and spirit of the invention. For example, specific shapes of various elements of the illustrated embodiments may be altered to suit particular applications. It is intended that the present invention include such modifications and variations as come within the scope of the appended claims and their equivalents.

What is claimed is:

1. A method for entropy transfer via at least one open periodic thermodynamic cyclic process using at least one working volume filled with a working fluid and at least one central partial volume in the working volume, which is located between at least two isothermal sectional areas, the method comprising:

periodically modifying the at least one central partial volume in size, wherein a flow of working fluid through the at least one central partial volume takes place from one isothermal sectional area to the other one, wherein an exchange of working fluid takes place at different pressure levels and at different time periods from at least one of 1) the working volume to at least one volume having a largely constant pressure and 2) at least one volume having a largely constant pressure into the working volume, wherein a modification of the working fluid temperature averaged through the working volume is concurrently brought about by the periodic modification of size of the at least one central partial volume, wherein the at least one central partial volume is modified in size during the exchange of working fluid at a largely constant pressure, wherein the size of the at least one central partial volume, or the ratio of its size relative to that of the working volume, is largely kept constant when the pressure in the working volume is modified without exchange of working fluid, wherein heat is input or output in the range of the at least two isothermal sectional areas, wherein one respective further partial volume borders on each of the flow section isothermal areas delimiting the at least one central partial volume, the working fluid in the partial volumes presents different temperatures, and the sizes of the partial volumes are modified periodically, and wherein, during a time interval much longer in comparison with the duration of one period of the cyclic process, either intake of heat energy to or discharge of heat energy from the working fluid in the working volume takes place with the aid of at least one substance of at least one continuously or periodically increasing and decreasing mass flow at a sliding temperature or at several temperature levels.

2. The method according to claim 1, wherein the intake of working fluid into the working volume and the discharge of working fluid from the working volume each take place starting out from partial volumes having different temperatures and being separated by one of the isothermal sectional areas in the range of which heat energy is taken in by or discharged from the working fluid.

3. The method according to claim 1, wherein a further exchange of working fluid takes place at identical time periods and at approximately identical pressure levels.

4. The method according to claim 1, wherein the size of the at least one working volume is modified periodically.

5. The method according to claim 1, wherein the size of the at least one working volume is modified periodically, primarily in those time periods during which no intake or discharge of working fluid into or from the working volume takes place.

6. The method according to claim 1, wherein the at least one substance is the working fluid.

7. The method according to claim 1, wherein the open periodic cyclic process is powered by the group consisting of solar energy, combustion energy from regenerative renewable raw materials, waste heat and nuclear power.

8. The method according to claim 1, wherein the drive energy is intermediately stored in a storage flowed through by the at least one substance having the form of a bulk material.

9. A device for entropy transfer comprising:

at least one working volume filled with a working fluid in a pressure vessel, at least two flow passage devices capable of containing a flow of working fluid therethrough, for confining at least one central partial volume periodically modified in size in the working volume, at least one device for periodically modifying the size of the at least one central partial volume, so that a modification of the temperature of the working fluid averaged through the working volume is concurrently brought about thereby during the working fluid exchange at a largely constant pressure, and the size of the at least one central partial volume, or the ratio of its size relative to that of the working volume, is largely kept constant when the pressure in the working volume is modified without exchange of working fluid, at least one device for modifying the pressure in the working volume, at least one device for intake of heat energy to or discharge of heat energy from the working fluid in the working volume with the aid of at least one substance of at least one continuously or periodically increasing and decreasing mass flow at sliding temperature or at several temperature levels during a time interval much longer in comparison with the duration of a period of the cyclic process, wherein at least one valve is opened for the intake of working fluid or discharge of working fluid from at least one or into at least one space having a substantially constant pressure for the purpose of the exchange of working fluid at different pressure levels, wherein heat energy is taken in by or discharged from the working fluid and respective isothermal sectional areas interconnected via a seal device or the delimitation of the working volume extend in the range of the at least two flow passage devices, wherein in the range of the flow passage devices one partial volume each periodically modified in size and having a different temperature borders on the side of the isothermal sectional areas facing away to the central partial volume.

10. The device according to claim 9, wherein a regenerator is arranged in the range of the isothermal sectional area where heat energy exchange takes place.

11. The device according to claim 9, wherein a heat exchanger is arranged in the range of the isothermal sectional area where the heat energy exchange takes place.

12. The device according to claim 9, further including a control system for periodically moving the at least two flow passage devices against each other, to reduce the central partial volume between the flow passage devices to the clearance volume during at least one time period.

13. The device according to claim 9, wherein the at least two flow passage devices are fixedly mounted in the working volume, and the intermediately positioned, central partial volume is reduced to the clearance volume during at least one time period with the aid of at least one displacement member periodically interposed by the control system.

14. The device according to claim 9, wherein the at least two flow passage devices have the form of displacement pistons movable against each other, with the central partial volume being located between two respective displacement pistons.

15. The device according to claim 9, further including a compressing device for periodically modifying the size of the working volume.

16. The device according to claim 15, wherein the compressing device comprises at least one movable liquid column.

17. The device according to claim 15, wherein the compressing device is a resonant oscillating system synchronised with the other periodical movements.

18. The device according to claim 15, wherein the control system is designed for control and feedback control of the compressing device.

19. The device according to claim 9, wherein the flow passage devices capable of containing a flow of working fluid therethrough serve the purpose of separating, purifying, or physically or chemically modifying the substances contained in the working fluid.

20. The device according to claim 9, wherein the direction of movement and the axis of symmetry of the flow passage devices is vertical, and the flow passages in particular are conical in shape.

21. The device according to claim 9, wherein two respective, not immediately neighbouring flow passage devices each are coupled to each other at fixed spacings in a direction of movement via members, and two respective, immediately neighbouring flow passage devices each periodically move towards each other and away from each other again.

22. The device according to claim 9, further including a turbine connected to two spaces having different pressures, wherein the two spaces are connected with the working volume through the intermediary of the at least one valve.

23. A device characterised by serial arrangement of a plurality of devices in accordance with claim 9.

24. A device characterised by parallel arrangement of a plurality of devices in accordance with claim 9.

25. The device according to claim 9, wherein at least one of the flow passage devices is driven at a phase difference of one quarter (25%) relative to the compressing device.

26. The device according to claim 9, characterised by use in the framework of combined heat and power generation for short-distance and long-distance heat energy networks.

* * * * *